US012196524B2

(12) United States Patent
Trpkovski

(10) Patent No.: US 12,196,524 B2
(45) Date of Patent: Jan. 14, 2025

(54) LINEAR CROSSBOW

(71) Applicant: Ravin Crossbows, LLC, Superior, WI (US)

(72) Inventor: Paul Trpkovski, Kailua Kona, HI (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

(21) Appl. No.: 18/412,281

(22) Filed: Jan. 12, 2024

(65) Prior Publication Data

US 2024/0271899 A1 Aug. 15, 2024

Related U.S. Application Data

(63) Continuation of application No. 18/094,921, filed on Jan. 9, 2023, now Pat. No. 11,874,084, which is a continuation of application No. 16/840,446, filed on Apr. 5, 2020, now Pat. No. 11,549,777.

(60) Provisional application No. 62/829,913, filed on Apr. 5, 2019.

(51) Int. Cl.

| | |
|---|---|
| ***F41B 5/12*** | (2006.01) |
| ***F41B 5/00*** | (2006.01) |
| ***F41G 1/38*** | (2006.01) |
| ***F41G 1/467*** | (2006.01) |
| ***F41G 11/00*** | (2006.01) |
| *F41B 5/14* | (2006.01) |

(52) U.S. Cl.

CPC ..... *F41B 5/123* (2013.01); *F41B 5/0094* (2013.01); *F41G 1/38* (2013.01); *F41G 11/003* (2013.01); *F41B 5/1469* (2013.01)

(58) Field of Classification Search

CPC .... F41B 5/12; F41B 5/123; F41B 5/14; F41B 5/1403; F41B 5/0094; F41G 1/38; F41G 1/467; F41G 11/003

USPC ..... 124/25, 86, 87; 33/265

See application file for complete search history.

(56) References Cited

U.S. PATENT DOCUMENTS

| | | | | |
|---|---|---|---|---|
| 1,261,992 A | | 4/1918 | Algie | |
| 2,814,284 A | * | 11/1957 | Sileo | F41B 5/12 124/87 |
| 3,224,427 A | * | 12/1965 | Ronan | F41B 5/12 124/35.1 |
| 4,169,456 A | | 10/1979 | Van House | |
| 4,766,874 A | | 8/1988 | Nishioka | |

(Continued)

FOREIGN PATENT DOCUMENTS

WO WO 2021/194387 A1 9/2021

OTHER PUBLICATIONS

O'Neal, 3DR Holdings, New 3D Printed Vincy Compound Bow Prototype Hits the Mark for Fun; 5 pages, Nov. 19, 2014.

*Primary Examiner* — Alexander R Niconovich
(74) *Attorney, Agent, or Firm* — Foley & Lardner LLP

(57) ABSTRACT

A crossbow includes a stock defining a projectile axis, a drawstring configured to move along the projectile axis between an undrawn position and a drawn position, the undrawn position defining a first power stroke end, the drawn position defining a second power stroke end, and a scope rail mount including a first support and a second support, the first support coupled to the stock at a first mount location positioned rearward of the first power stroke end, the second support coupled with the stock at a second mount location positioned rearward of the first mount location and forward of the second power stroke end.

19 Claims, 70 Drawing Sheets

(56) References Cited

U.S. PATENT DOCUMENTS

| | | | | |
|---|---|---|---|---|
| 4,917,071 | A | 4/1990 | Bozek | |
| 5,092,308 | A * | 3/1992 | Sheffield | F41B 5/12 124/91 |
| 5,630,405 | A | 5/1997 | Nizov | |
| 5,720,268 | A | 2/1998 | Koltze | |
| 6,273,078 | B1 | 8/2001 | Schwesinger | |
| 7,506,643 | B2 * | 3/2009 | Holmberg | F41B 5/12 124/87 |
| 7,624,724 | B2 | 12/2009 | Bednard et al. | |
| 7,810,480 | B2 | 10/2010 | Shepley et al. | |
| 7,926,474 | B2 | 4/2011 | Berry | |
| 7,997,258 | B2 | 8/2011 | Shepley et al. | |
| 8,485,170 | B1 | 7/2013 | Prior | |
| 8,522,762 | B2 | 9/2013 | Trpkovski | |
| 8,567,376 | B2 * | 10/2013 | Flint | F41B 5/12 124/20.3 |
| 8,607,773 | B1 | 12/2013 | Schultz | |
| 8,622,050 | B2 | 1/2014 | Goff et al. | |
| 8,651,095 | B2 | 2/2014 | Islas | |
| 8,663,732 | B2 | 3/2014 | Kohnke | |
| 8,671,923 | B2 | 3/2014 | Goff et al. | |
| 8,701,641 | B2 * | 4/2014 | Biafore, Jr. | F41B 5/123 124/25 |
| 8,701,642 | B2 * | 4/2014 | Biafore, Jr. | F41B 5/123 124/25 |
| 8,813,735 | B2 * | 8/2014 | Biafore, Jr. | F41B 5/1442 124/25 |
| 8,863,732 | B1 | 10/2014 | Prior | |
| 8,991,375 | B2 | 3/2015 | McPherson | |
| 9,022,013 | B2 * | 5/2015 | Trpkovski | F41B 5/14 124/87 |
| 9,121,659 | B1 | 9/2015 | Chang | |
| 9,255,756 | B1 | 2/2016 | Wu et al. | |
| 9,255,764 | B2 | 2/2016 | Park | |
| 9,291,421 | B1 | 3/2016 | Kempf | |
| 9,518,796 | B2 | 12/2016 | Carroll | |
| 9,518,797 | B2 | 12/2016 | Carroll | |
| 9,714,808 | B2 | 7/2017 | Carroll | |
| 9,719,749 | B1 | 8/2017 | Prior | |
| 10,012,472 | B2 | 7/2018 | Gohlke | |
| 10,209,028 | B2 * | 2/2019 | Bofill | F41B 5/123 |
| 10,254,075 | B2 * | 4/2019 | Yehle | F41B 5/143 |
| 10,359,254 | B1 | 7/2019 | Kempf et al. | |
| 10,458,743 | B1 | 10/2019 | Kempf et al. | |
| 10,514,226 | B2 | 12/2019 | Shaffer et al. | |
| 10,533,822 | B1 | 1/2020 | Popov | |
| 10,690,436 | B1 | 6/2020 | Kempf et al. | |
| 10,712,118 | B2 * | 7/2020 | Yehle | F41B 5/105 |
| 10,767,956 | B2 | 9/2020 | Popov | |
| 10,962,323 | B2 | 3/2021 | Langley | |
| 11,131,524 | B1 | 9/2021 | Kempf et al. | |
| 11,402,171 | B2 | 8/2022 | Trpkovski | |
| 11,408,703 | B2 | 8/2022 | Trpkovski | |
| 11,512,921 | B1 * | 11/2022 | Xiao | F41B 5/0094 |
| 11,512,923 | B2 | 11/2022 | Trpkovski | |
| 11,549,777 | B1 | 1/2023 | Trpkovski | |
| 11,713,940 | B2 * | 8/2023 | Trpkovski | F41B 3/02 124/25 |
| 11,713,941 | B1 * | 8/2023 | Crist | F41B 5/12 124/25 |
| 11,725,899 | B2 | 8/2023 | Trpkovski et al. | |
| 11,808,543 | B2 * | 11/2023 | Yehle | F41B 5/123 |
| 12,130,113 | B2 * | 10/2024 | Trpkovski | F41G 11/003 |
| 2004/0194771 | A1 | 10/2004 | Malucelli | |
| 2014/0251294 | A1 | 9/2014 | Novikov | |
| 2021/0080218 | A1 | 3/2021 | Trpkovski | |
| 2021/0123700 | A1 | 4/2021 | Wei | |
| 2022/0214131 | A1 | 7/2022 | Trpkovski et al. | |
| 2022/0214132 | A1 | 7/2022 | Trpkovski et al. | |
| 2022/0307791 | A1 | 9/2022 | Trpkovski | |
| 2023/0358502 | A1 | 11/2023 | Crist et al. | |

* cited by examiner

REVERSED LIMBS OPTION

REVERSED LIMBS OPTION

REVERSED LIMBS OPTION

LINEAR CROSSBOW

CROSS-REFERENCE TO RELATED APPLICATIONS

This application is a continuation of U.S. patent application Ser. No. 18/094,921, filed on Jan. 9, 2023, which is a continuation of U.S. patent application Ser. No. 16/840,446, filed on Apr. 5, 2020, now U.S. Pat. No. 11,549,777, and claims the benefit of U.S. Provisional Patent Application No. 62/829,913, filed on Apr. 5, 2019, the entire contents of which are incorporated herein by reference in their entirety.

BACKGROUND

This application generally relates to crossbows and projectile launchers, and more particularly to linear crossbows with an arrow shuttle that operates in a linear manner parallel to arrow flight path, thus making for a safe shooting, extremely accurate, easily cocked, and compact crossbow.

Crossbows are generally known in the art. Crossbows typically include a bow portion, a stock portion, and a draw string latch that holds the bow in the fully drawn position. Typically, the draw string is perpendicular to the arrow or direction of flight. Furthermore, the draw string when shooting moves aggressively from the drawn position to the rest position. Accordingly, objects must remain free of the flight path of the draw string.

Today, most crossbow manufactures are designing crossbows to reduce the felt recoil, making them narrower, efficient, and as accurate and safe as possible. The most common method to reduce recoil is to make the limbs oriented such that the limbs are parallel to one another, thus cancelling most of the recoil. In doing so, the riser for the bow portion of the crossbow becomes wider and increases the length and weight of the crossbow while trying to maintain a power stroke.

Furthermore, manufacturers are attempting to minimize power cable wear that must be guided below and away from the draw string and arrow fletching. The power cables on most crossbows today are guided and under significant load and wear prematurely, thus reducing accuracy, efficiency, and safety. The narrower the crossbow is made the more difficult guiding the power cables become since the distance is reduced increasing the load and wear. Also, crossbows on the market all suffer from left to right movement or timing issues of the draw string reducing the accuracy if cocked incorrectly, or if the timing cables becomes out of time making the crossbow shoot left or right of the intended target. Numerous camming means have been developed to reduce the power cabling wear and make the crossbow narrow, but these suffer from drawbacks such as left to right movement of the drawstring.

Currently, most crossbows are very efficient and produce speeds in excess of 400 feet per second (f.p.s.); however, they all suffer from power cable wear and left to right draw movement. Also, the means for cocking crossbows on the market involve either hand cocking or using a rope cocker that pulls the draw string to the string latch, or another method is to move the string latch and pull the latch and draw string back to the cocked position. One problem with both of these methods is premature wear on the draw string by the string latch and rope cocker.

SUMMARY

One embodiment relates to a crossbow that includes a stock defining a front end and a rear end, and a limb including: a fixed end affixed to the stock between the front end and the rear end, and a free end positioned between the front end and the rear end. The limb is configured to flex in a substantially vertical plane.

Another embodiment relates to a crossbow that includes a stock defining a projectile flight path, a string let out assembly rotatably coupled to the stock about an axis of rotation perpendicular to the projectile flight path, the string let out assembly including a drawstring groove configured to support a drawstring, and a cable groove configured to support a power cable, and a limb including: a fixed end affixed to the stock below the projectile flight path, and a free end configured to couple to the power cable and flex in a substantially vertical plane.

Another embodiment relates to a crossbow that includes a stock defining a rear end, and a string let out assembly including: a drawstring groove configured to support a drawstring, a first cable groove configured to support a first power cable, and a second cable groove configured to support a second power cable. The drawstring groove, the first power cable groove, and the second power cable groove rotate about an axis of rotation. The crossbow also includes a first limb including: a first fixed end affixed to the stock between the rear end and the axis of rotation of the string let out assembly, and a first free end configured to couple to the first power cable and flex in a first substantially vertical plane, and a second limb including: a second fixed end affixed to the stock between the rear end and the axis of rotation of the string let out assembly, and a second free end configured to couple to the second power cable and flex in a second substantially vertical plane.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE FIGURES

FIG. 1 illustrates a very narrow arrangement of the linear crossbow in the drawn position.

DETAILED DESCRIPTION

Figure 1:
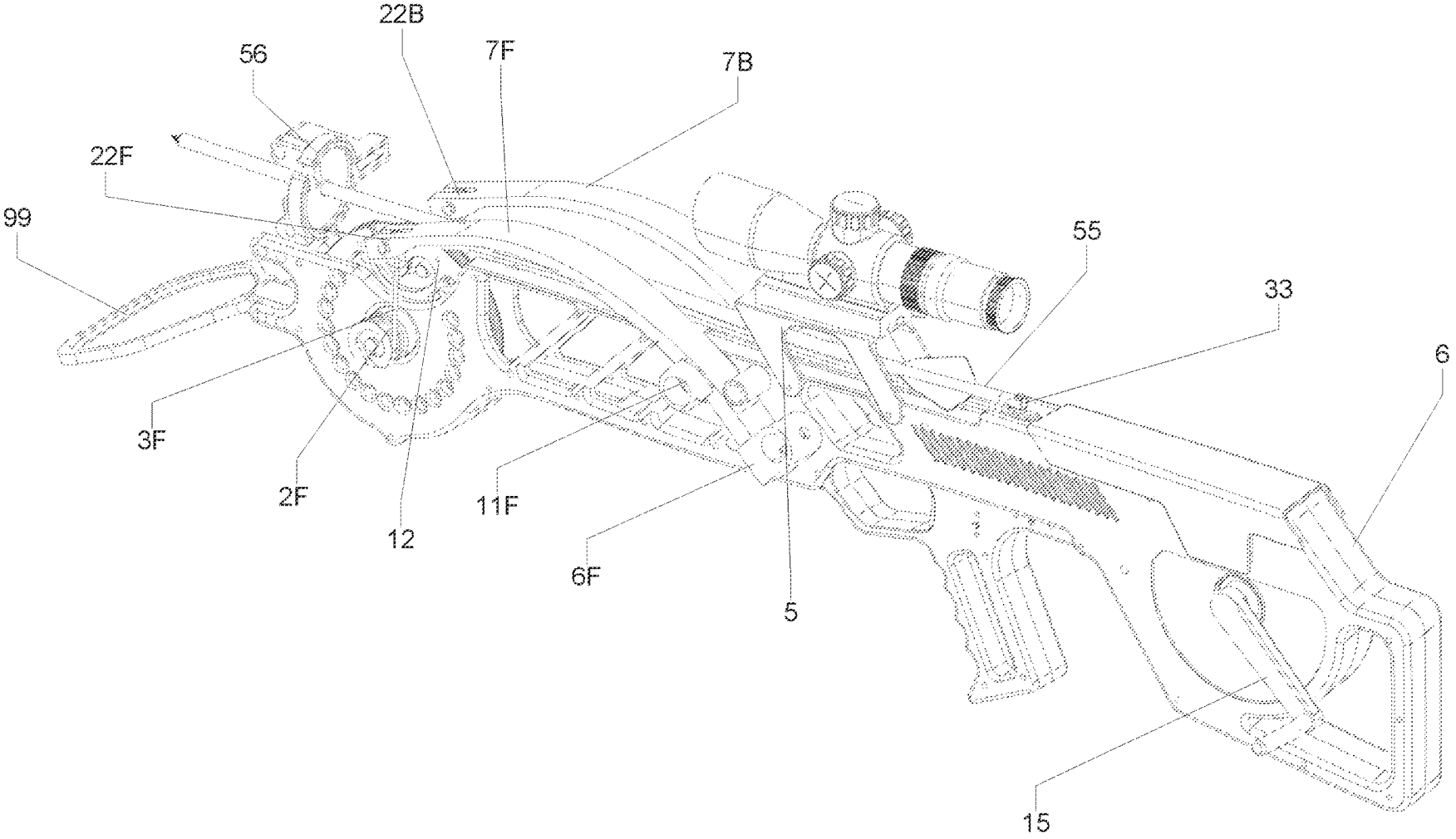
FIG. 1 is a left side perspective view of a linear crossbow according to the principles of the present disclosure; in particular
Figure 2:
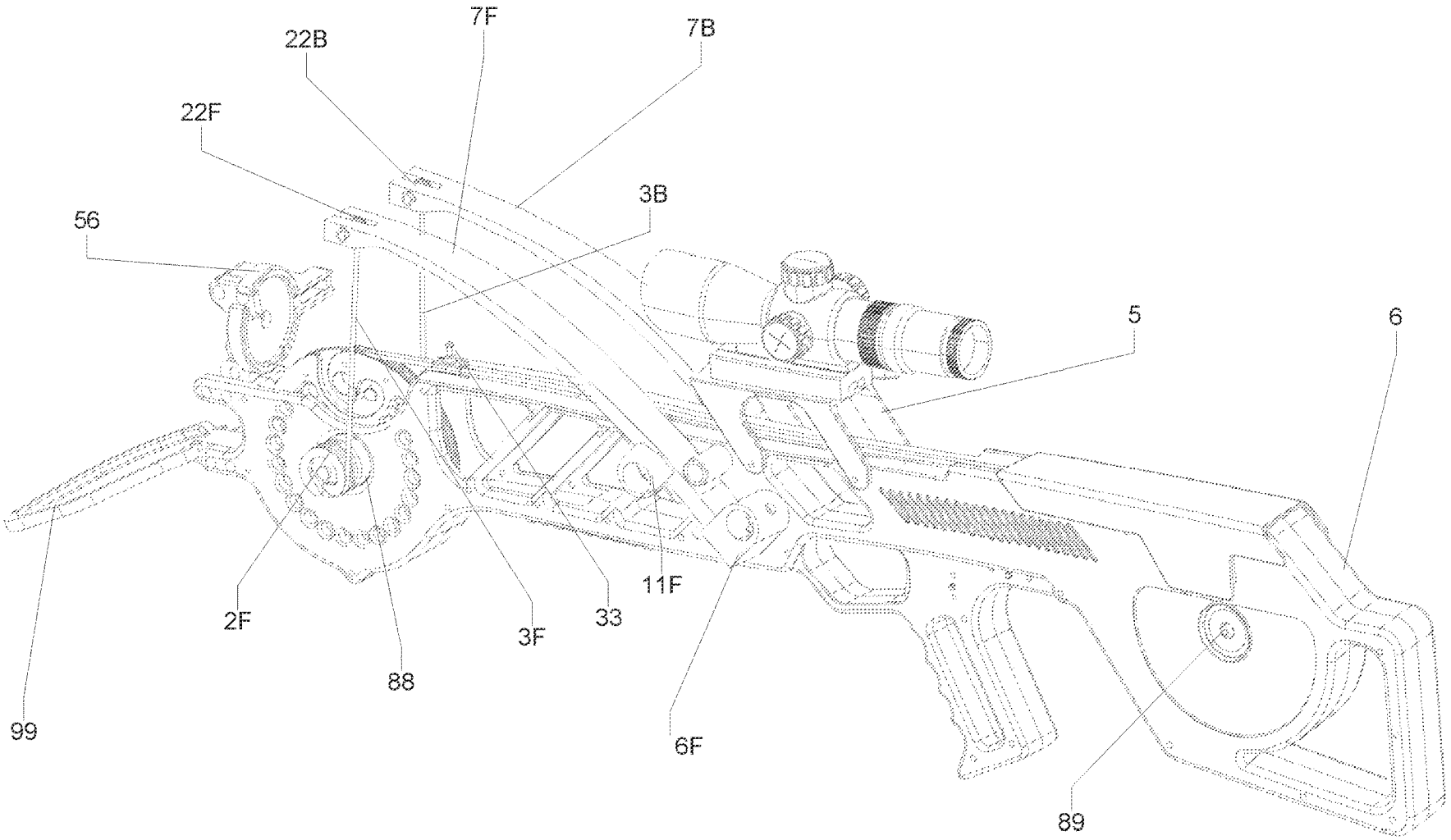
FIG. 2 is a left perspective view of the linear crossbow of FIG. 1, the linear crossbow illustrated in an undrawn configuration.

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

According to the principles of the present disclosure, limb, stock, draw string, latch and tensioning systems, referred to herein as a linear crossbow, include configurations that provide various advantages over prior art crossbows using prior art for limb configurations and various cam systems.

The linear crossbow can be designed using various limb arrangements, draw string let out means and or cam arrangements to reduce shock, improve efficiency, improve balance, improve safety, shoot different projectiles, and improve accuracy. The linear crossbow may include one or more of the following features: 1) Limbs mounted forward vertically parallel to draw string. 2) Parallel Limbs rear facing 3) Parallel Limbs forward 4) Dual string let out track with dual cams 5) Dual string let out with center mounted power cables 6) Scope sight mount that spans the stock side to side 7) Various Projectiles and Interchangeable mounts 8) Fixed or Drop away rest system 9) Rear take up latch, trigger and variable power stroke 10) Fixed Central Cams. Any one of the aforementioned items provide new improvements over prior art technologies, and, alone or combined, produce improvements to prior art crossbows. By combining various elements, a linear crossbow can be produced that is narrower, more accurate, more efficient and safer to operate.

Figure 70:
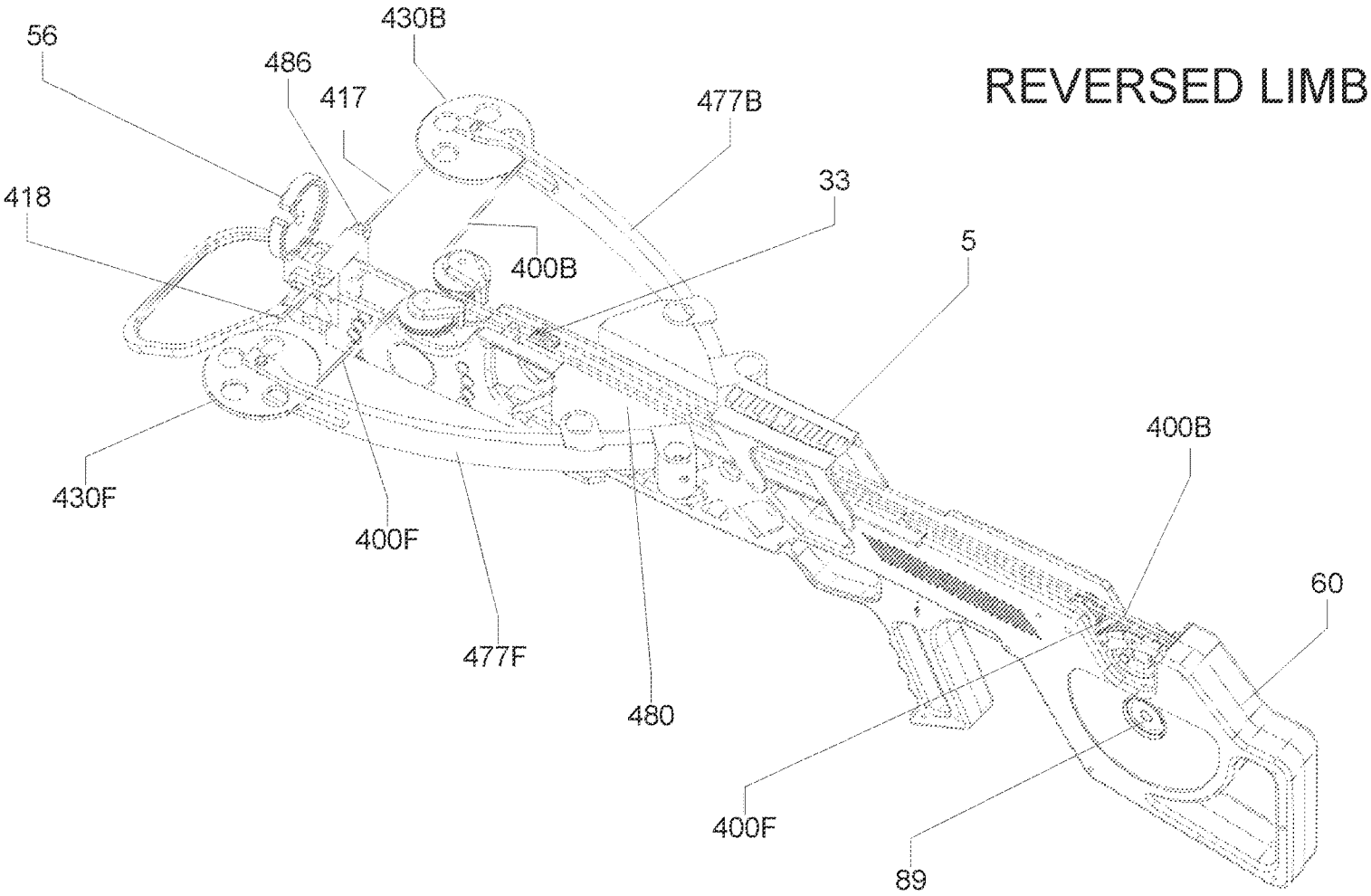
FIG. 70 is a left perspective view of the crossbow of FIG. 34 in the undrawn position with the limbs, cams, idlers REVERSED to show the same design can be flipped if desired.

The linear crossbows shown in FIG. 1 thru 70 all show the linear crossbow using dual draw strings to improve stability of the arrow shuttle, however, a single draw string and a shuttle attached in a similar fashion could be performed and would function as well. Also, a shuttle guide could be used to support the shuttle but would likely decrease the efficiency of the linear crossbow. Likewise, the types of cams shown can be any number of cams known or limb arrangements that have been used on other crossbow and bow designs.

Section 1—Limbs Mounted Forward Vertically Parallel

FIGS. 1-10 illustrate an example of a linear crossbow according to the principles of the present disclosure.

The limbs 7F and 7B can either be a single limb or a split limb set and are shown as a single limb set. The limbs 7F and 7B have a unique orientation in relation to the stock such that they are positioned along the side and upward of the stock 6. The limbs 7F and 7B are oriented to create a very narrow crossbow with a width of distance 9D that is below 8 inches and preferably around 3 inches. The limbs 7F and 7B are distally mounted in the forward direction and the fixed ends are affixed by 6F and 6B which are affixed to stock 6.

The limbs 7F and 7B are also supported over mid limb supports 11F and 11B to provide a moment for the limbs to flex over. The mid limb supports 11F and 11B are also affixed to the stock 6 as shown. The limbs 7F and 7B free ends have power cables 3F and 3B that are affixed to the free limb ends at point 22F and 22B and to the forward string let out track assembly 12.

Furthermore, assembly 12 has dual spiral take up tracks 2F and 2B that take up power cables 3F and 3B that are attached to at points 3AF and 3AB. The forward string let out track assembly 12 has dual string let out grooves with the draw strings 1F and 1B attached and wrapped one revolution in the undrawn state and are attached at points 12AF and 12AB. The 12 forward string let out assembly is also rotatably mounted to stock 6 with bearings and axle 88 to allow assembly 12 to freely rotate and supports the power cable loads that can be in excess of 1000 lbs.

The draw strings 1F and 1B after wrapping one revolution are then directed over the stop pulley 44 then directed towards the rear take up string tracks of assembly 14 and the draw string 1F and 1B are attached in corresponding grooves at points 14AF and 14AB. The stop pulley 44 is rotatably mounted to the stock 6 with an internal bearing assembly and freely spins on axle 45. The purpose of 44 stop pulley is critical in the operation of the design in order to stop the rotation of the 14 assembly without free-wheeling and losing tension.

The assembly 14 contains dual string grooves to take up the draw strings 1F and 1B when assembly 14 is ratcheted up using detachable handle crank 15 with the toothed side mounts 17 and 18 of assembly 14 interacting with the latch assembly 19. The latch assembly 19 pivots about bearing axle point 66 and the trigger assembly 20 pivots about axle point 67. The ratchets or toothed sides of 14 contain 17 and 18 that lock the take up mechanism during the drawing of the linear crossbow until the trigger of the trigger assembly 20 is depressed disengaging claws of the latch assembly 19 from the teeth of 17 and 18 thus firing the crossbow.

Figure 3:
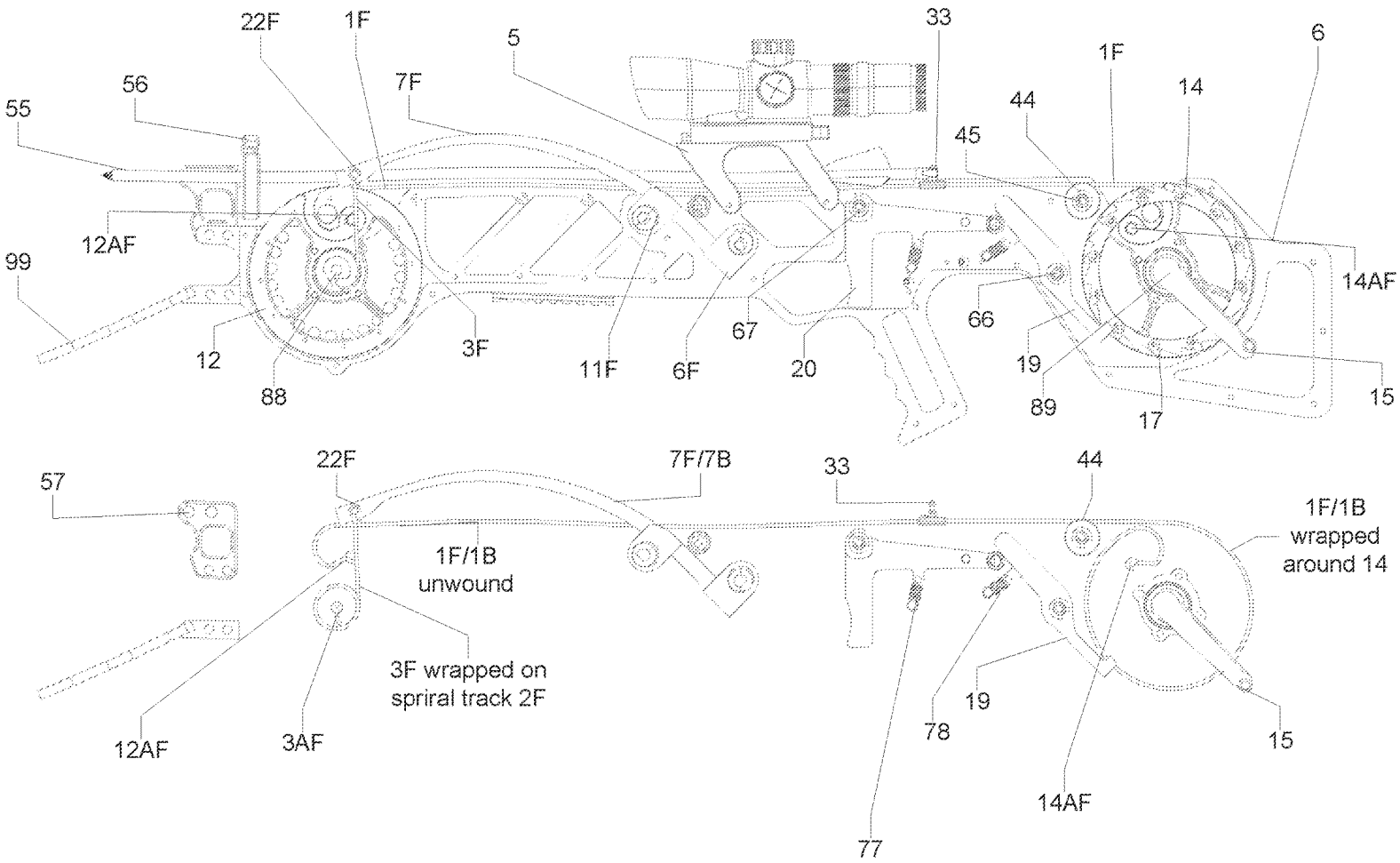
FIG. 3 is left side cross section view of the linear crossbow of FIG. 1, the linear crossbow illustrated in a drawn configuration and a detailed string path view.
Figure 4:
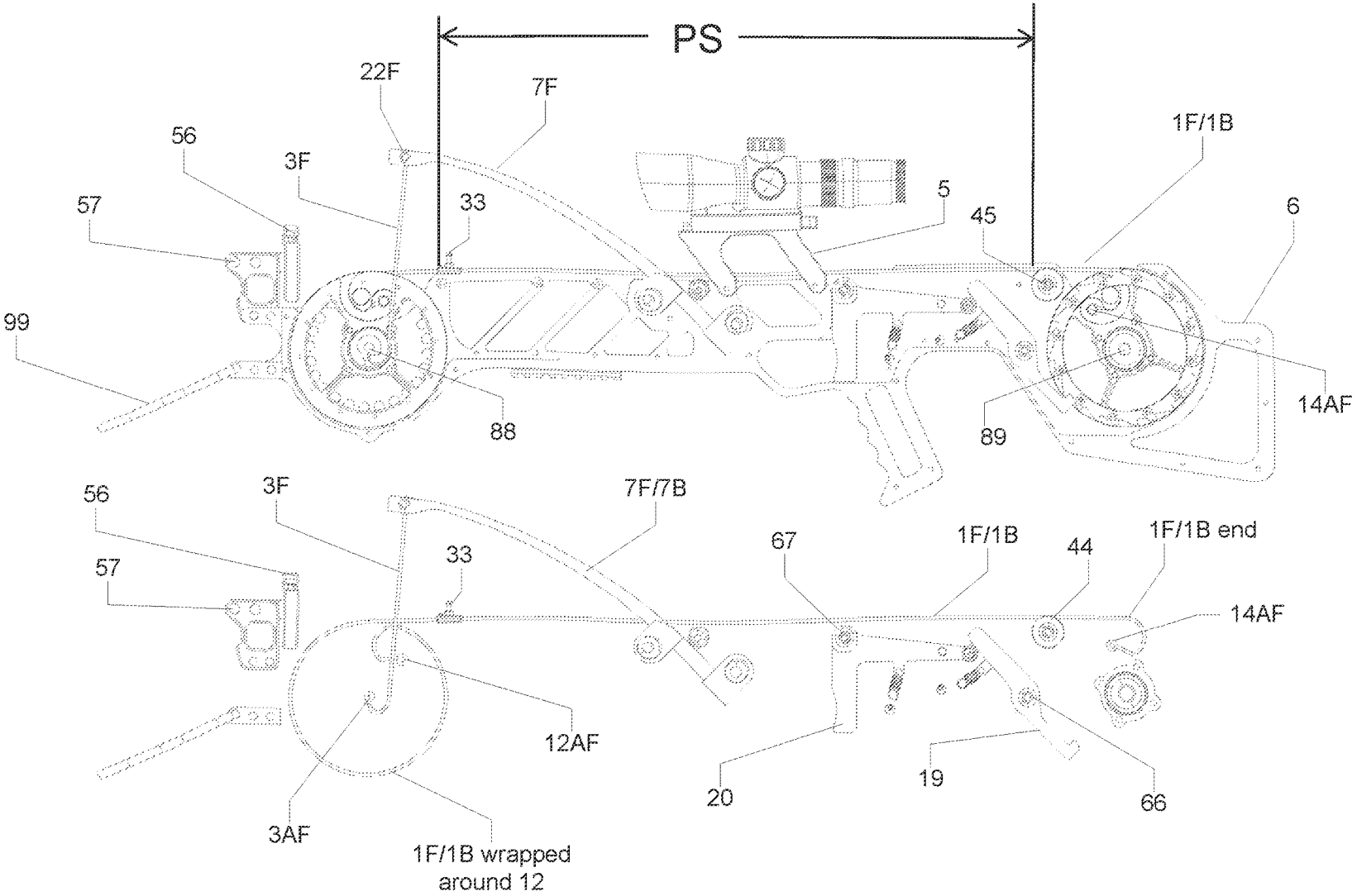
FIG. 4 is a left side cross section view of the linear crossbow of FIG. 1 in the undrawn position along with a detailed string path view.
Figure 5:
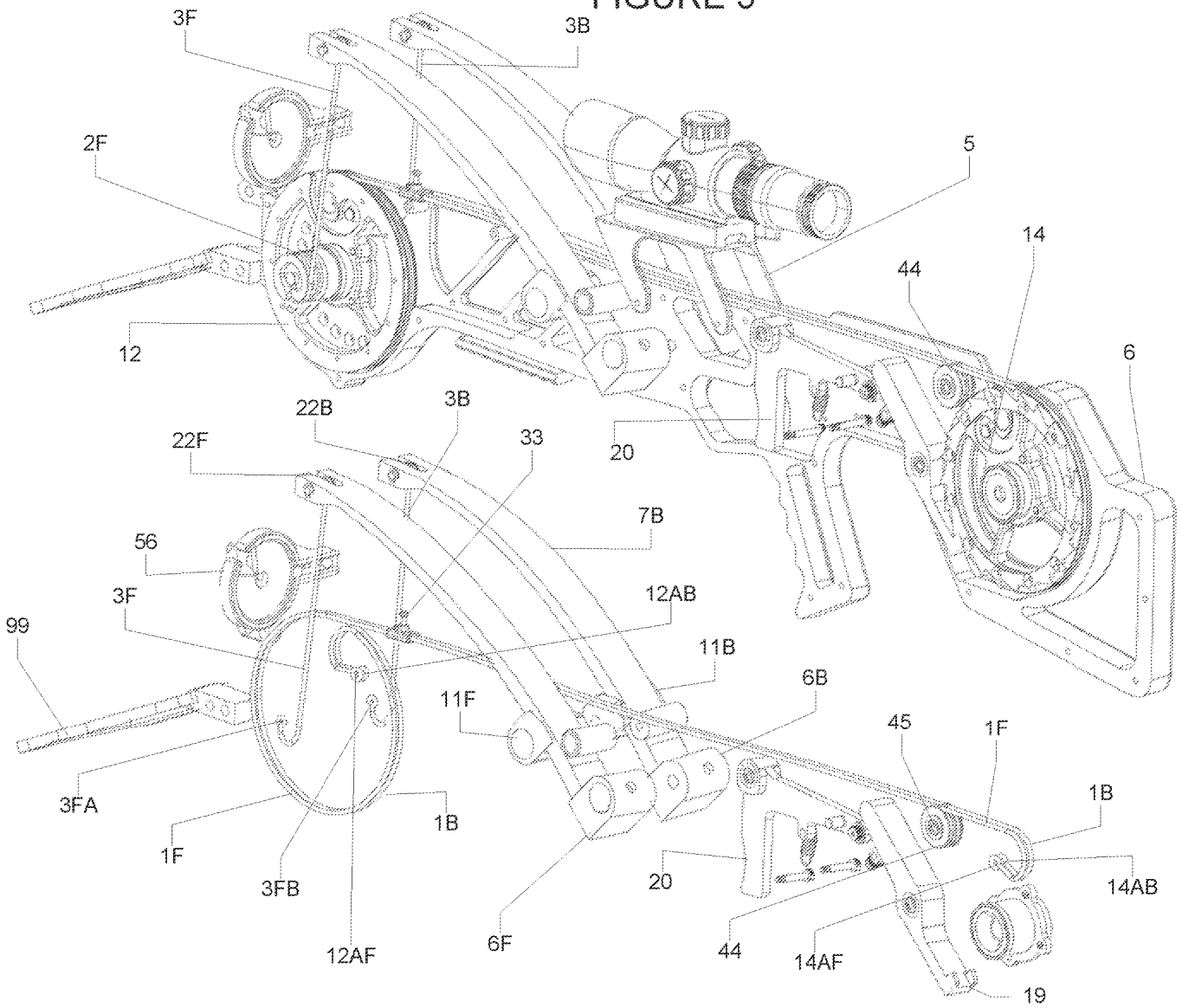
FIG. 5 is a left side perspective cross section view of the linear crossbow of FIG. 1 in the undrawn position along with a lower detailed view showing the string paths more detailed.
Figure 6:
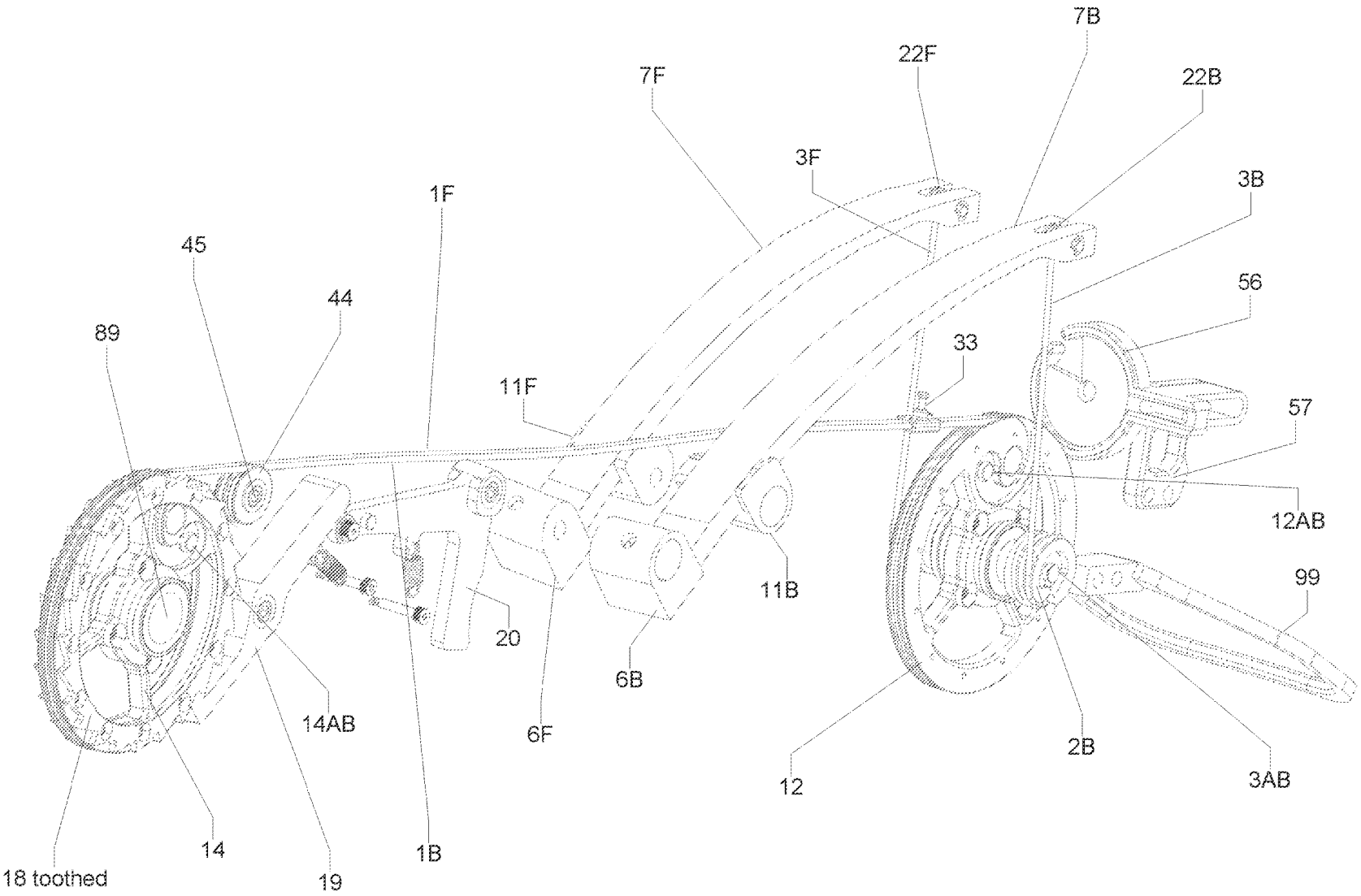
FIG. 6 is a right side perspective exposed view without stock of the linear crossbow of FIG. 1 showing the right side and the inner details in the undrawn position.
Figure 7:
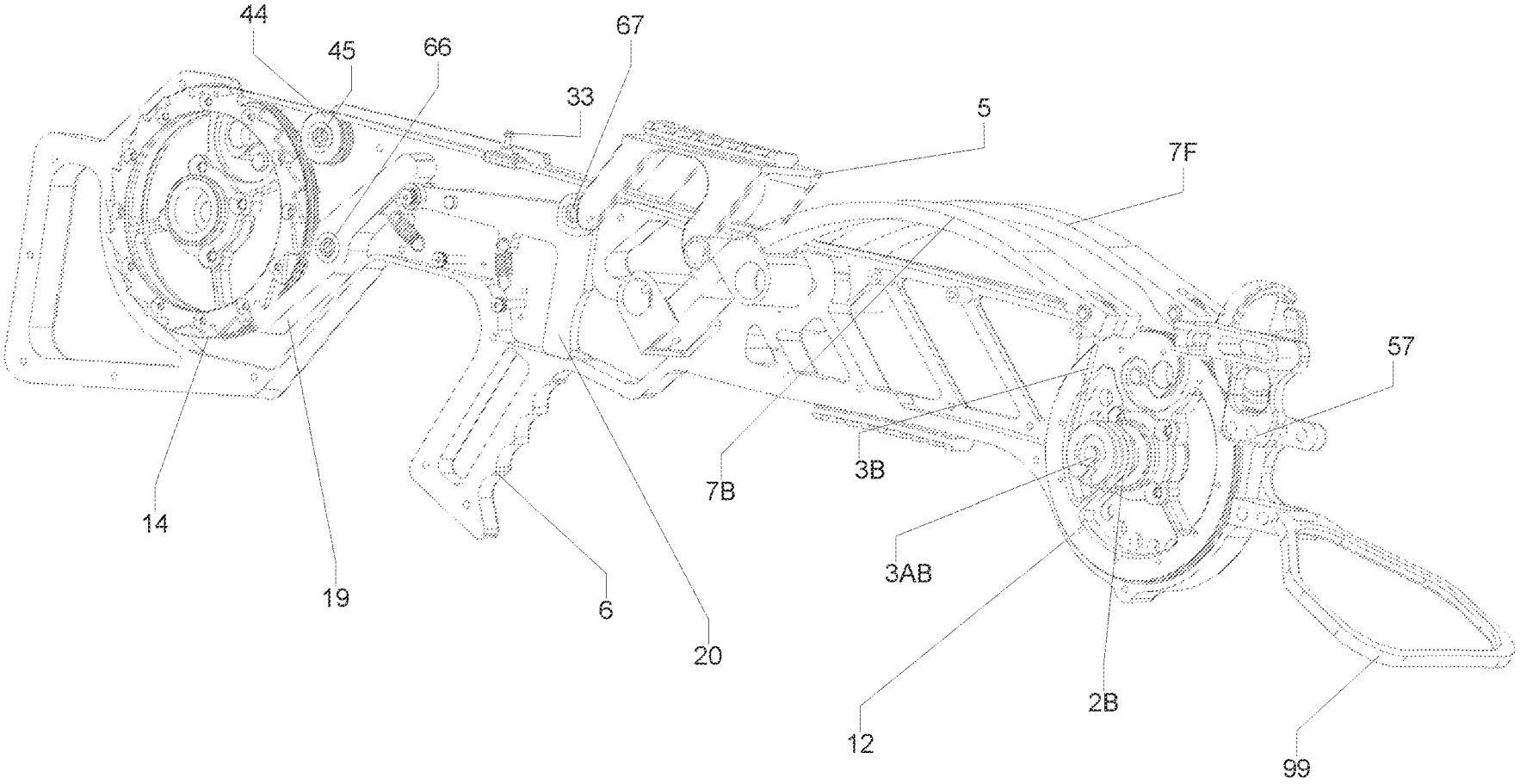
FIG. 7 is a right side perspective view with the right side of stock cross section removed to show the right side inner working and the linear crossbow of FIG. 1 in the drawn position.
Figure 8:
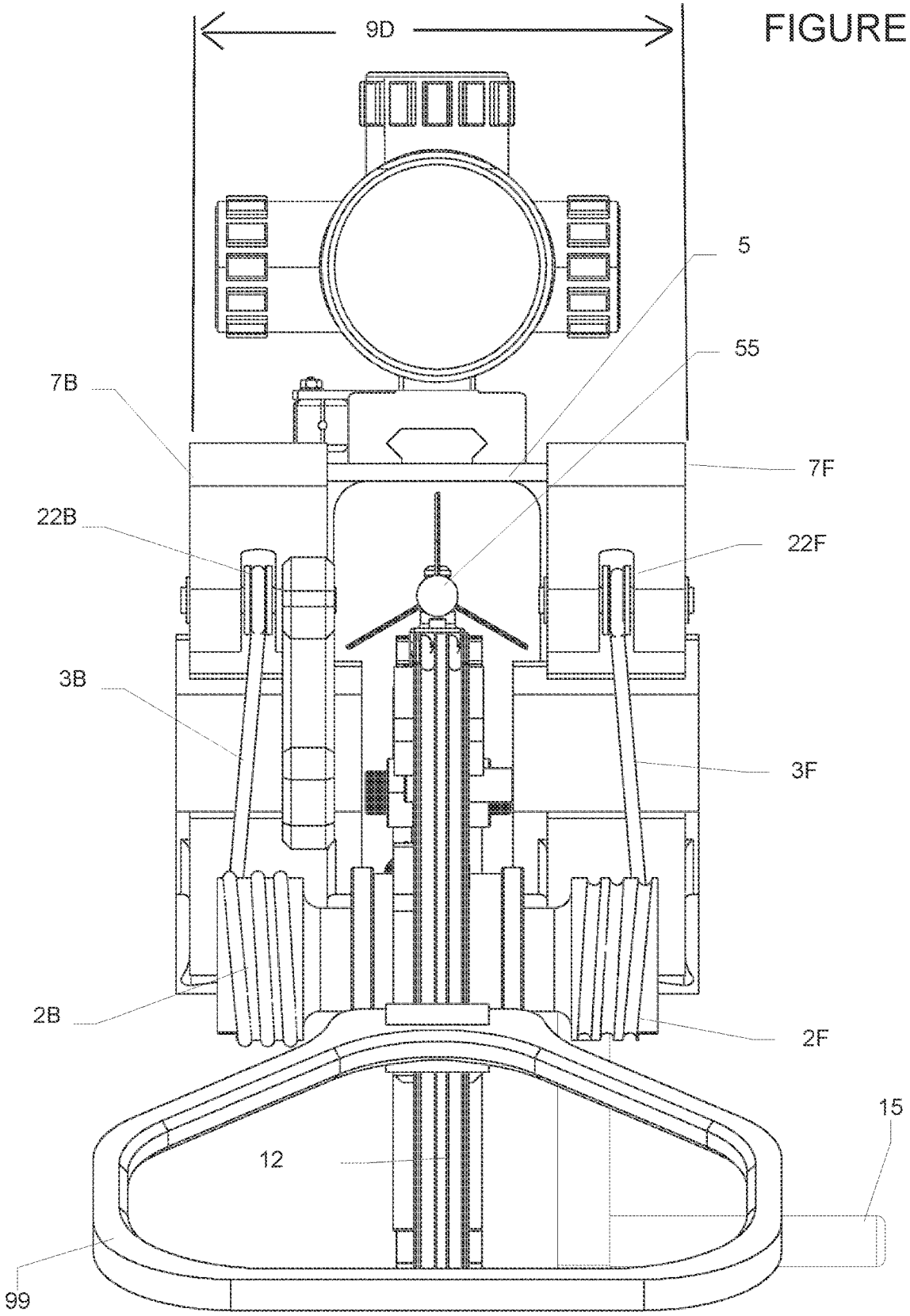
FIG. 8 is a front view looking back at the shooter view thru the linear crossbow of FIG. 1 in the drawn position.
Figure 9:
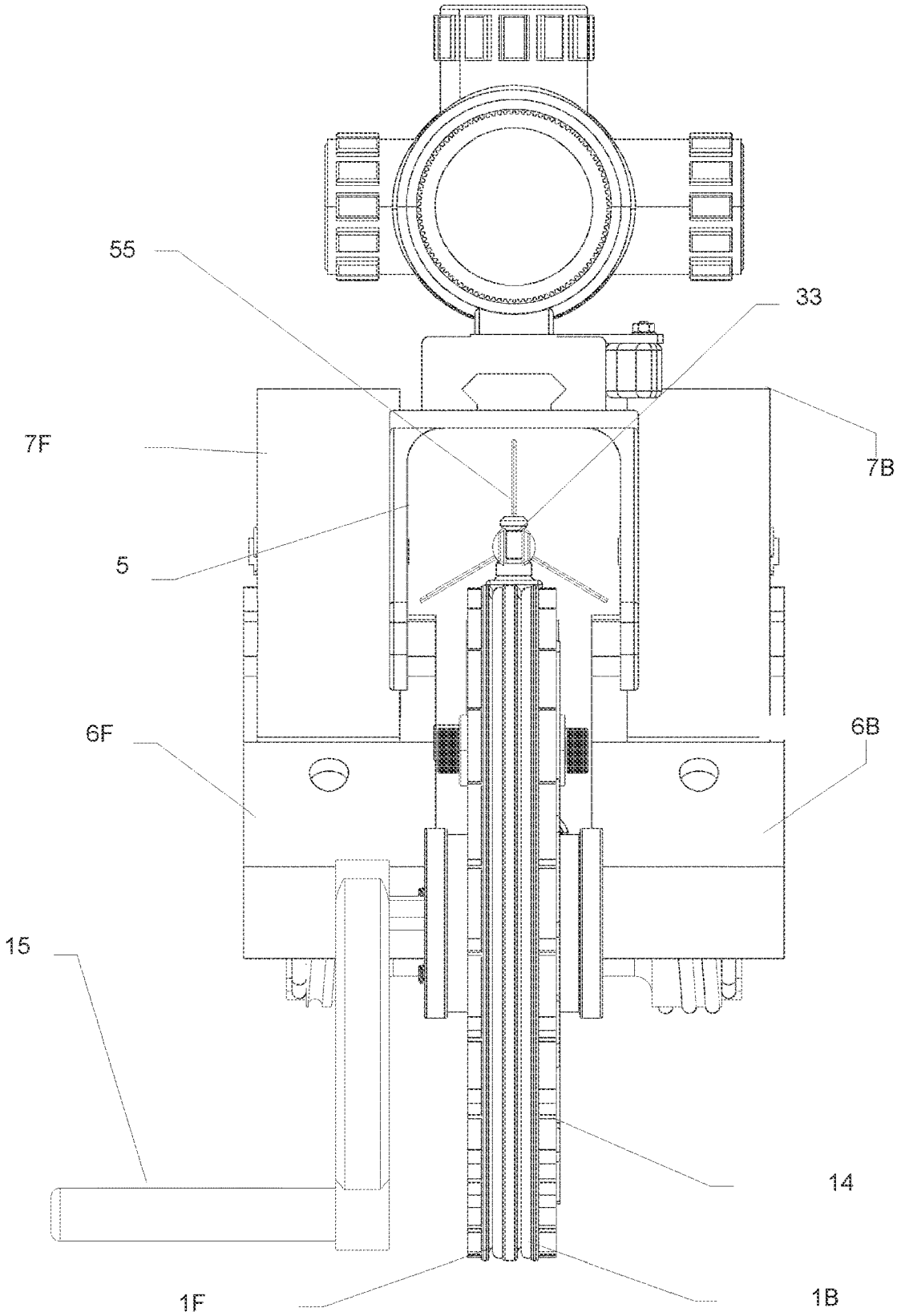
FIG. 9 is a back view of the linear crossbow of FIG. 1 in the drawn position with the stock portion removed to better show the details.
Figure 10:
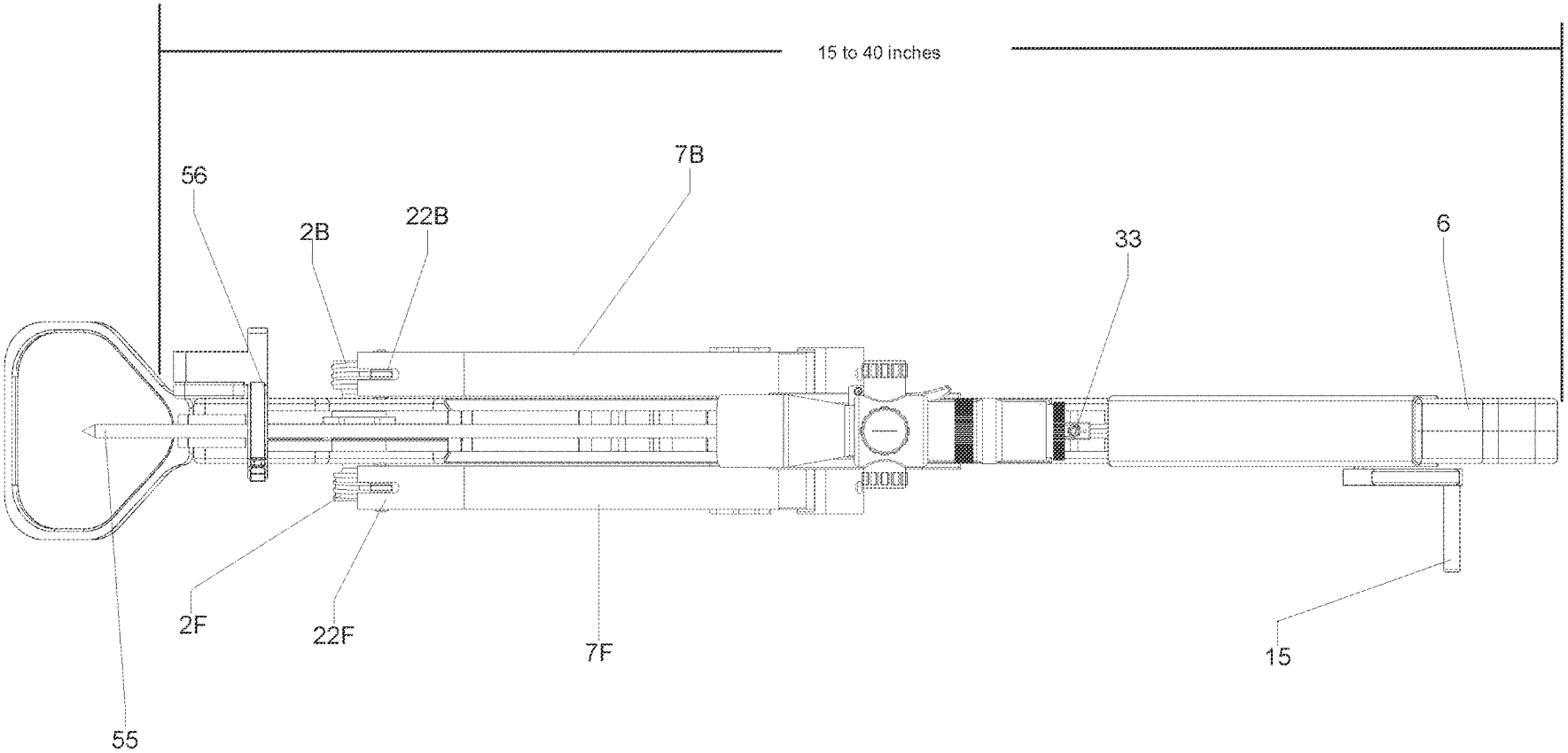
FIG. 10 is a top view of the linear crossbow of FIG. 1 in the drawn position.
Figure 11:
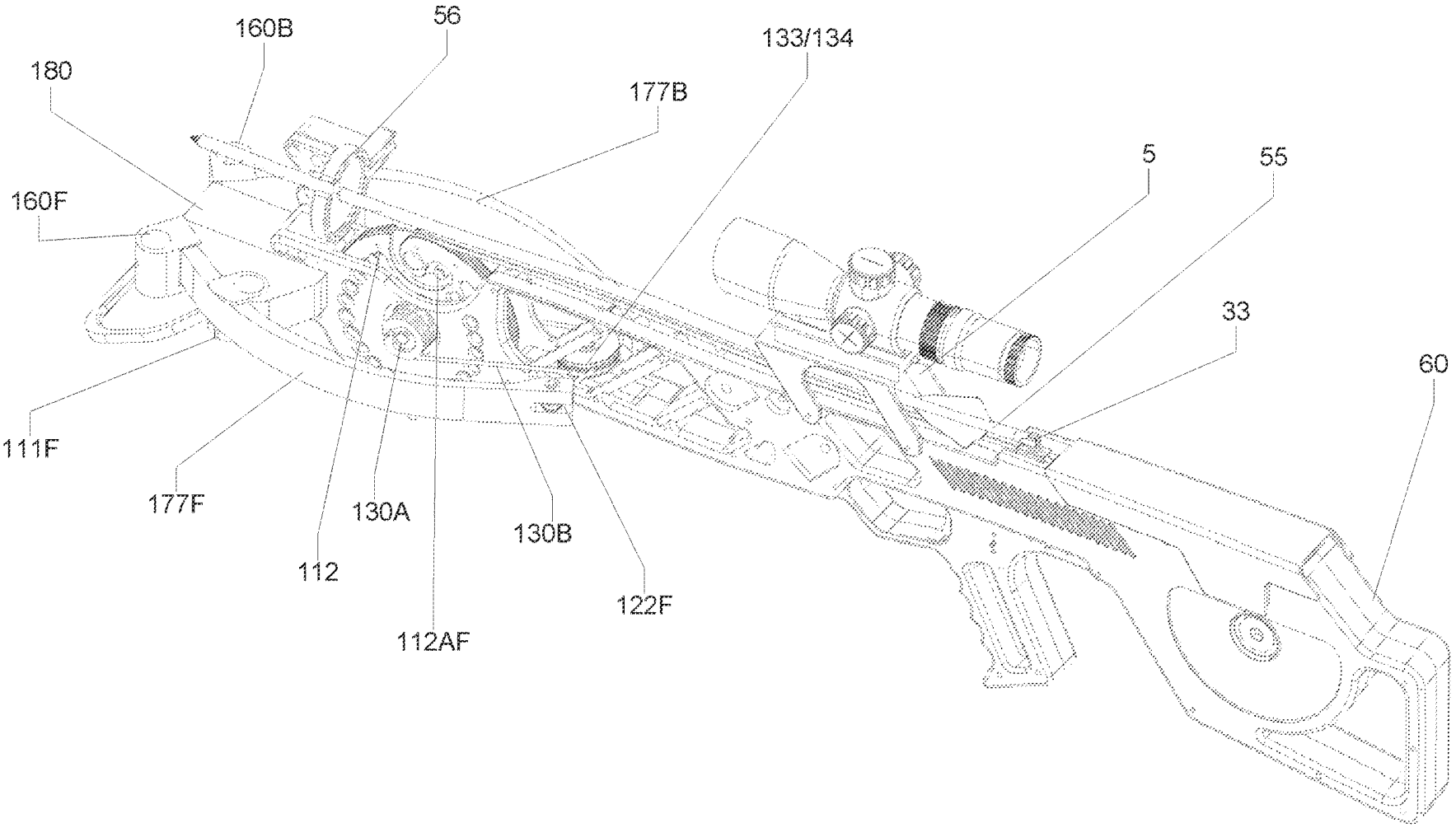
FIG. 11 is a perspective view of another linear crossbow with forward string let out track and a limb arrangement with rearward facing limbs in the drawn position.
Figure 12:
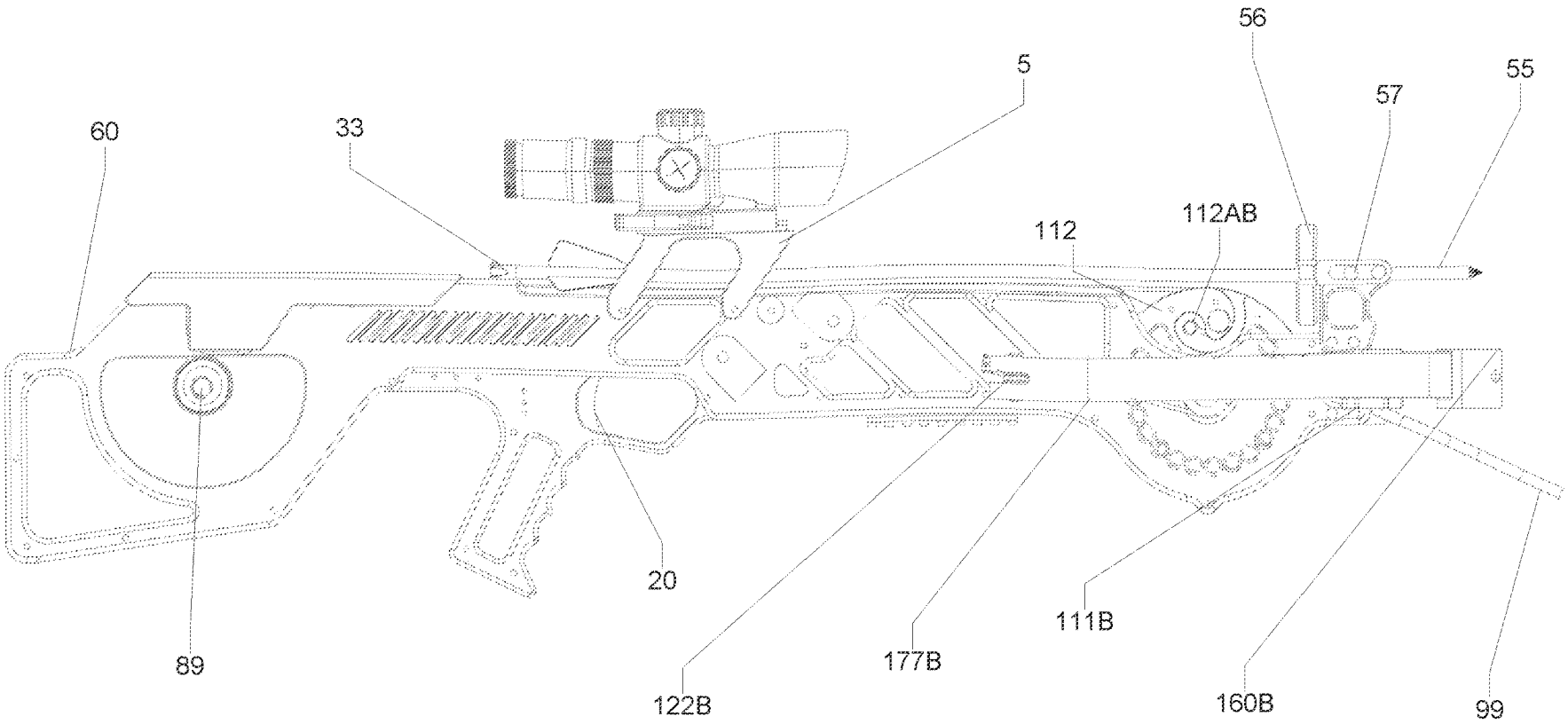
FIG. 12 is a right side view of the linear crossbow of FIG. 11.
Figure 13:
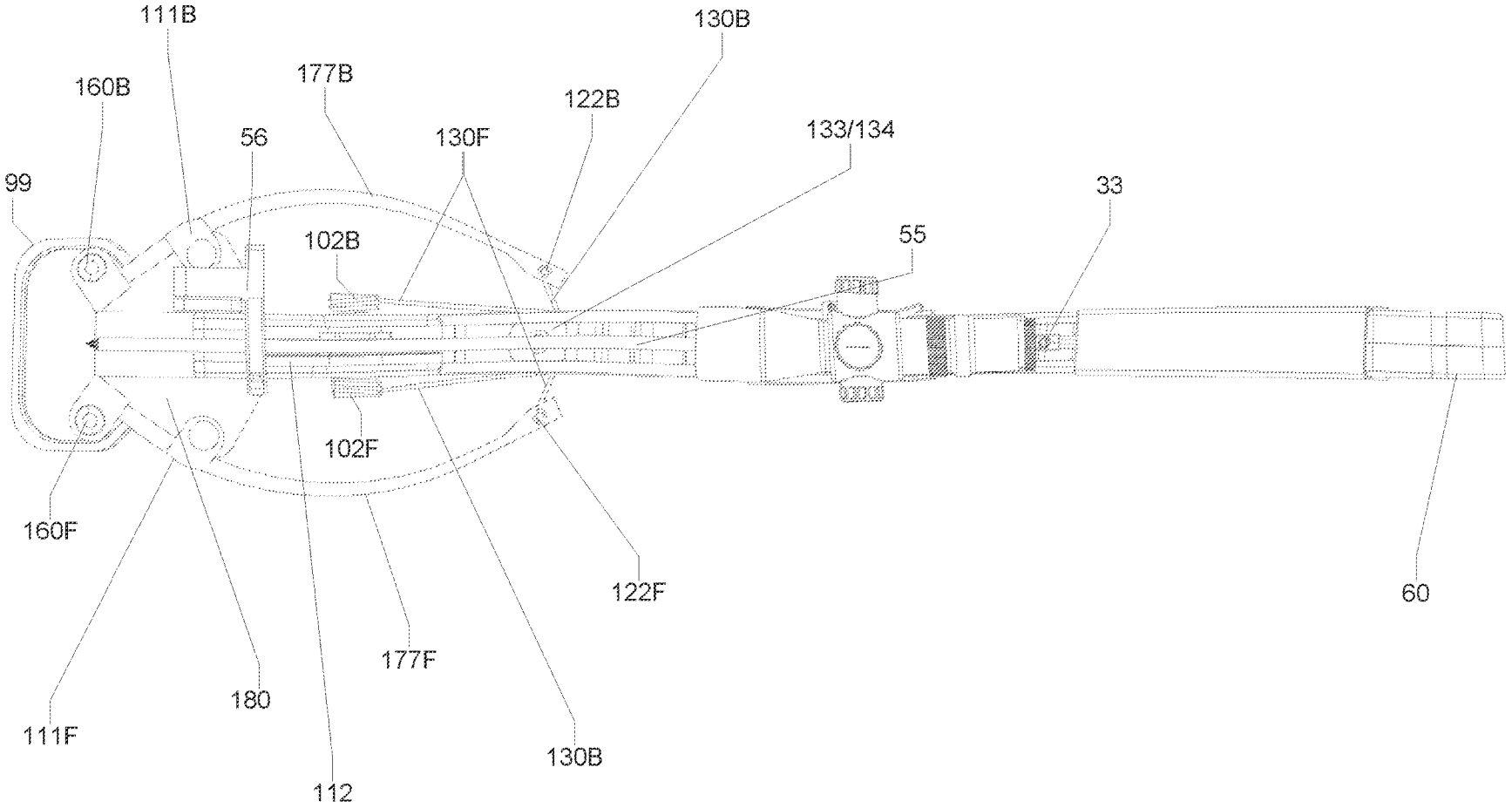
FIG. 13 is a top view of the linear crossbow of FIG. 11 in the draw position.
Figure 14:
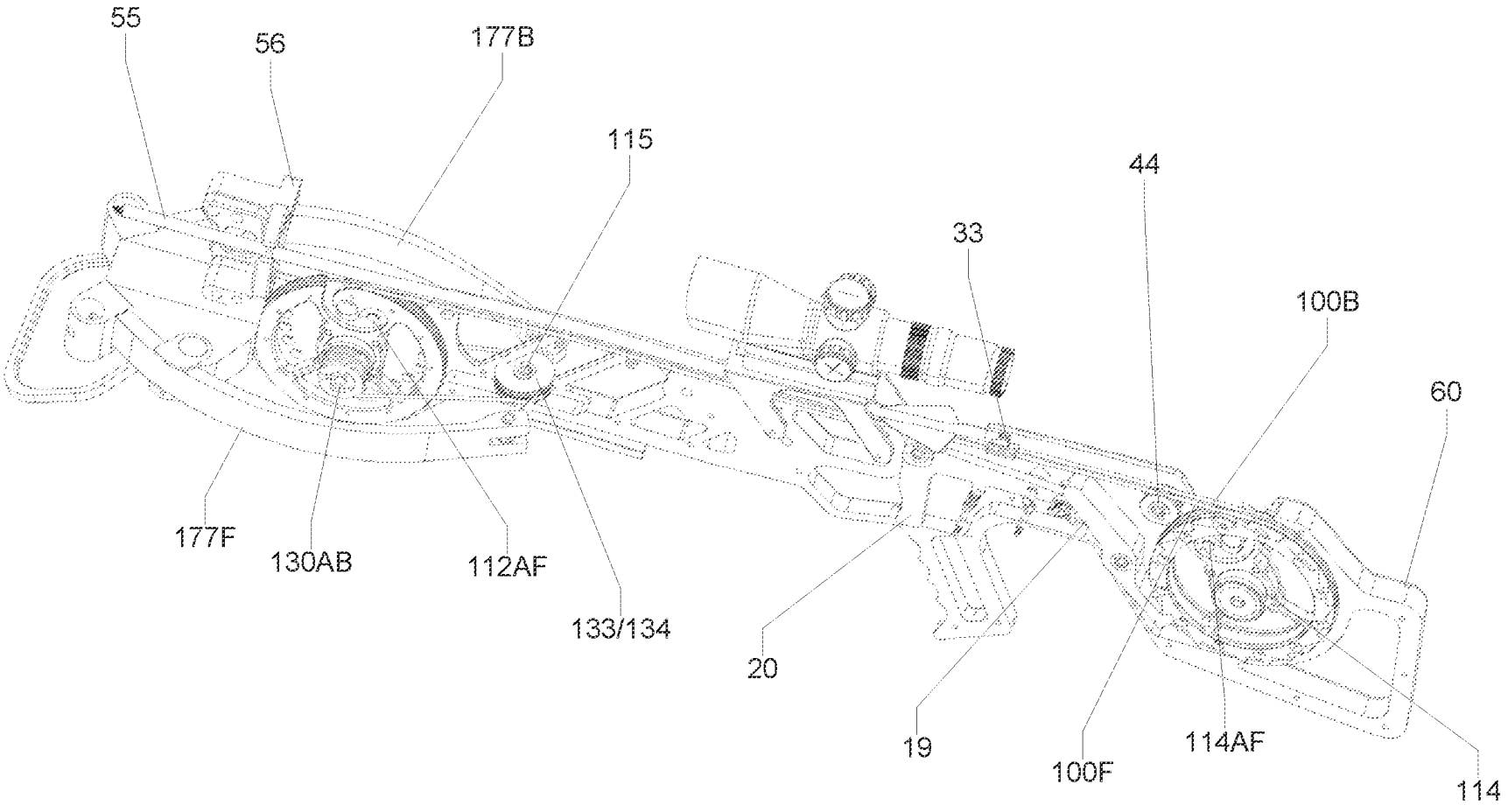
FIG. 14 is a perspective view of the linear crossbow of FIG. 11 in the drawn position and internal components exposed.
Figure 15:
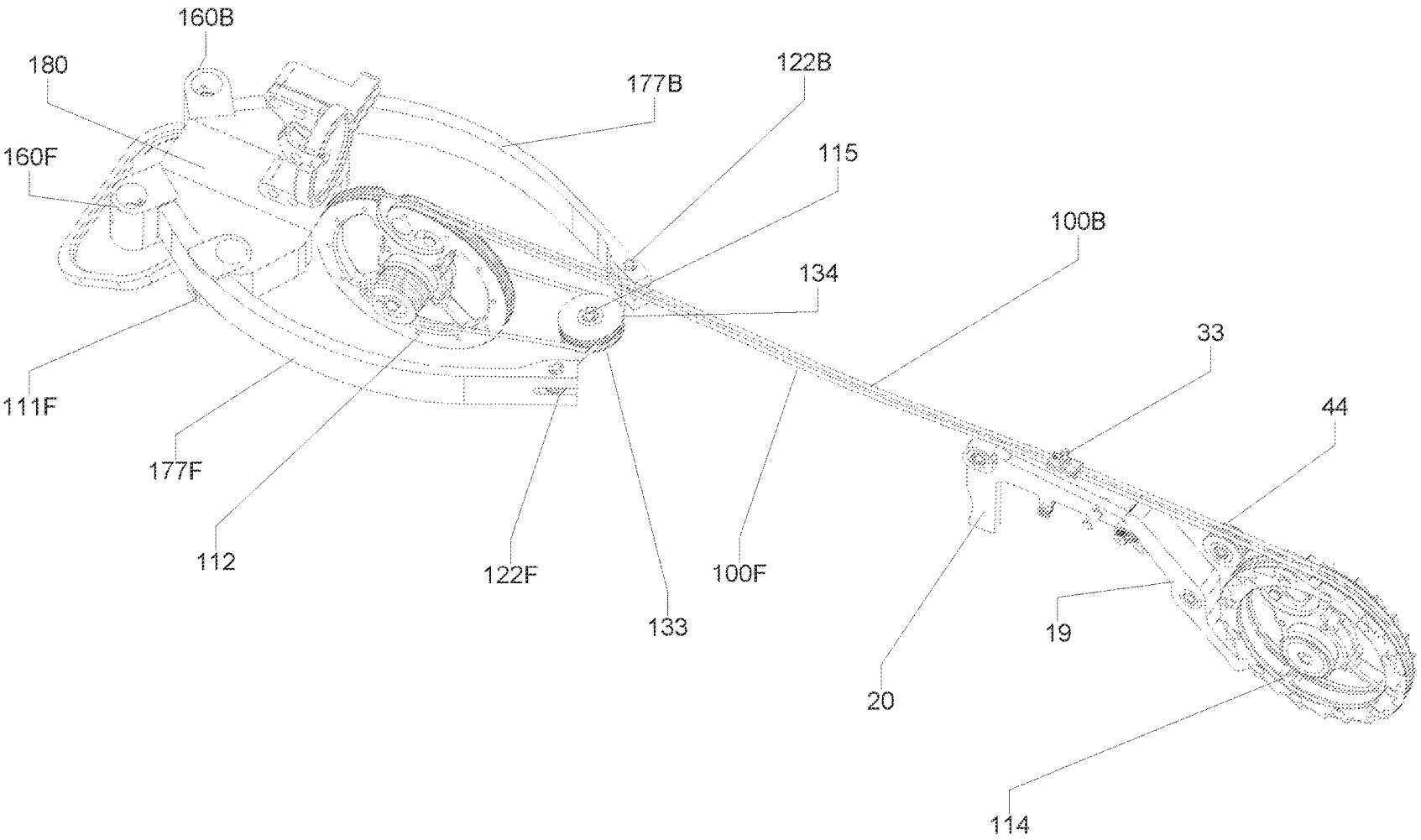
FIG. 15 is a perspective view of another linear crossbow of FIG. 11 in the drawn position with the components exposed showing the left side.
Figure 16:
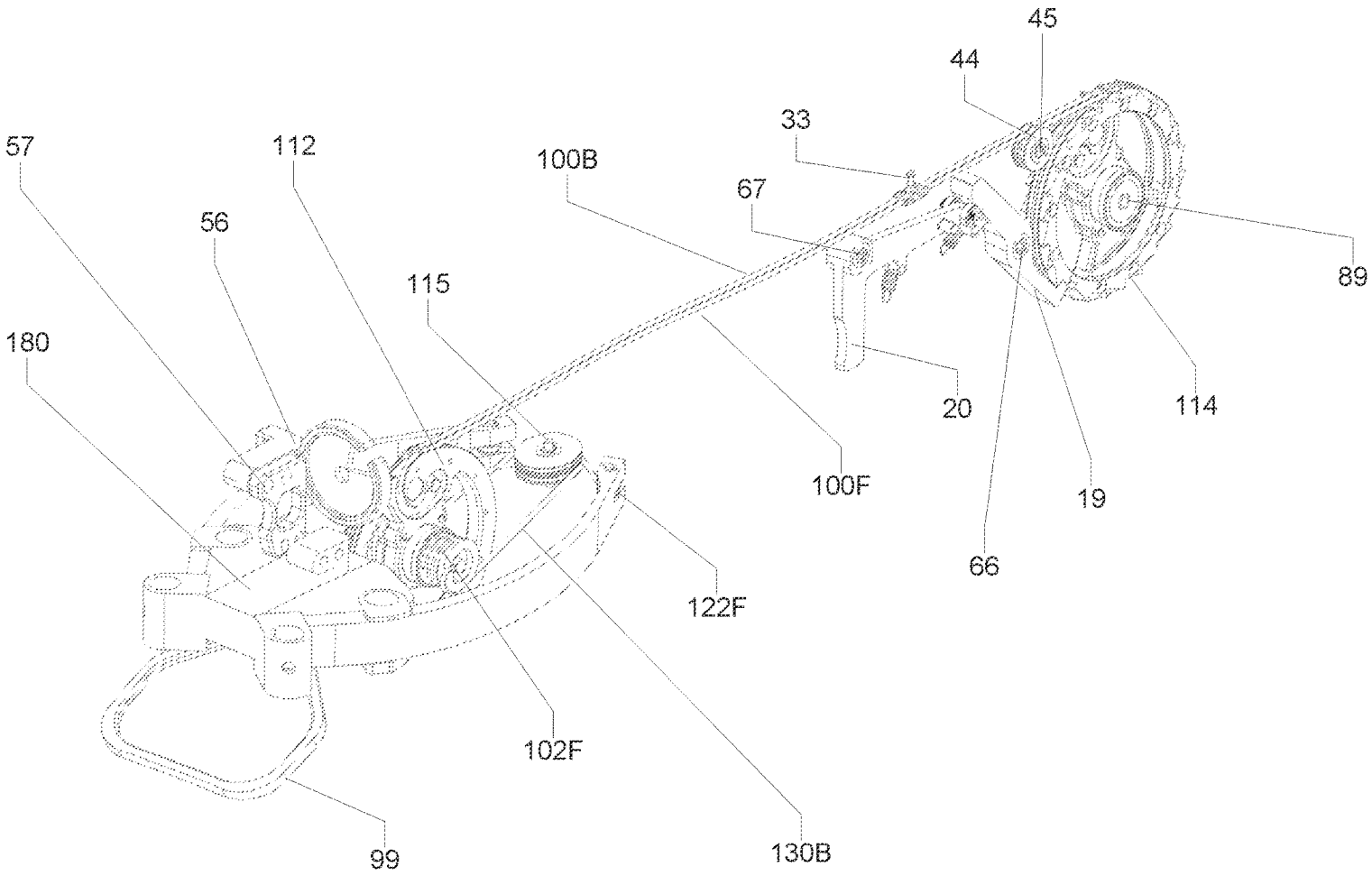
FIG. 16 is a perspective view of the linear crossbow of FIG. 11 in the drawn position and internal components exposed showing the right side.
Figure 17:
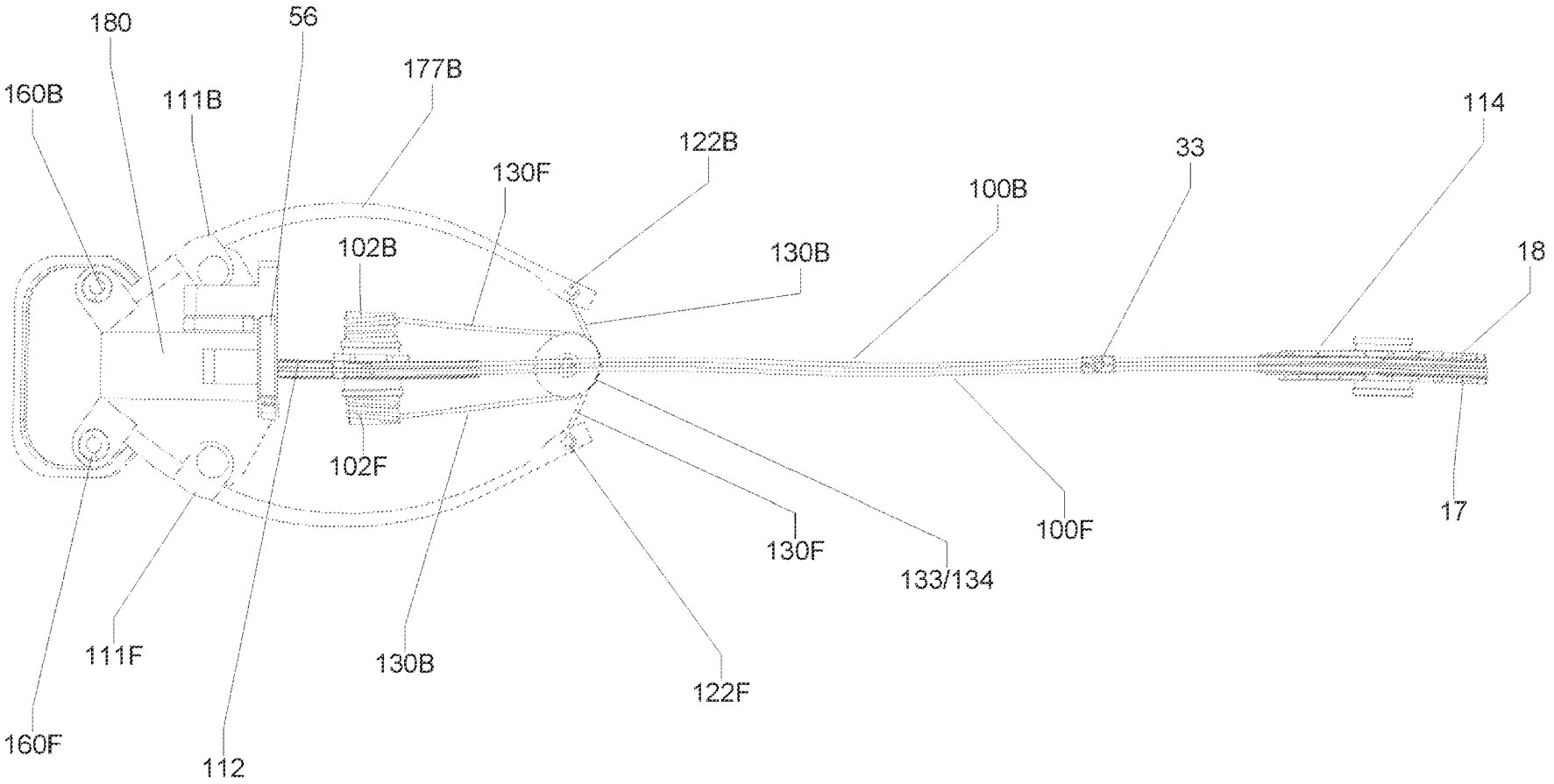
FIG. 17 is a top view of the linear crossbow of FIG. 11 in the drawn position with components exposed.
Figure 18:
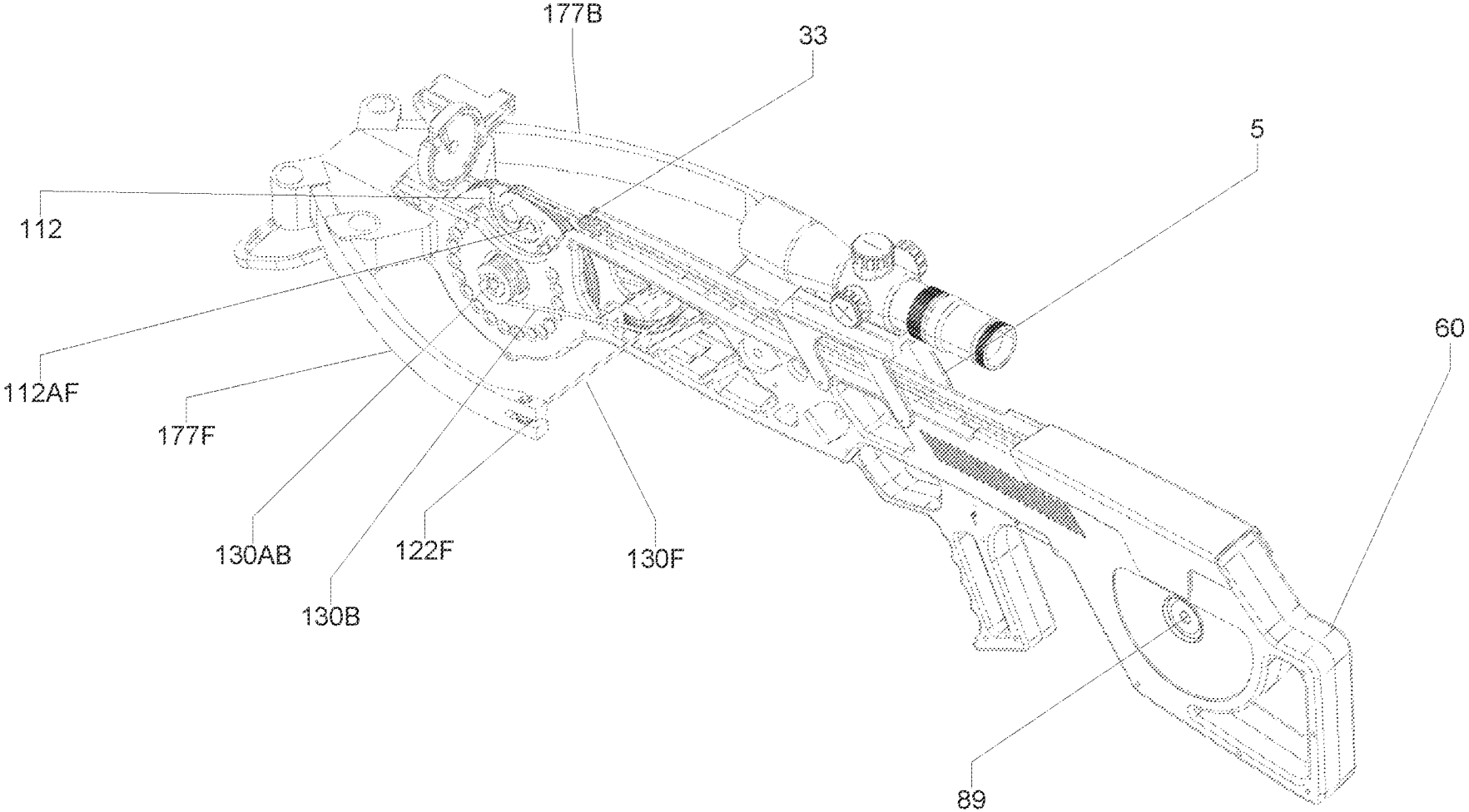
FIG. 18 is a perspective view of the linear crossbow of FIG. 11 in the undrawn position and a left side overview.
Figure 19:
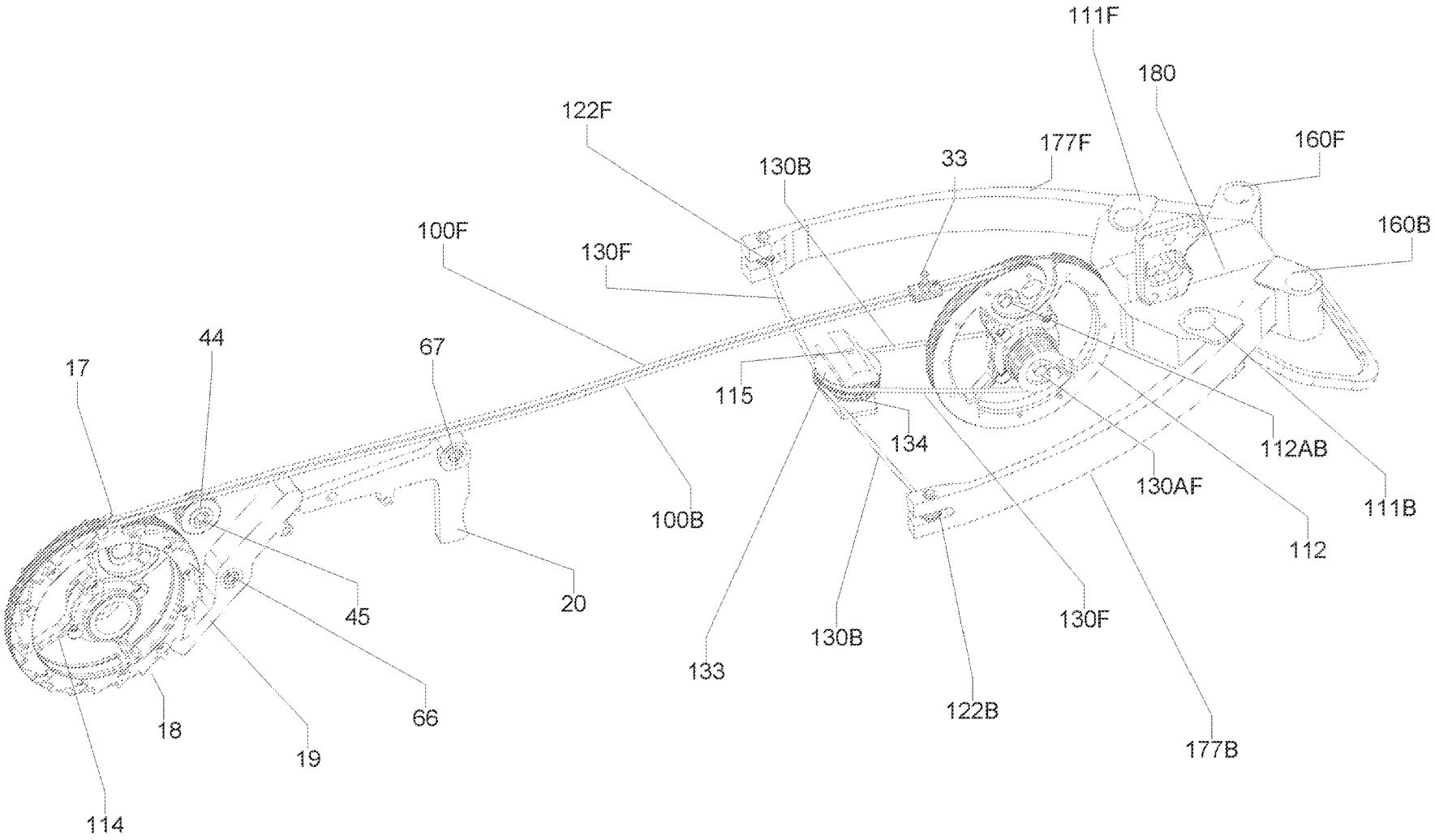
FIG. 19 is a perspective view of the linear crossbow of FIG. 11 in the undrawn position and the right side view with components exposed.
Figure 20:
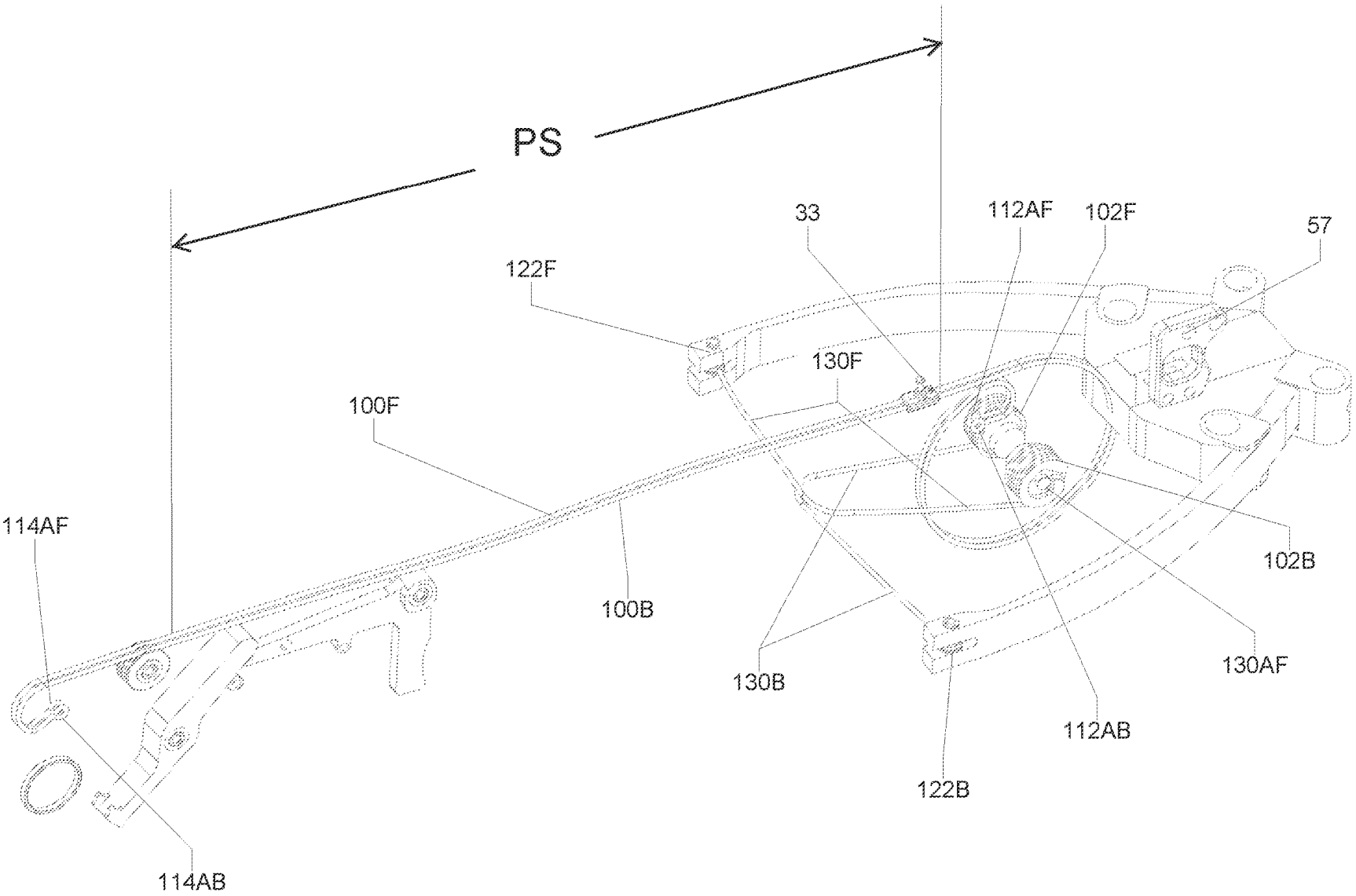
FIG. 20 is a right side perspective view of the linear crossbow of FIG. 11 in the undrawn further detailing the string paths and connection points.
Figure 21:
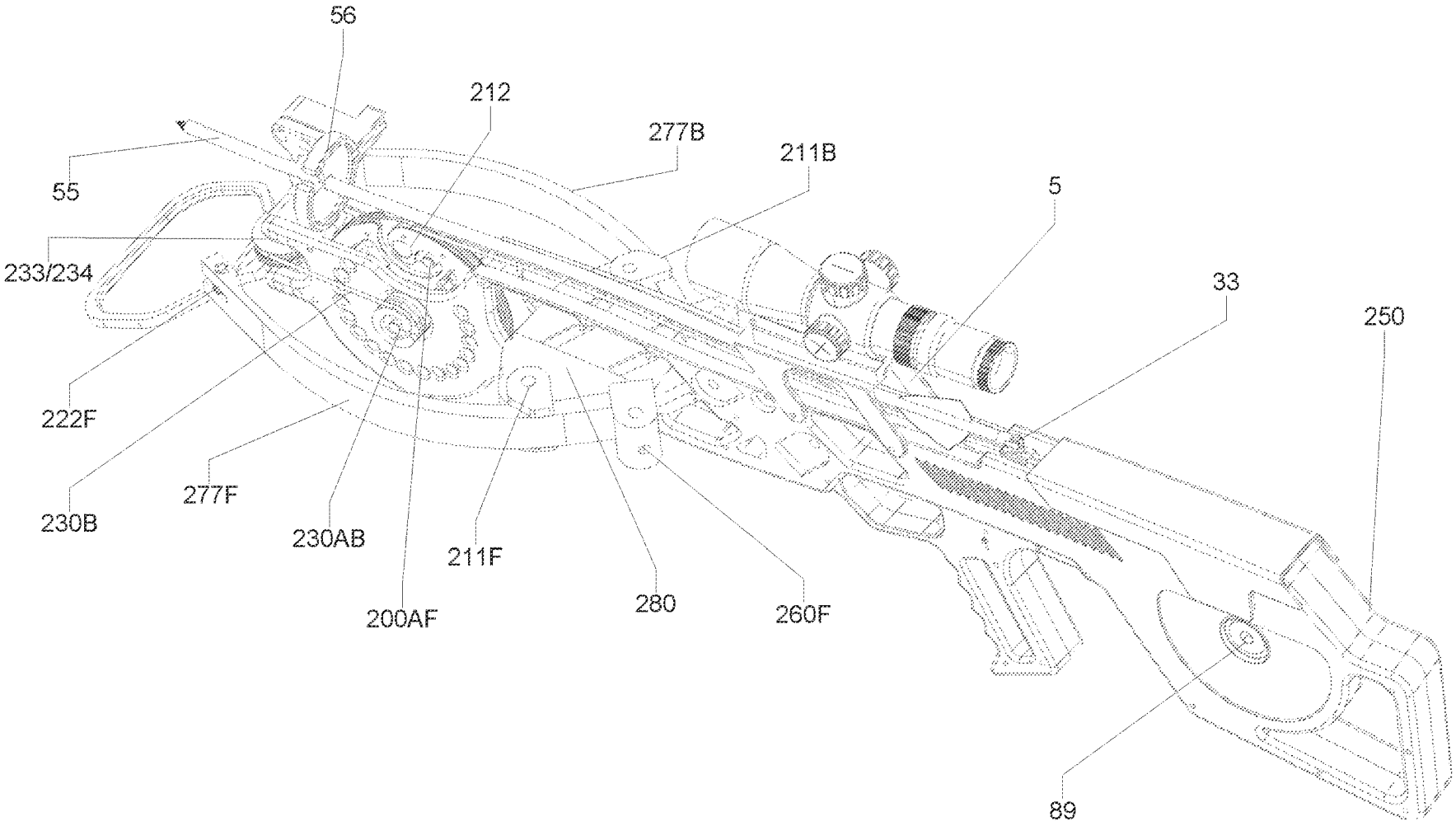
FIG. 21 is a perspective of another linear crossbow with a forward let out string track with limbs facing in the forward direction in the drawn position.
Figure 22:
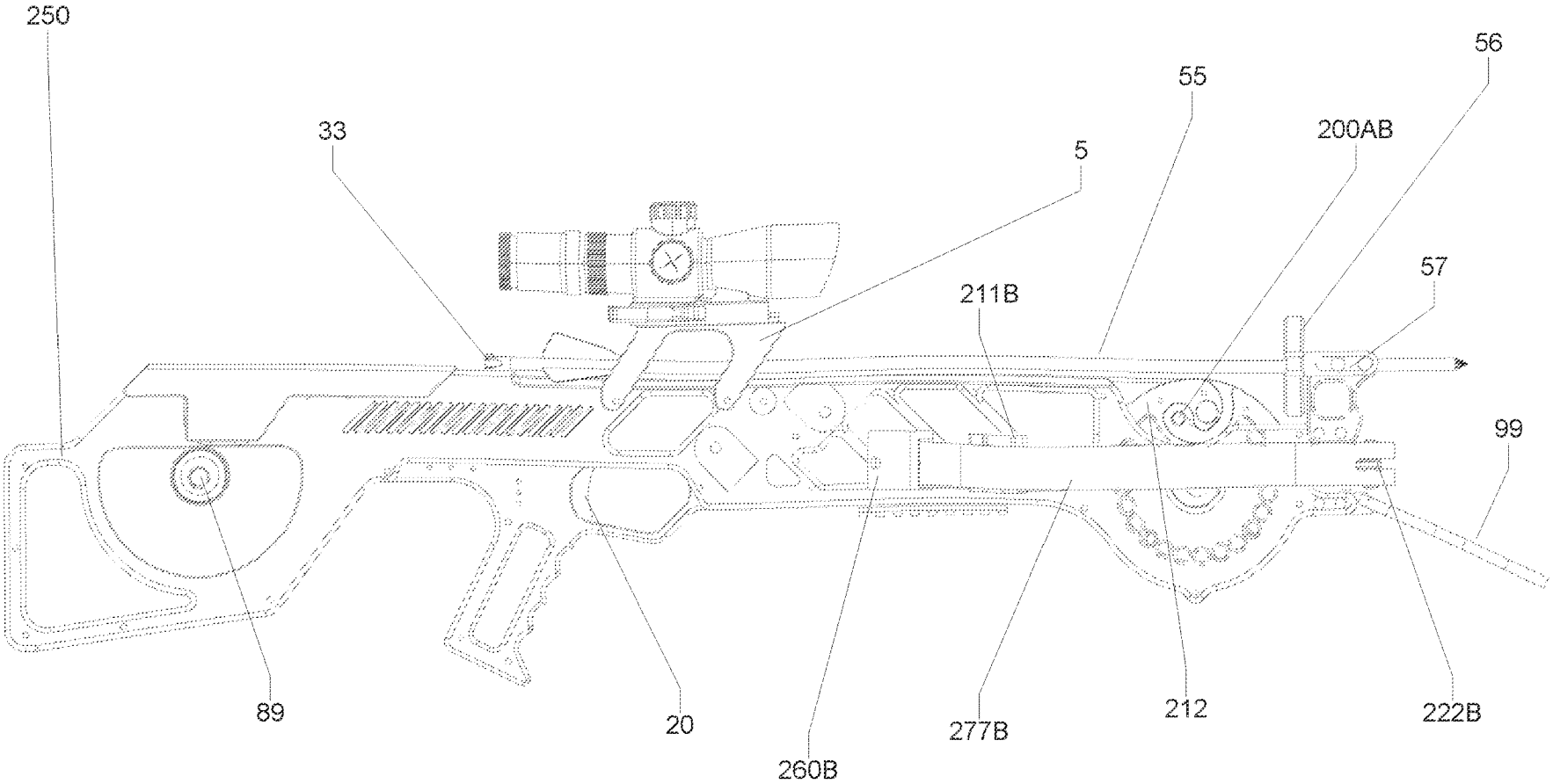
FIG. 22 is a right side view of the linear crossbow of FIG. 21.
Figure 23:
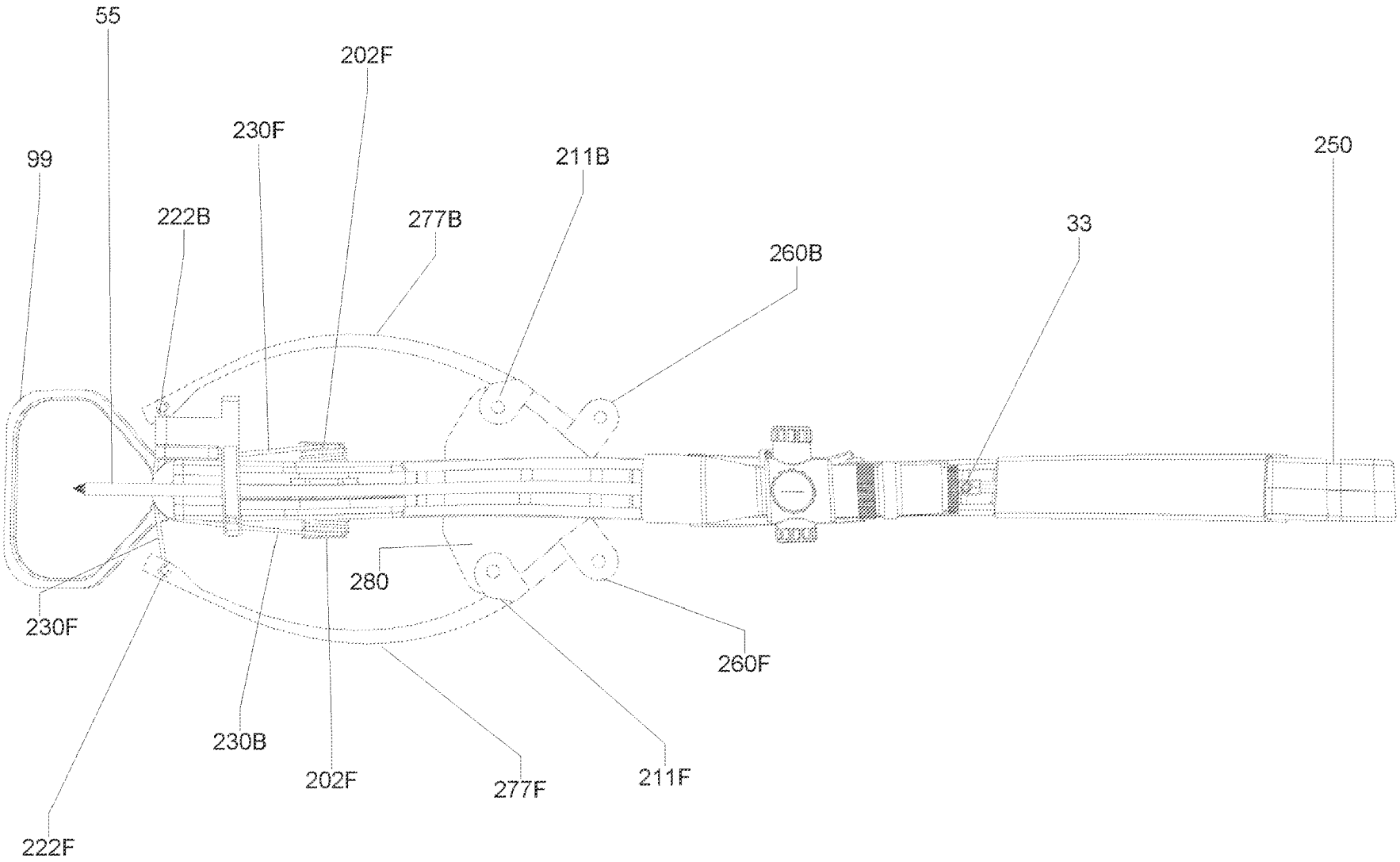
FIG. 23 is a top view of the linear crossbow of FIG. 21 in the drawn position.
Figure 24:
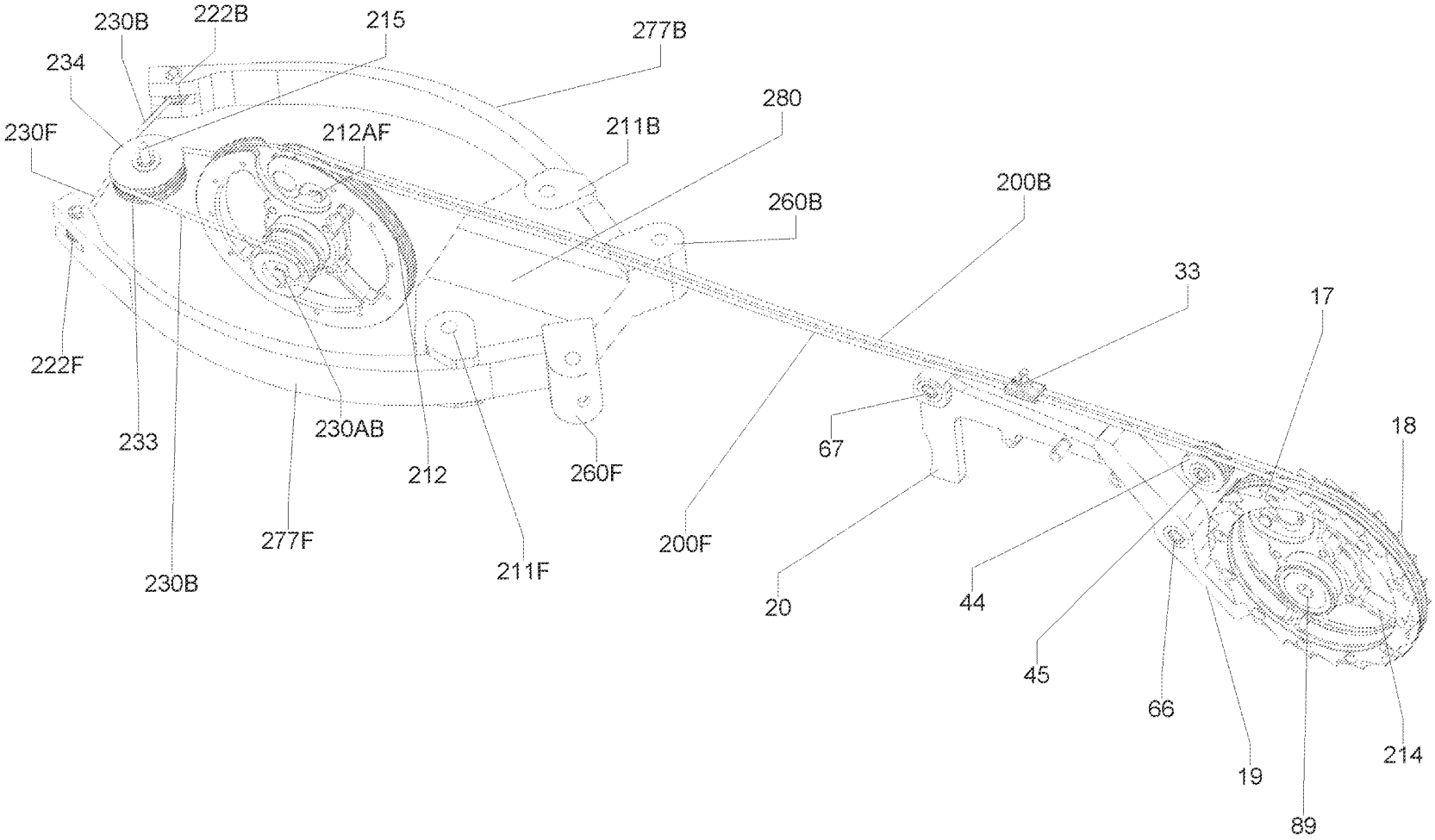
FIG. 24 is a left side perspective view of the linear crossbow of FIG. 21 in the drawn position showing internal details.
Figure 25:
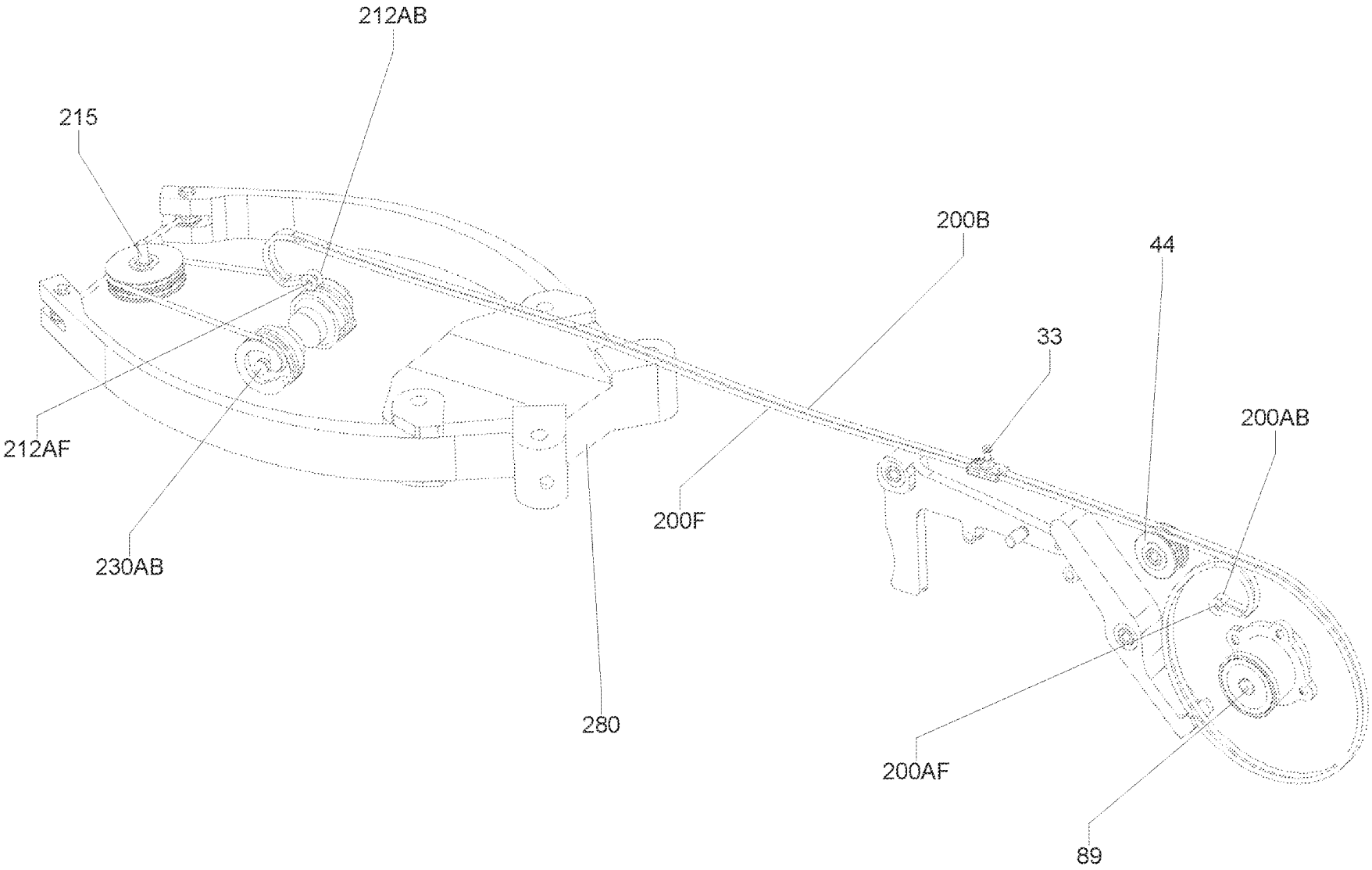
FIG. 25 is a left side perspective view of the linear crossbow of FIG. 21 in the drawn position further detailing the string connection points.

The trigger assembly 20 and the latch assembly both have springs 77 and 78 that bias the position shown in FIG. 3. The rear take up assembly 14 is rotatably mounted to the stock 6 with bearings and axle 89 allowing 14 to freely and efficiently rotate. The entire assembly axle 89 has a receptacle to accept the detachable handle crank 15 and ratchet the assembly to the drawn position. The trigger assembly 20 interacts with 19 latch assembly such that when trigger of the trigger assembly 20 is depressed the 19 latch disengages and allows the loaded draw strings 1F and 1B to transfer by being pulled by the forward string let out assembly 12 while limbs 7F and 7B are unloading and concurrently pulling on power cables 3F and 3B causing the 12 forward let out track to quickly wind strings 1F and 1B up and unload string portion that was wound on rear take up track assembly 14 until all the draw strings 1F and 1B reach where they are attached and causing unwinding to stop by using the 44 stop pulley.

The arrow shuttle 33 is affixed to draw strings 1F and 1B and is located such that in the at rest position and the fully cocked position it remains along the straight path between 12 and 14. The arrow attachment post allows the arrow 55 to be nocked on the arrow shuttle 33 and the forward portion of the arrow 55 is supported by the arrow rest 56. The shuttle 33 is only supported by the draw strings 1F and 1B and has no frictional loss from being guided on a track. The power stroke PS is typically 14 inches but can be between 1 inch to 30 inches since the design allows for very long power strokes.

The diameter of 12 and 14 respectfully have a circumference that is equal or great than the desired power stroke PS. The diameter of 12 and 14 are around 4.7 inches but can be between 1 and 8 inches. The string grooves tracks of 12 and 14 are linear and a single rotation; but could also be spiral or stacked allowing significantly more draw string to be spooled and make the track diameters smaller and still provide enough payout for a power stroke of 6 to 30 inches. The reasoning for 12 and 14 being a single layer since it is the most efficient method for operation at the high speeds for shooting arrows 55.

Figure 52:
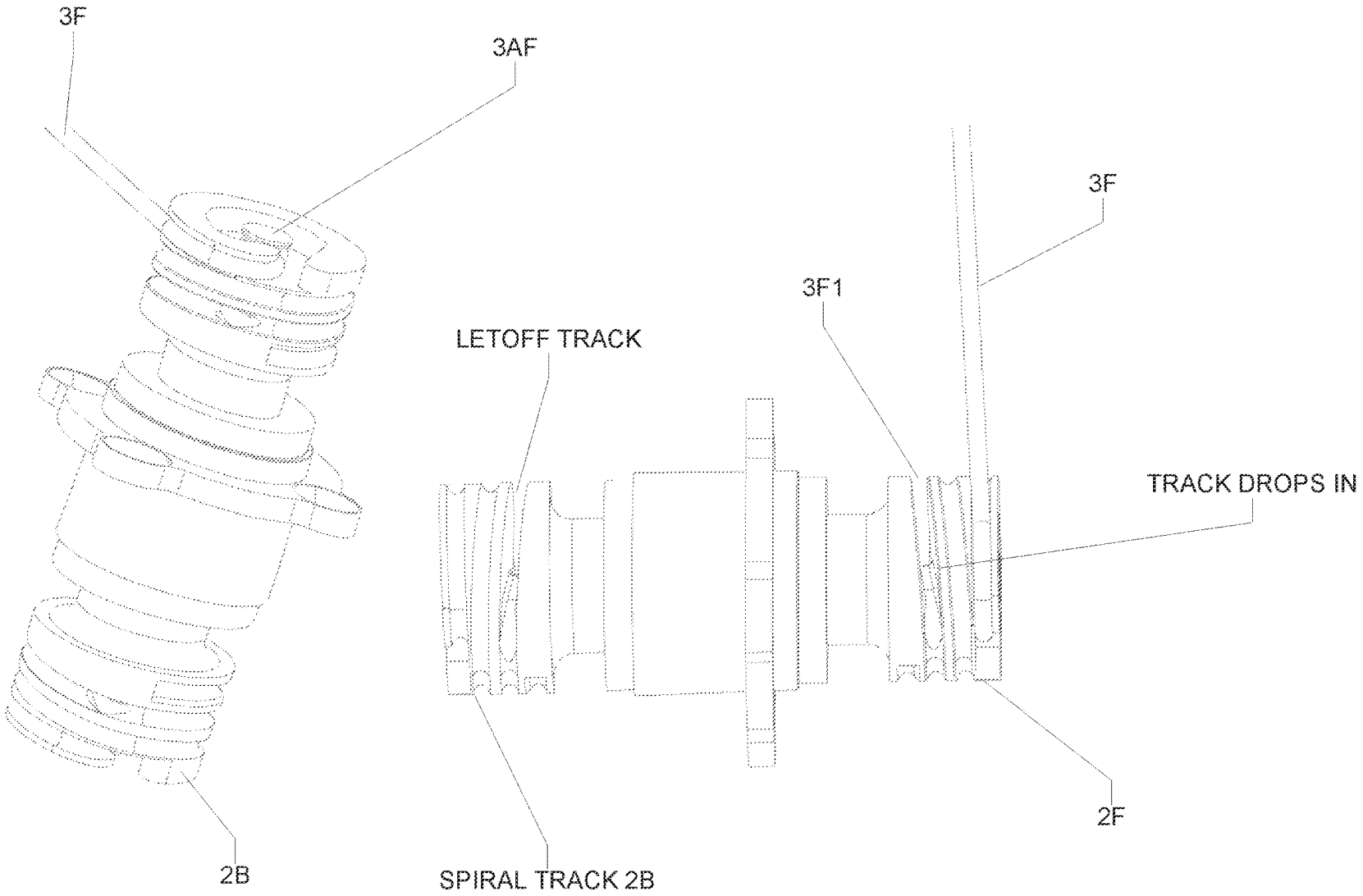
FIG. 52 is a side and perspective view of the power take up spiral track with let off.
Figure 53:
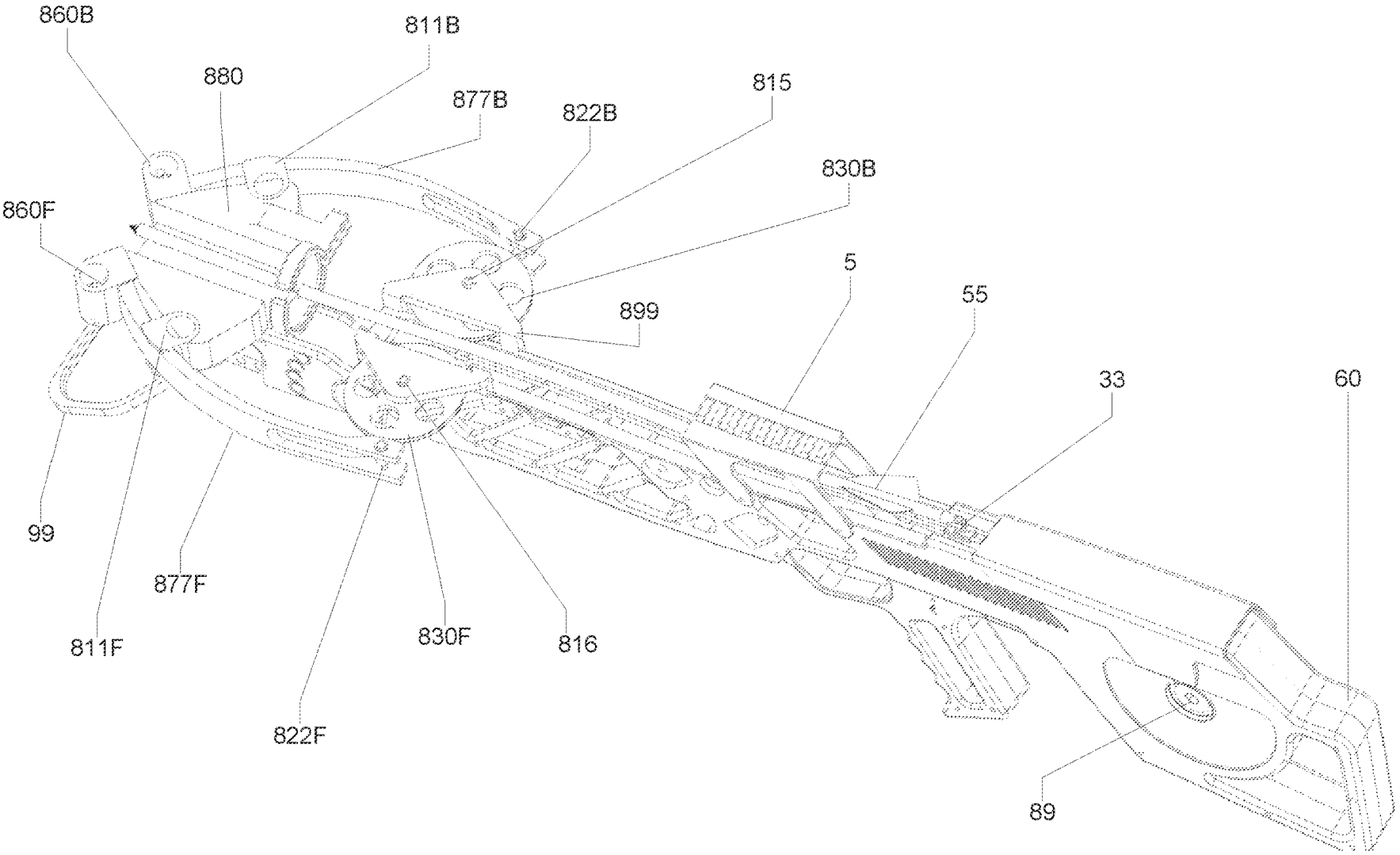
FIG. 53 is another linear crossbow design with a pair of cams affixed to the stock and the limbs distally mounted in the rearward direction with the power cables attached to the end of limbs and then to the fixed central cams shown in the drawn position.
Figure 54:
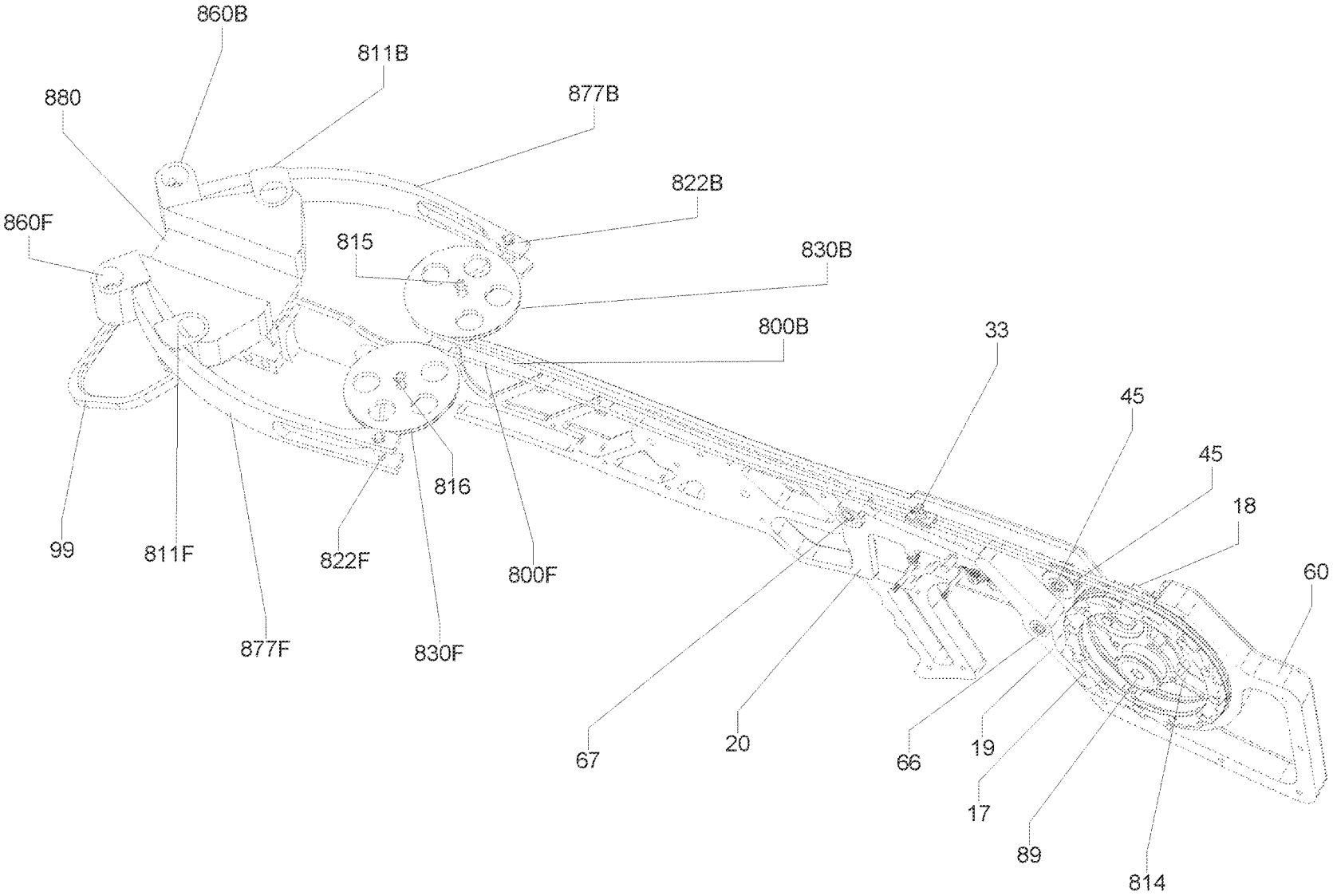
FIG. 54 is a left perspective view of the linear crossbow shown in FIG. 53 in the drawn position and a partial cut away view of the stock to display the inner working components.
Figure 55:
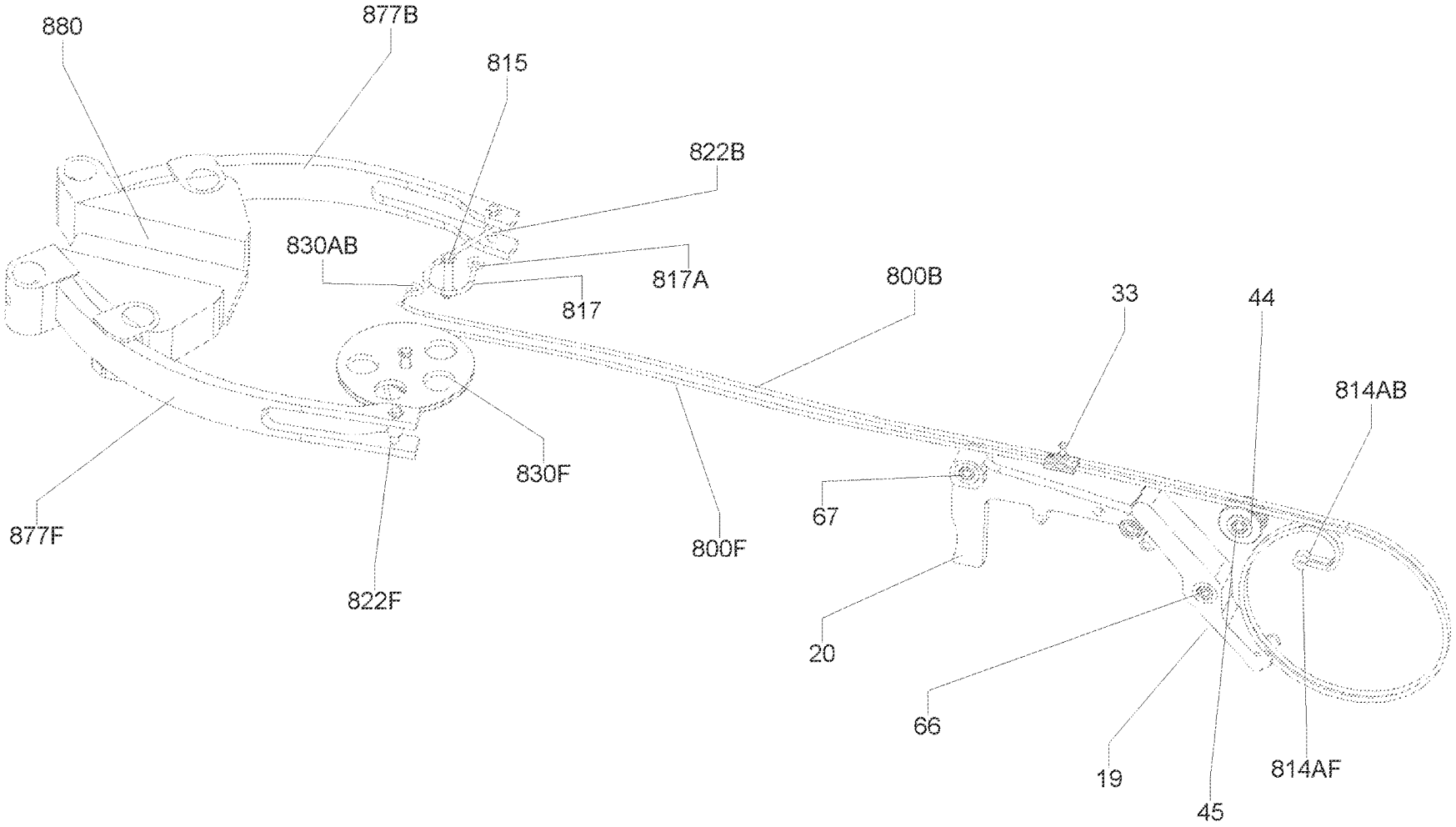
FIG. 55 is a left perspective view of the linear crossbow of FIG. 53 exposing the inner working and string connection points in the drawn position.
Figure 56:
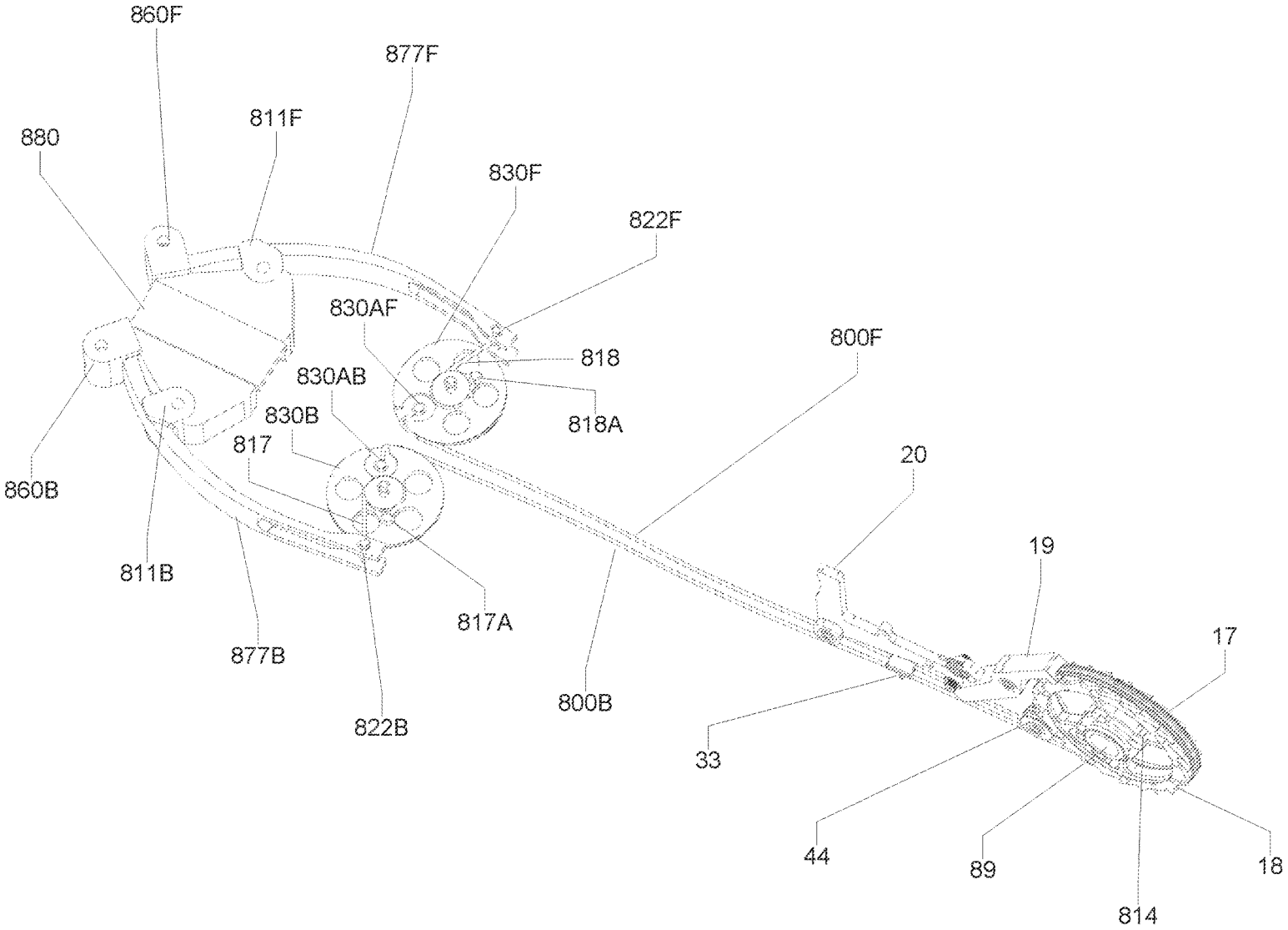
FIG. 56 is a bottom perspective view of the linear crossbow of FIG. 53 exposing the inner working of the linear crossbow in the drawn position.
Figure 57:
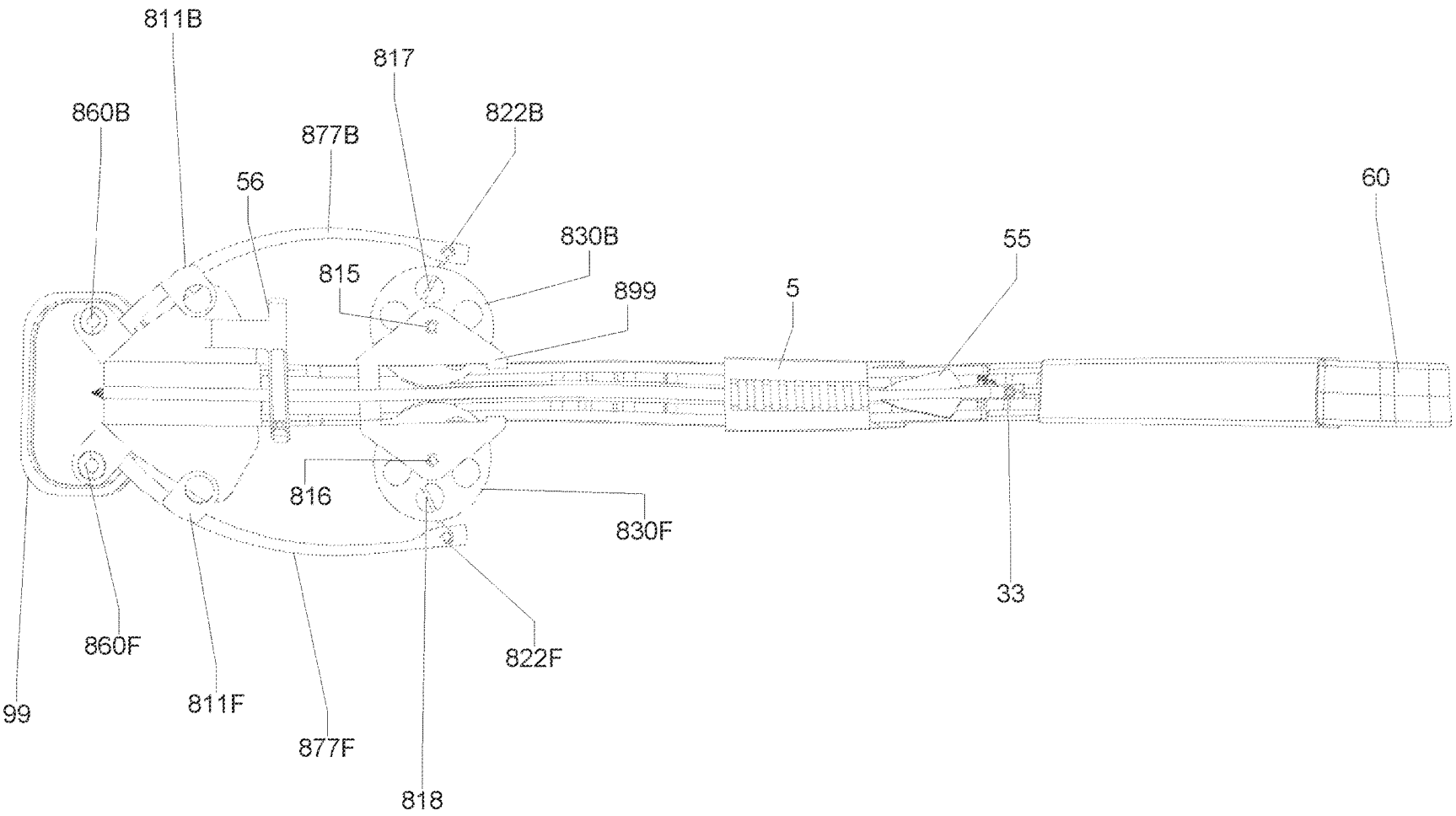
FIG. 57 is a top view of the linear crossbow of FIG. 53 detailing the operation of components in the drawn position.
Figure 58:
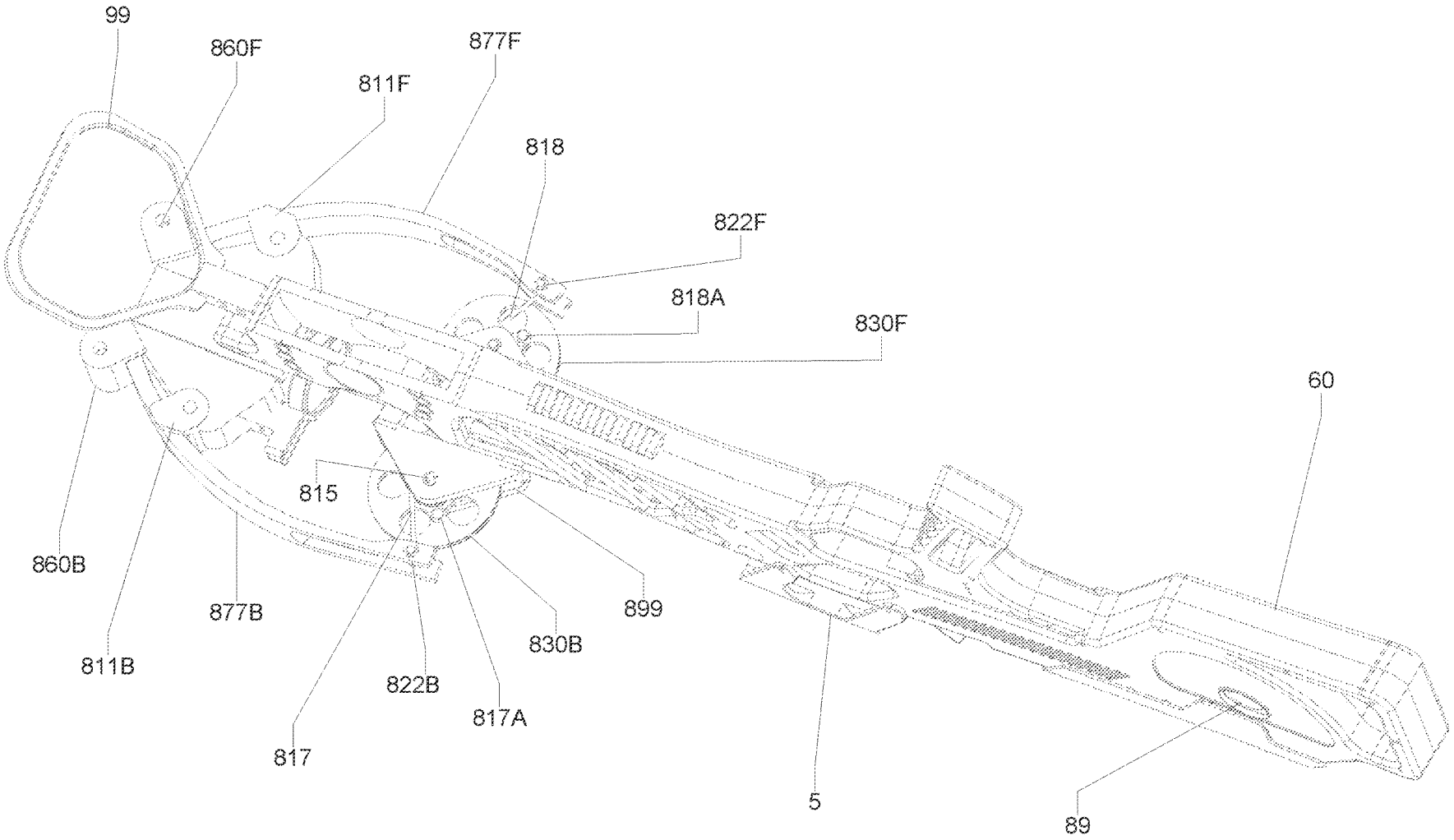
FIG. 58 is a bottom perspective view of the complete linear crossbow in the drawn position.
Figure 59:
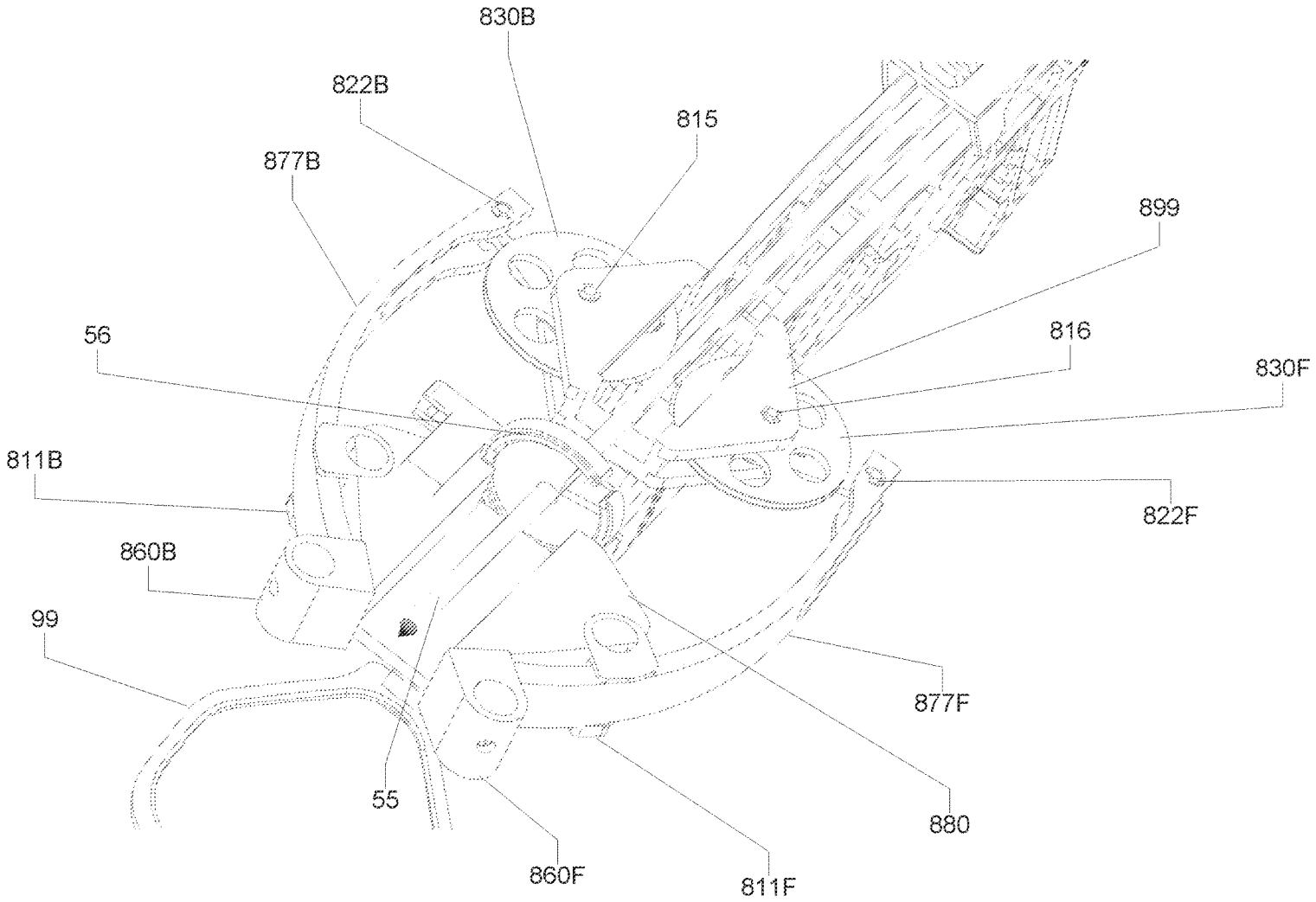
FIG. 59 is a top perspective zoom view of the linear crossbow of FIG. 53.
Figure 60:
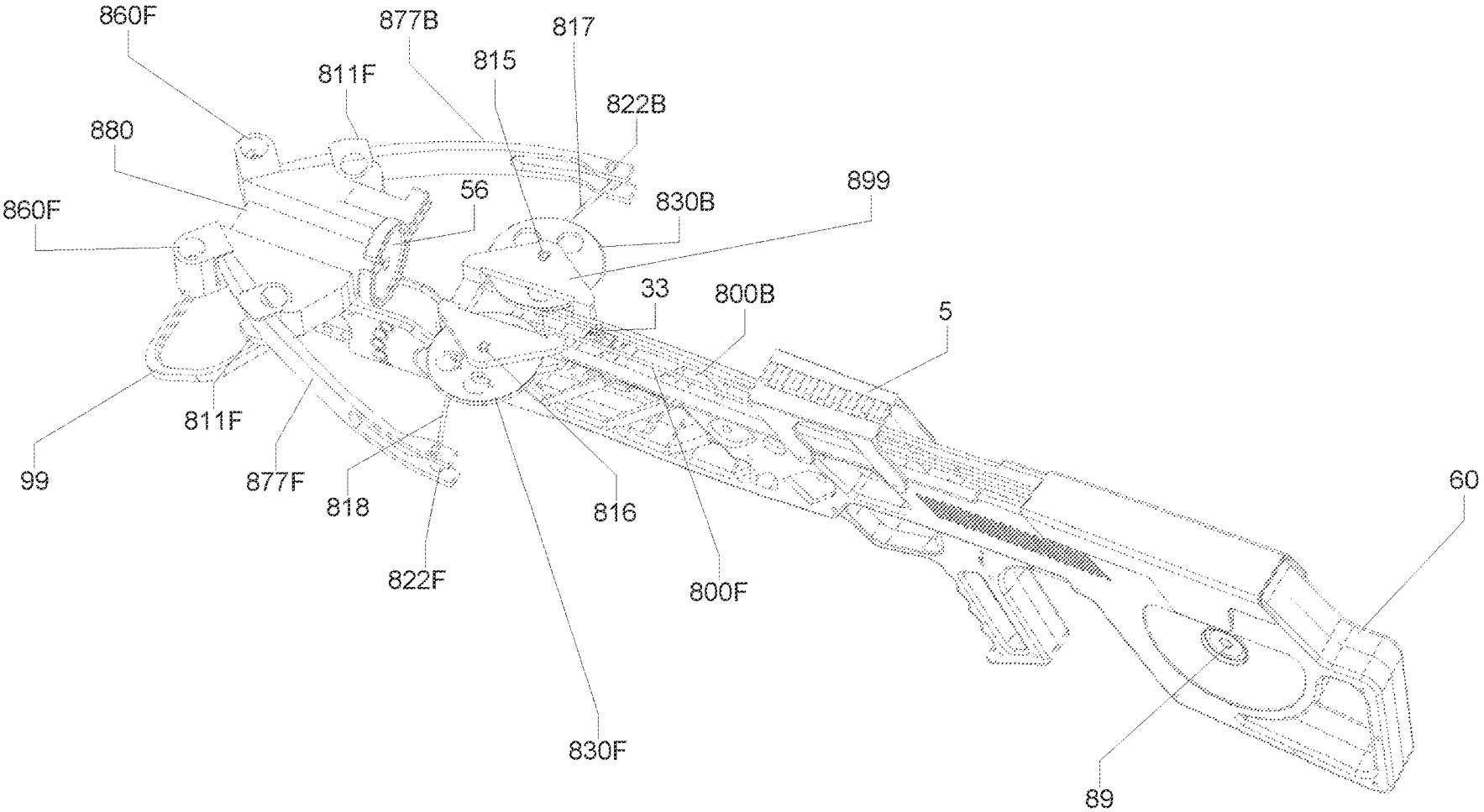
FIG. 60 is a left side perspective view of the linear crossbow of FIG. 53 in the undrawn position.
Figure 61:
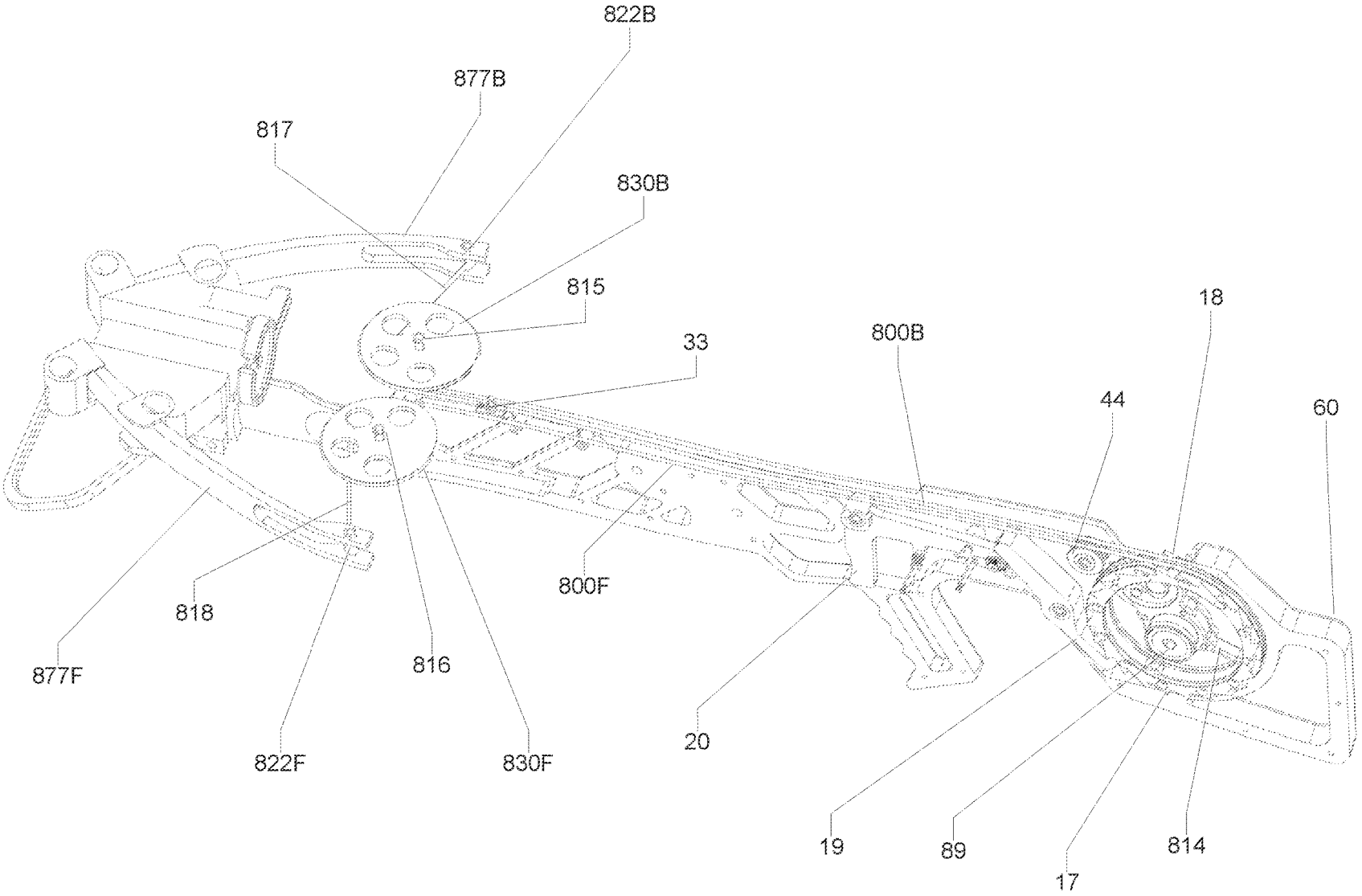
FIG. 61 is a left perspective view of the linear crossbow of FIG. 53 in the undrawn position with exposed stock portion to view inner workings.
Figure 62:
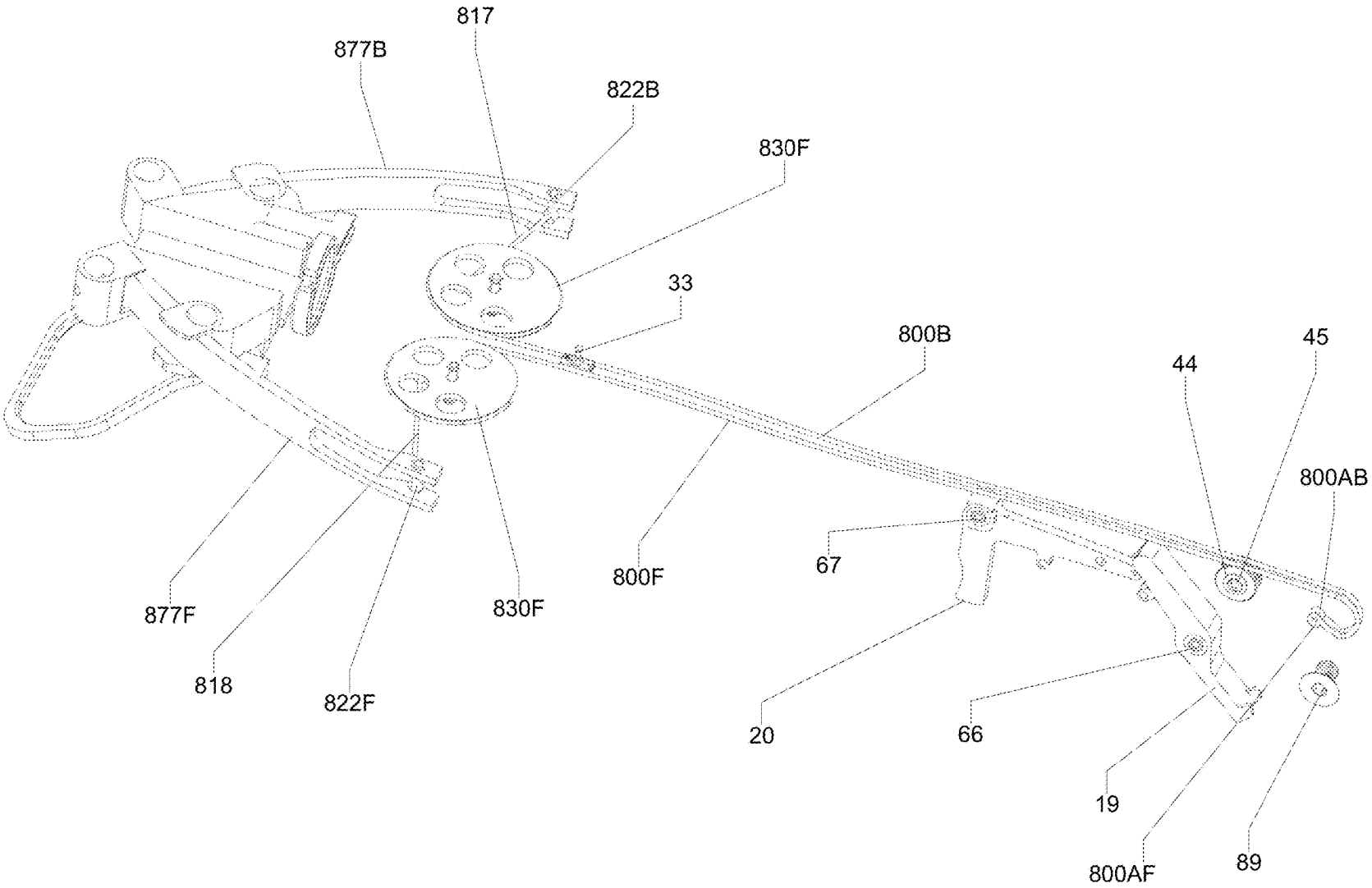
FIG. 62 is a left perspective view of the linear crossbow of FIG. 53 in the undrawn position showing the string routing details.
Figure 63:
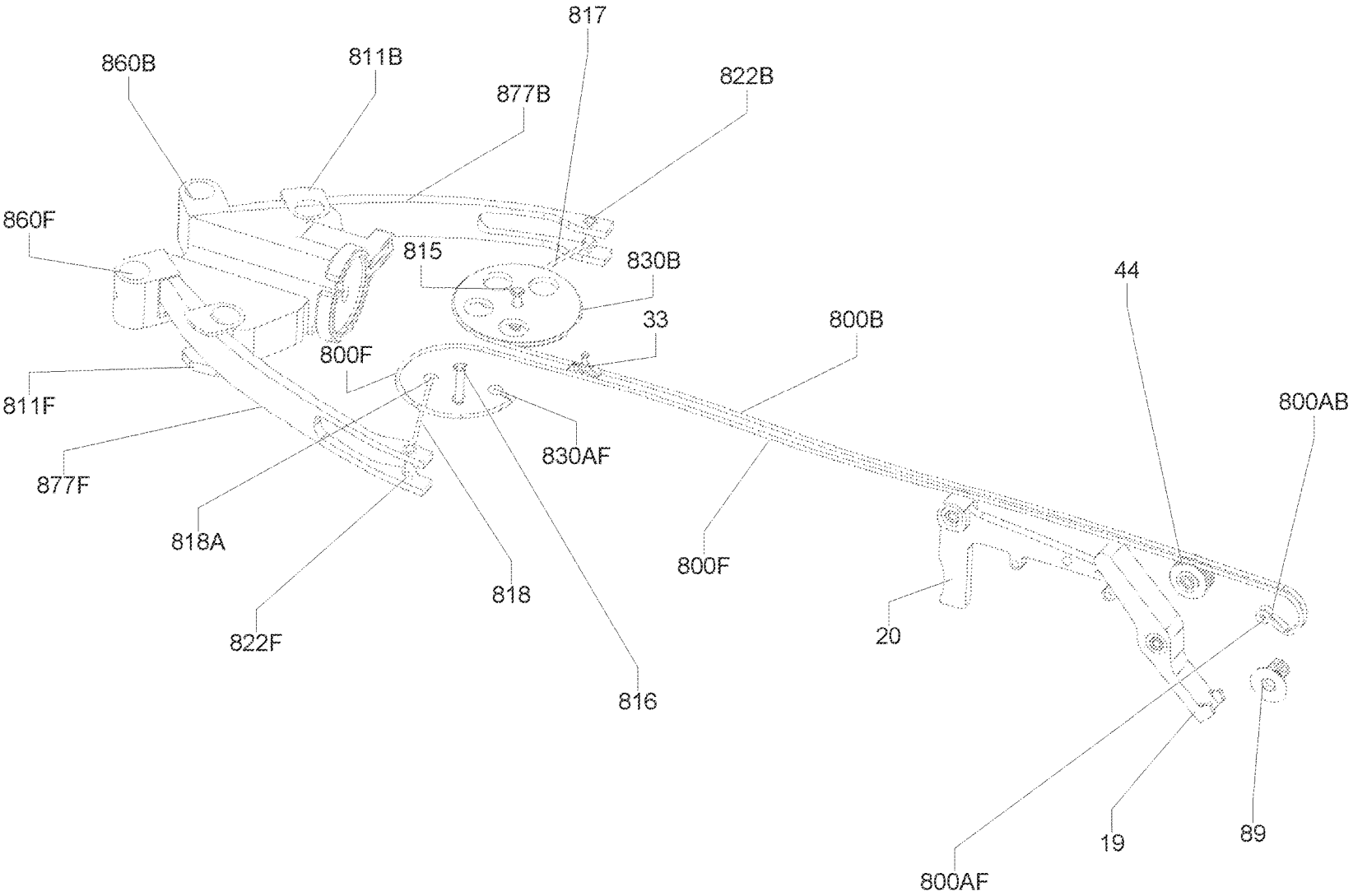
FIG. 63 is a left perspective view of the linear crossbow of FIG. 53 in the undrawn position showing further details of the string routing.
Figure 64:
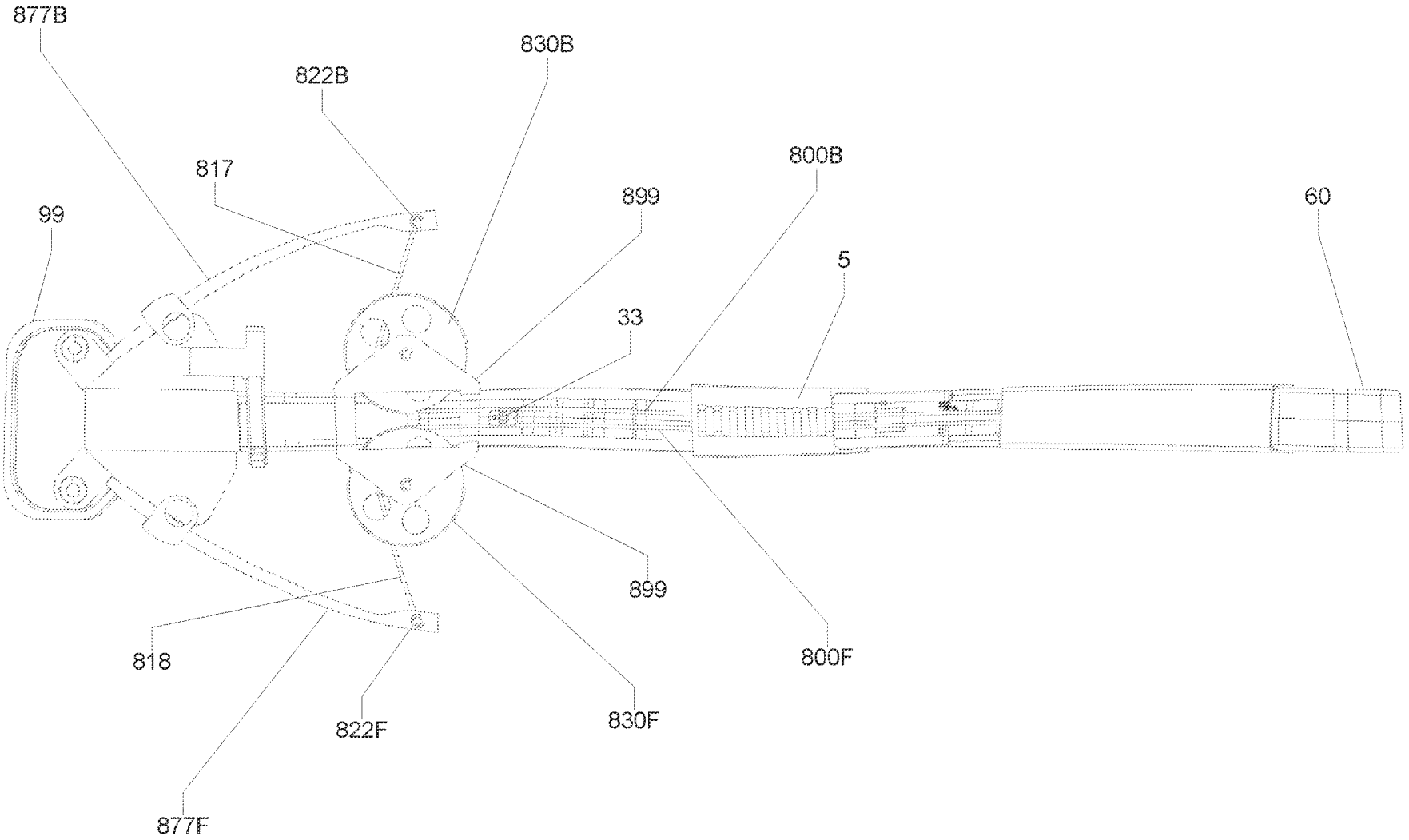
FIG. 64 is a top view of the linear crossbow of FIG. 53 in the undrawn position.
Figure 65:
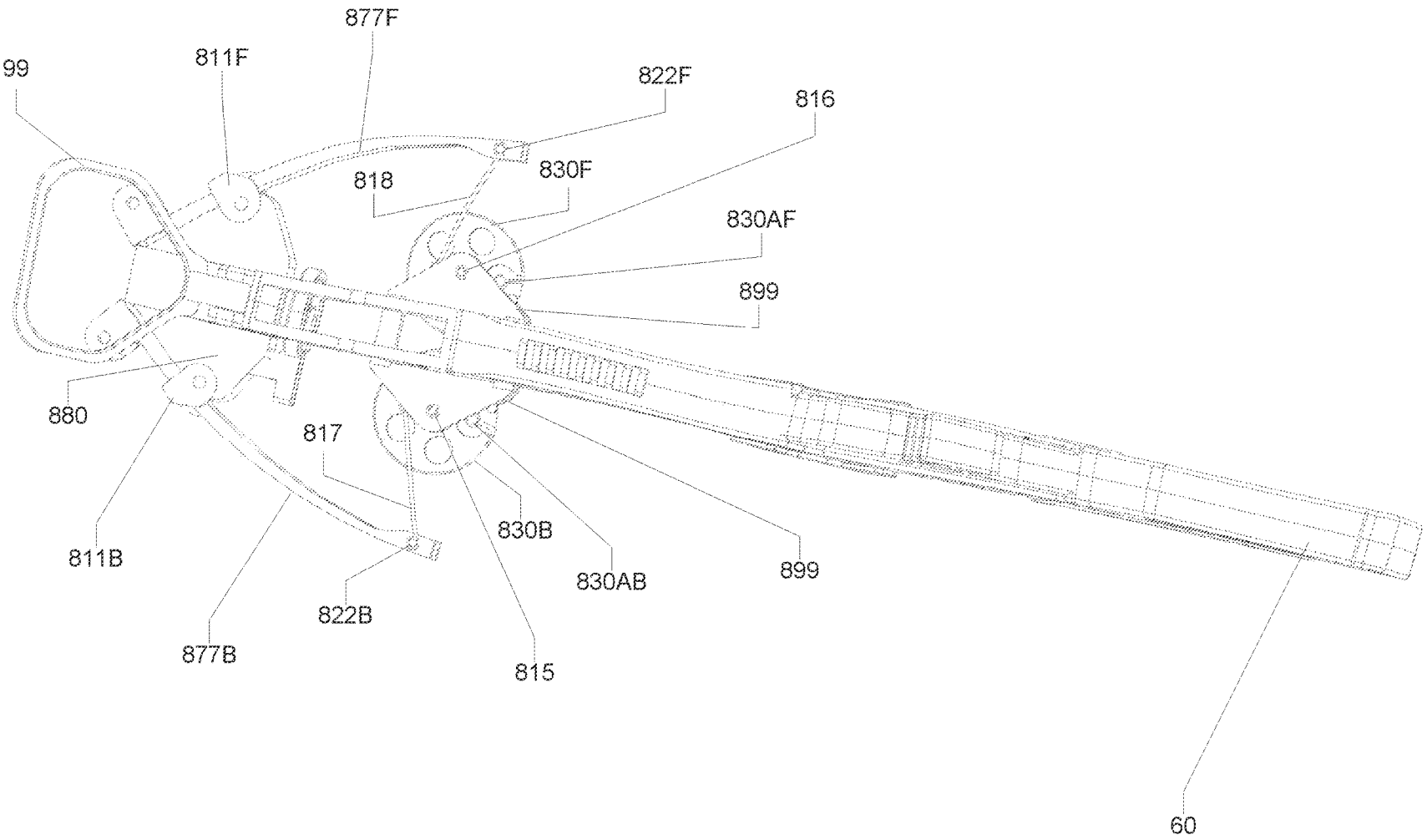
FIG. 65 is a bottom perspective view of the linear crossbow of FIG. 53 in the undrawn position.
Figure 66:
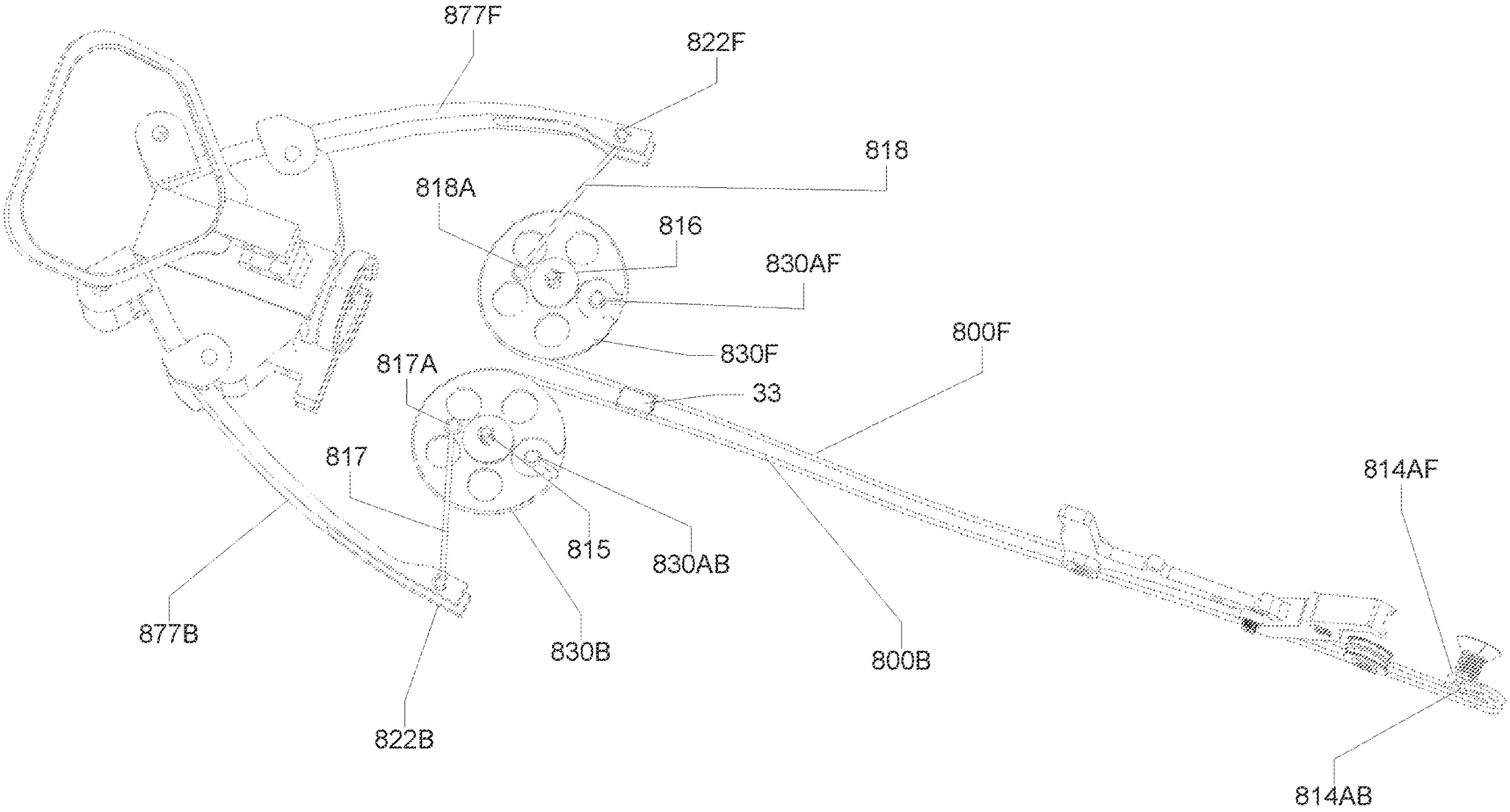
FIG. 66 is a bottom perspective view of the linear crossbow of FIG. 53 in the undrawn position removing the stock to detail the inner components.
Figure 67:
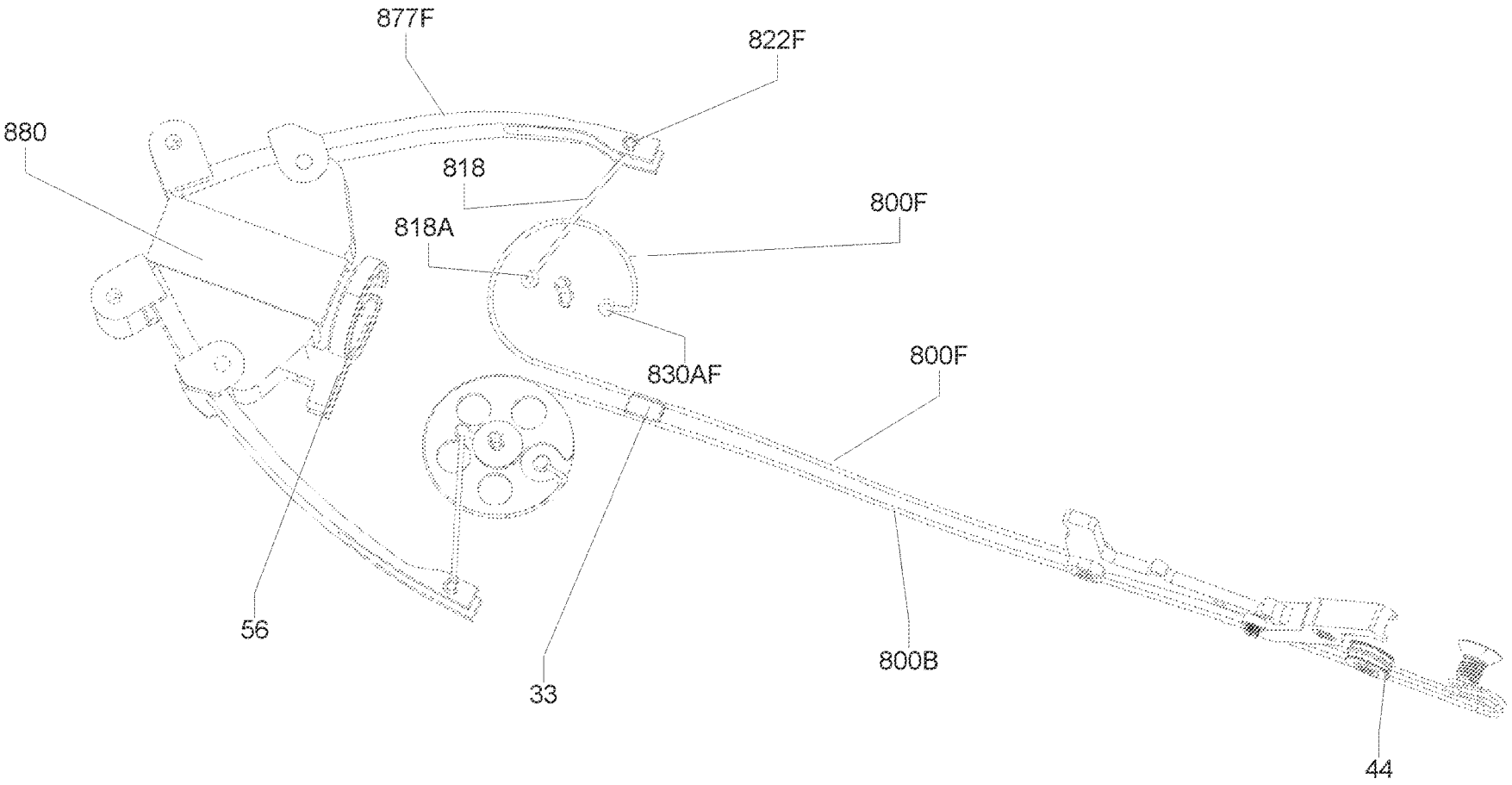
FIG. 67 is a bottom perspective view of the linear crossbow of FIG. 53 in the undrawn position with the string routing details exposed.

The forward spiral take up tracks 2F and 2B are shown circular in nature but could be noncircular and could also contain a let off portion to allow the holding weight at full draw to be near zero as shown in FIG. 52. The spiral track 2F wraps the power cable 3F around a circumference and as shown then 3F1 drops to a much smaller diameter to reduce the bias significantly on the string let out track assembly 12 and make the trigger of the trigger assembly 20 have a much lower pull needed to release the latch 19 for shooting. The let off for 3F1 can be from 0 to 100 percent and preferably around a 70 percent let off.

The trigger mechanism can include an auto safety and anti-dry fire protection but for ease of explanation they have been omitted here. Such items could easily be included.

The linear crossbow shown in the figures also shows a foot stirrup 99 that is mostly for safety of arrow and not needed as a cocking aid. The primary method of cocking the linear crossbow is using the detachable handle crank 15 that fits into a receiving socket of axle 89 that is directly connected to the rear take up assembly 14.

The method of operation of the linear crossbow in detailed in FIG. 1 thru 10 showing the linear crossbow both the drawn and undrawn positions. In the undrawn positions the draw strings 1B and 1F are initially would around string let out assembly and attached to the rear take up assembly 14. During the drawing cycle the limbs 7F and 7B are drawn down by power cables 3F and 3B as assembly 12 rotates thus letting out draw string 1F and 1B to the rear take up assembly 14 until the desired power stroke is reach and held by the latch means 20 of the rear take up assembly 14. At the end of the draw cycle or drawn position the draw strings are wrapped around the take up assembly 14 as shown in the Figures and the string let out assembly has draw strings 1F and 1B at the end of the available draw string payout. The process repeats every time the linear crossbow is fired and drawn again. The attachments of arrow shuttle is a post with an diameter of about 0.115 inches matching the diameter of most draw strings used today thus mimicking a draw string connection. The connections means or arrow shuttle 33 could be any type of connection means for arrows or other projectiles.

Section 2—Parallel Limbs Rear Facing

Another example configuration of the linear crossbow is shown in FIG. 11 through FIG. 20. In this example, the linear crossbow has a few additional components to redirect the power cables from the limb tips to the power tracks on the forward string let out tracks. Furthermore, this design has rearward facing and near parallel limb arrangement that will significantly reduce recoil and shock after the shot. The layout of the limbs and the additional guide pulleys are the main difference from the linear crossbow shown in FIG. 11 thru 20. The details described will focus primarily on the limbs and pulleys and the rest will be understood to be similar or the same as the prior design described in Section 1.

The following details describe the design for this linear crossbow starting with the limbs. The limbs 177F and 177B can either be single or split limbs design, also the limbs 177F and 177B are attached to a forward riser 180 section and are distally mounted from riser 180 and the riser 180 is affixed to stock 60. The limb 177F and 177B are affixed to riser 180 at point 160F and 160B. The limbs 177F and 177B are also supported over mid limb supports 111F and 111B to provide a moment for the limbs to flex over. The mid limb supports 111F and 111B are also affixed to the riser 180 as shown. The limbs 177F and 177B free ends have power cables 130F and 130B that are affixed to the free limb ends at point 122F and 122B.

The power cable 130F and 130B are then directed towards the guide pulleys 133 and 134. Pulleys 133 and 134 are independently rotatably mounted to stock 60 and freely rotate about axle 115 which is rigidly mounted to the stock 60. The power cables 130F and 130B are then directed towards the forward string let out track power take up spiral tracks at 102F and 102B and affixed at points 130AF and 130AB.

Furthermore, spiral tracks 102F and 102B are part of the forward string let out track assembly 112 which is rotatably mounted to the stock 60. The string let out track assembly has draw strings 100F and 100B attached to 112 assembly at point 112AF and 112AB and in the undrawn state are wrapped about the circumference and then directed to the stop pulley 44 and then rear draw string take up assembly 114. The draw strings 100F and 100B are attached to 114 assembly at 114AF and 114AB as shown. In the undrawn state arrow shuttle 33 is in the forward position and in the drawn position move back.

During the drawing cycle the limbs 177F and 177B are flexed as the assembly 112 is rotated causing draw strings 100F and 100B to payout to the rear take up assembly 114 and the limb power cables 130B and 130F pull on the limbs and are taken up by the rotation of forward string let out assembly 112. The rest of the function of this design has been described above.

The overall width of the linear crossbow describes in FIG. 10 thru 20 can have a width between 3 inches and 24 inches depending on the angle of the limbs, but preferable in the range of about 8 inches in undrawn position. The power stroke of this design would be in the range of 1 to 30 inches and preferably around 15 inches. The arrow shuttle 33 is affixed to draw strings 100F and 100B such that going from the undrawn to drawn position the arrow shuttle moves about 14 inches in the direction of arrow flight and remains attached and under tension.

The basic premise of this design is using two limbs with independent power cables working a central or single string let out means using independently attached power cables that are directed to the same assembly biasing the forward string let out assembly 112 to resist letting out the draw strings 1F and 1B. The draw strings 1F and 1B payout and take up between 112 and 114 and repeat this process during the shooting and cocking of the linear crossbow. The linear crossbow also shows a scope mount 5 that is mounted to the sides of the stock anywhere along the length of the stock providing for a very rigid mount that allows the draw strings, arrow, and arrow shuttle to freely pass between and under the scope mount without interference to the travel of the mentioned. The power stroke PS with this design can between 1 and 30 inches and the arrow shuttle 33 moves between the forward and rearward string tracks.

Section 3—Parallel Limbs Forward Facing

Another example configuration of the linear crossbow is shown in FIG. 21 through 27. The linear crossbow shown here is very similar to the linear crossbow of section 2 but the limbs are pointing in the opposite direction shifting the weight and improving balance. Furthermore, this design has forward facing and near parallel limb arrangement that will significantly reduce recoil and shock after the shot. This linear crossbow design may balance better and pulls the riser weight further back. The layout of the limbs and the additional guide pulleys are the main difference from the linear crossbow shown in FIG. 1 thru 10. The details described will focus primarily on the limbs and pulleys and the rest will be understood to be similar or the same as the prior design described in Section 1.

The following details describe the design for this linear crossbow starting with the limbs. The limbs 277F and 277B can either be single or split limbs design, also the limbs 277F and 277B are attached to a rearward riser 280 section and are distilling mounted from riser 280 and the riser 280 is affixed to stock 250. The limb 277F and 277B are affixed to riser 280 at point 260F and 260B. The limbs 277F and 277B are also supported over mid limb supports 211F and 211B to provide a moment for the limbs to flex over. The mid limb supports 211F and 211B are also affixed to the riser 280 as shown. The limbs 277F and 277B free ends have power cables 230F and 230B that are affixed to the free limb ends at point 222F and 222B.

The power cable 230F and 230B are then directed towards the forward guide pulleys 233 and 234. Pulleys 233 and 234 are rotatably mounted to stock 250 and freely rotate about axle 215 which is rigidly mounted to the stock 250. The power cables 230F and 230B are then directed towards the forward string let out track power take up spiral tracks and 202F and 202B and attached at point 230AF and 230AB.

Figure 26:
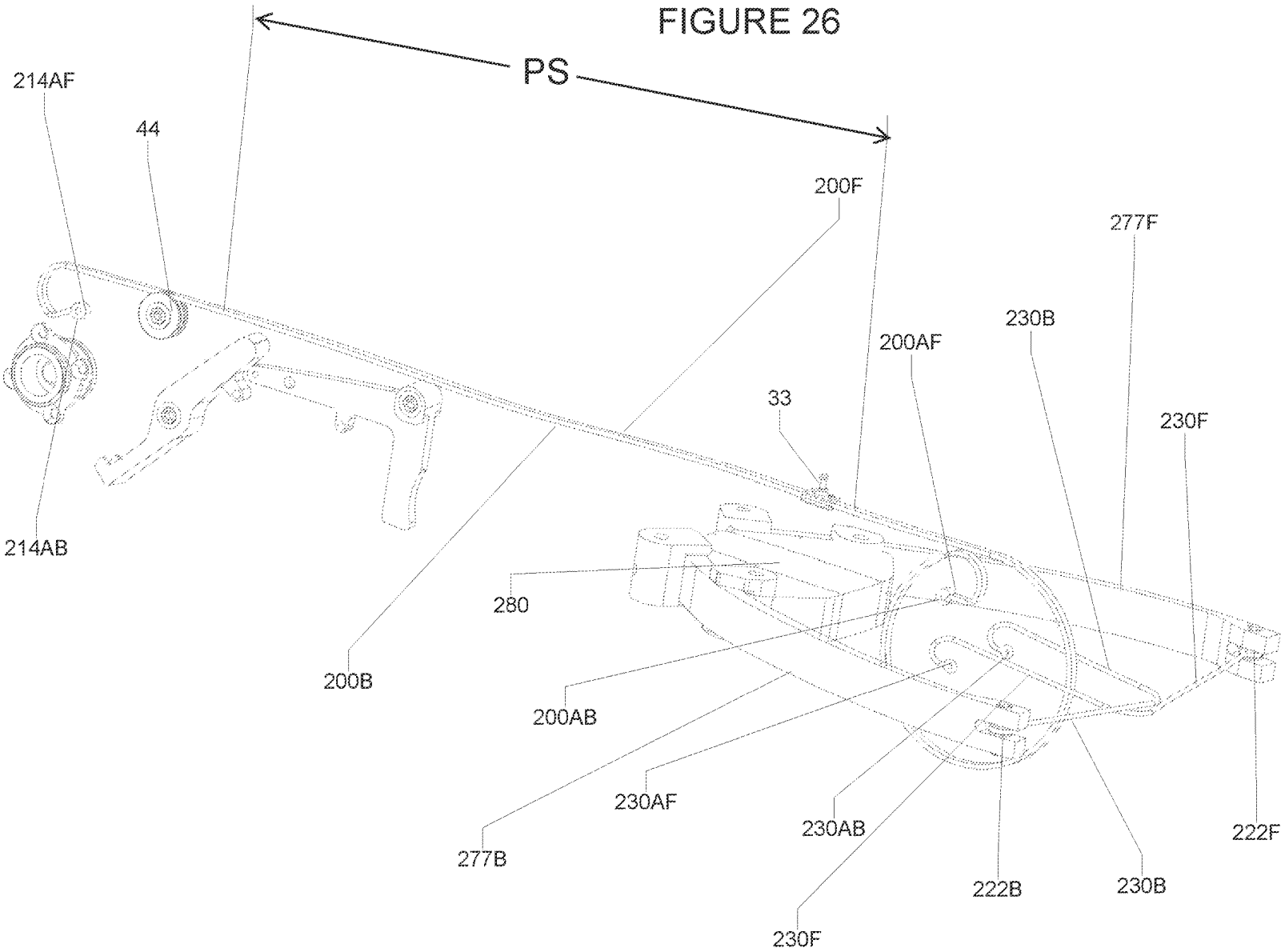
FIG. 26 is right side perspective view of the linear crossbow of FIG. 21 in the undrawn position showing the detailed string connection and routing.
Figure 27:
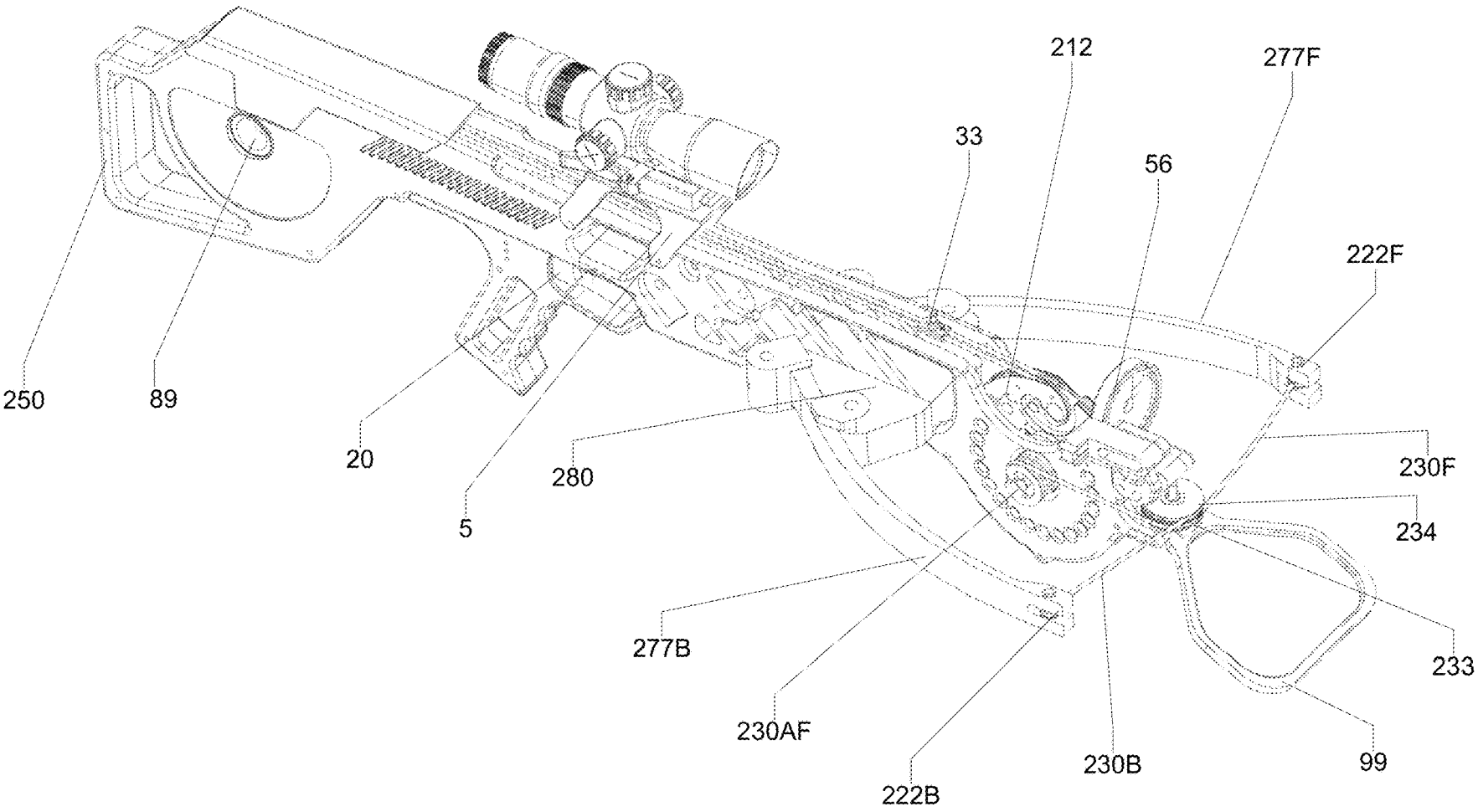
FIG. 27 is a right side perspective view of the linear crossbow of FIG. 21 in the undrawn position showing the complete crossbow.
Figure 28:
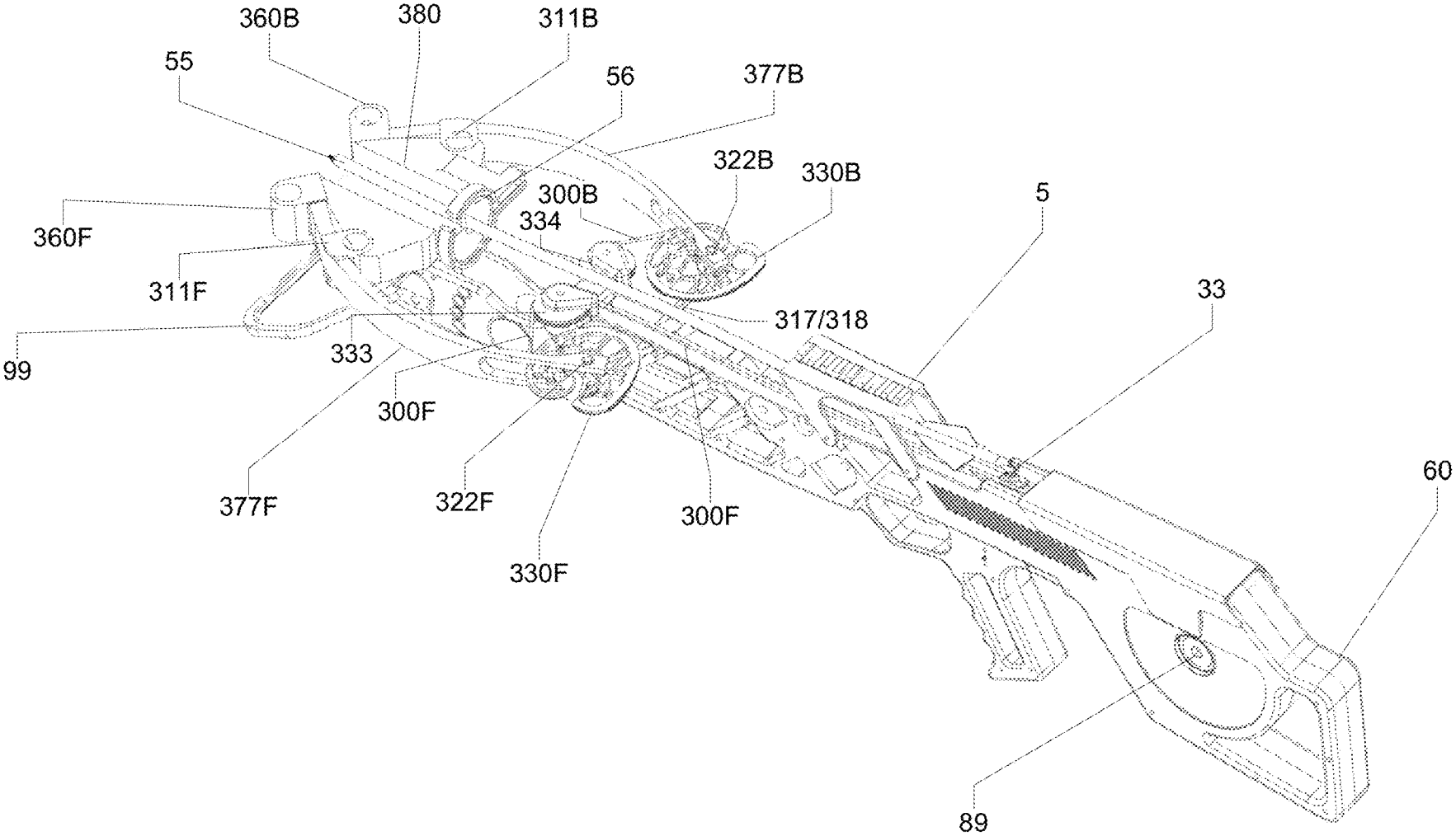
FIG. 28 is another linear crossbow with the limbs facing rearward with cams distally mounting and limb to limb power cables left side perspective view.
Figure 29:
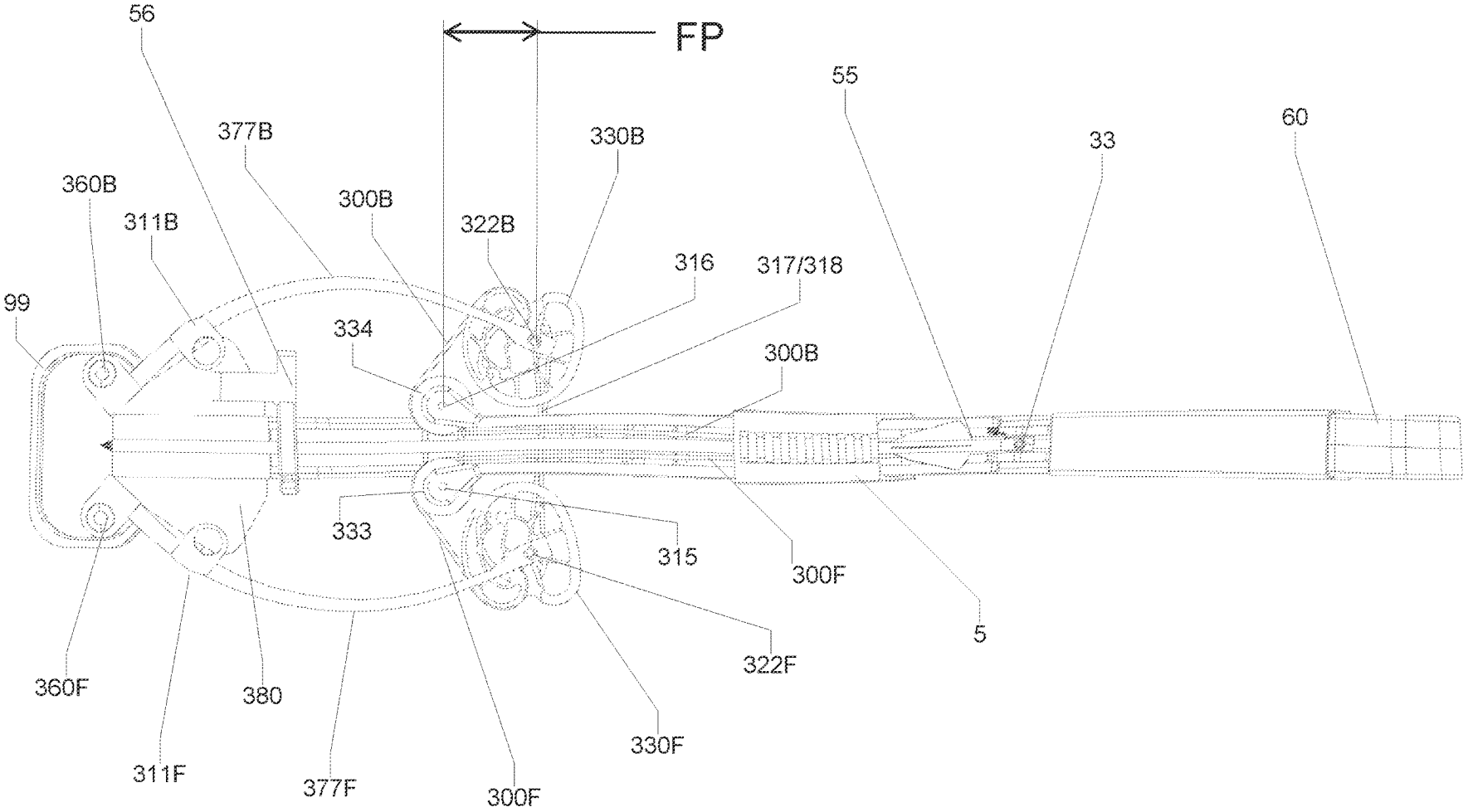
FIG. 29 is a top view of the linear crossbow of FIG. 28 in the draw position.
Figure 30:
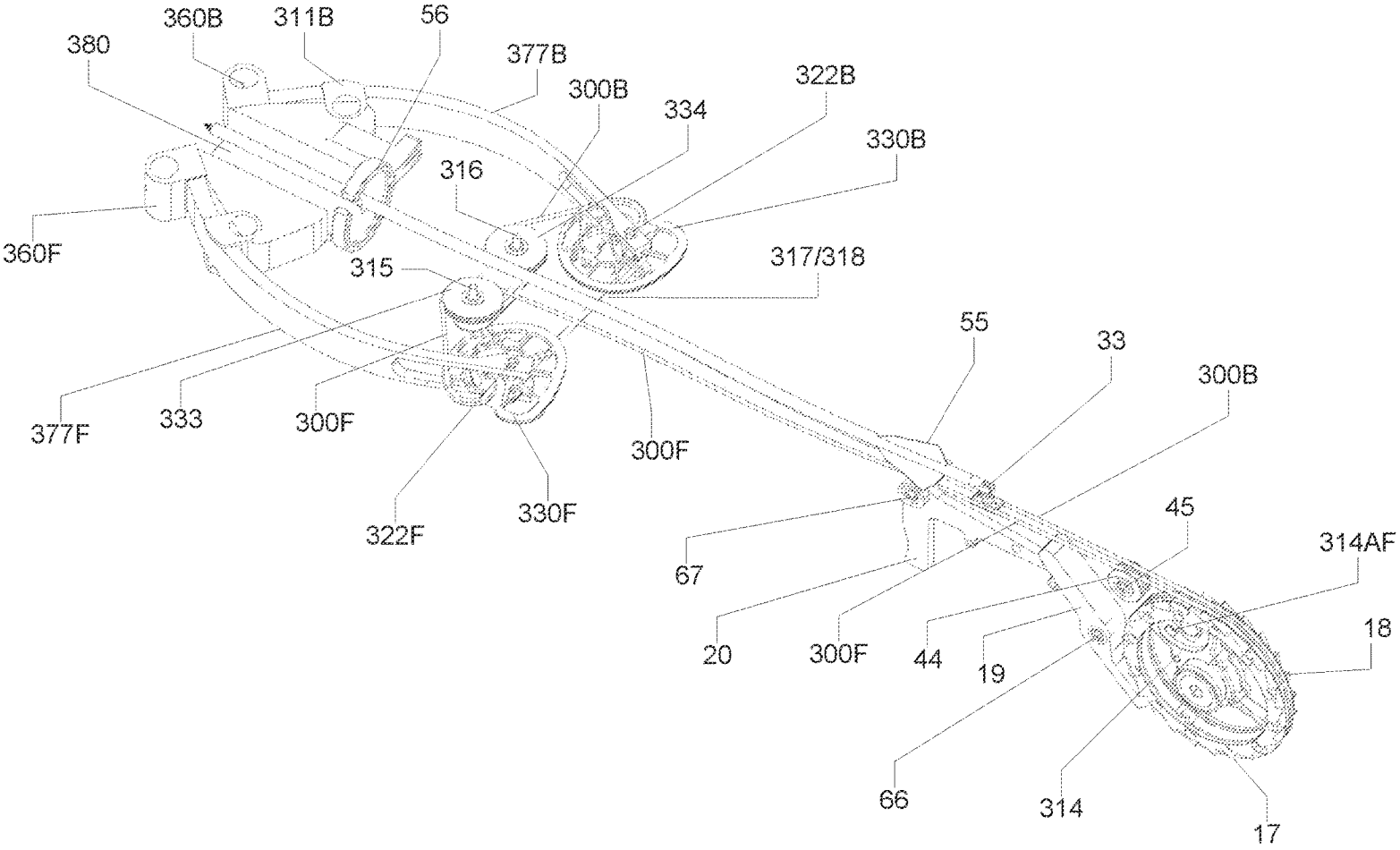
FIG. 30 is a left side perspective view of the linear crossbow of FIG. 28 detailing the internal components and string connections.
Figure 31:
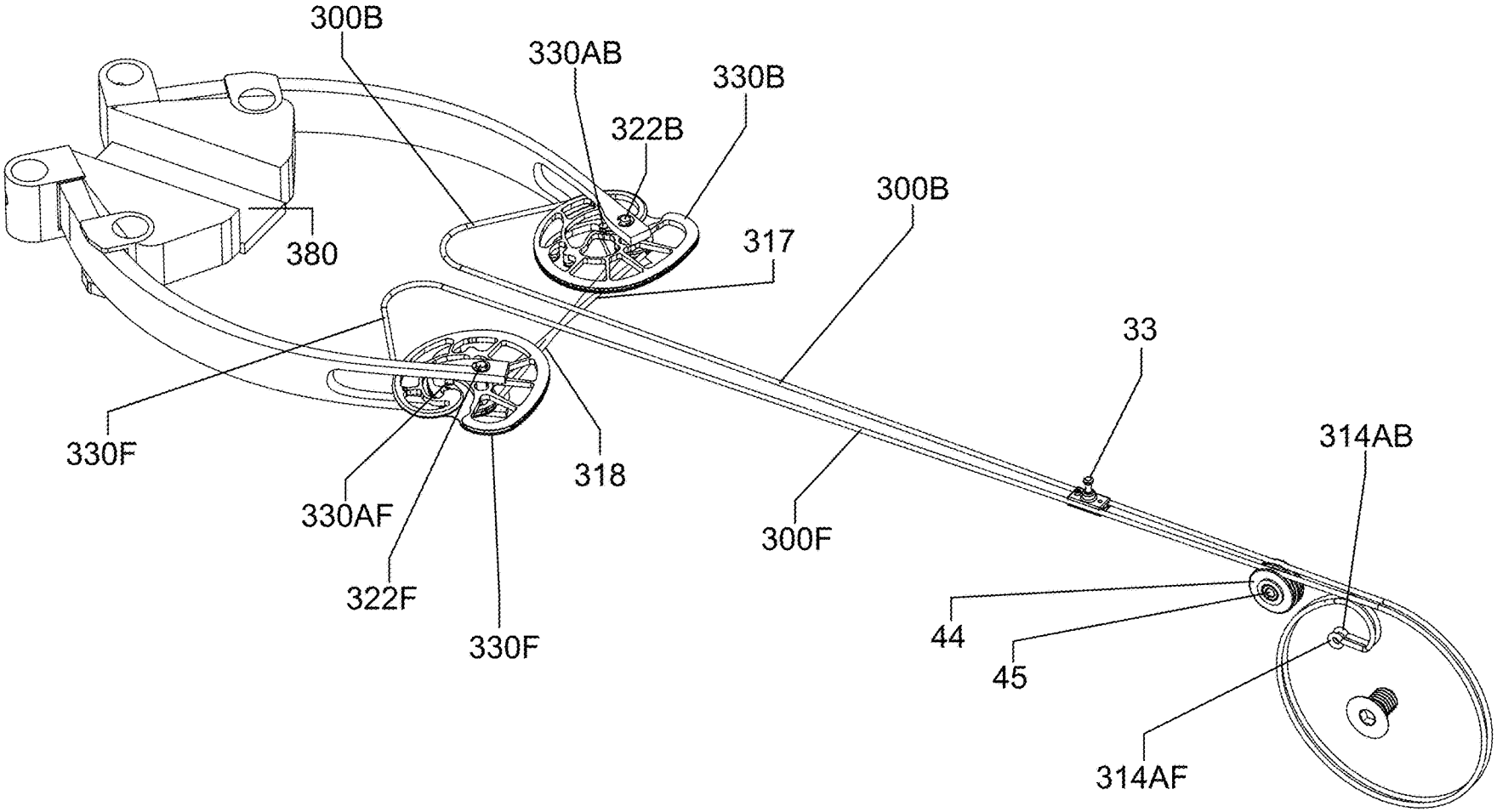
FIG. 31 is a left side perspective view of the linear crossbow of FIG. 28 in the drawn position further detailing the string routing and connection points.
Figure 32:
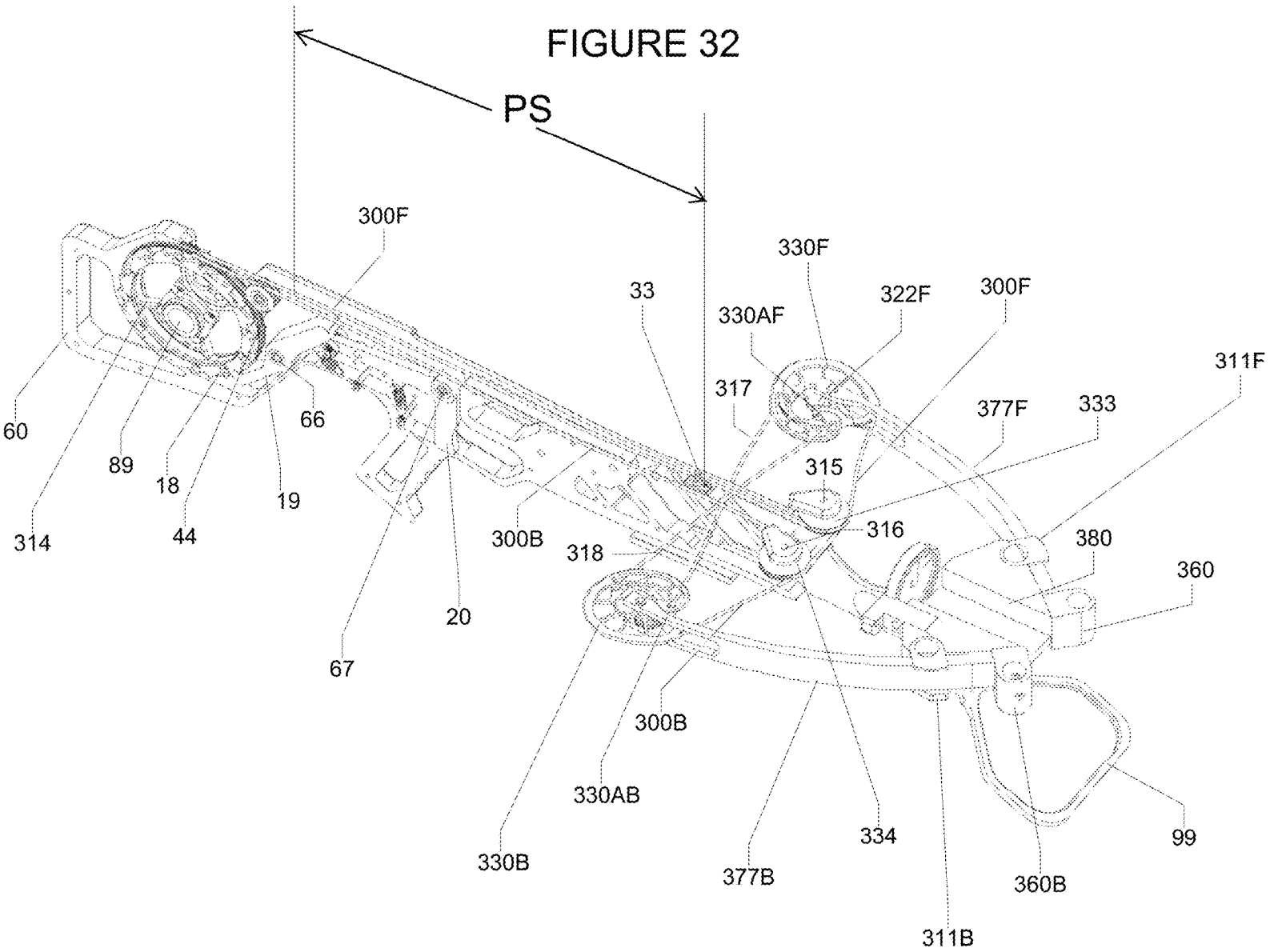
FIG. 32 is a right side perspective view of the linear crossbow of FIG. 28 in the undrawn position and exposing some internal parts and details.
Figure 33:
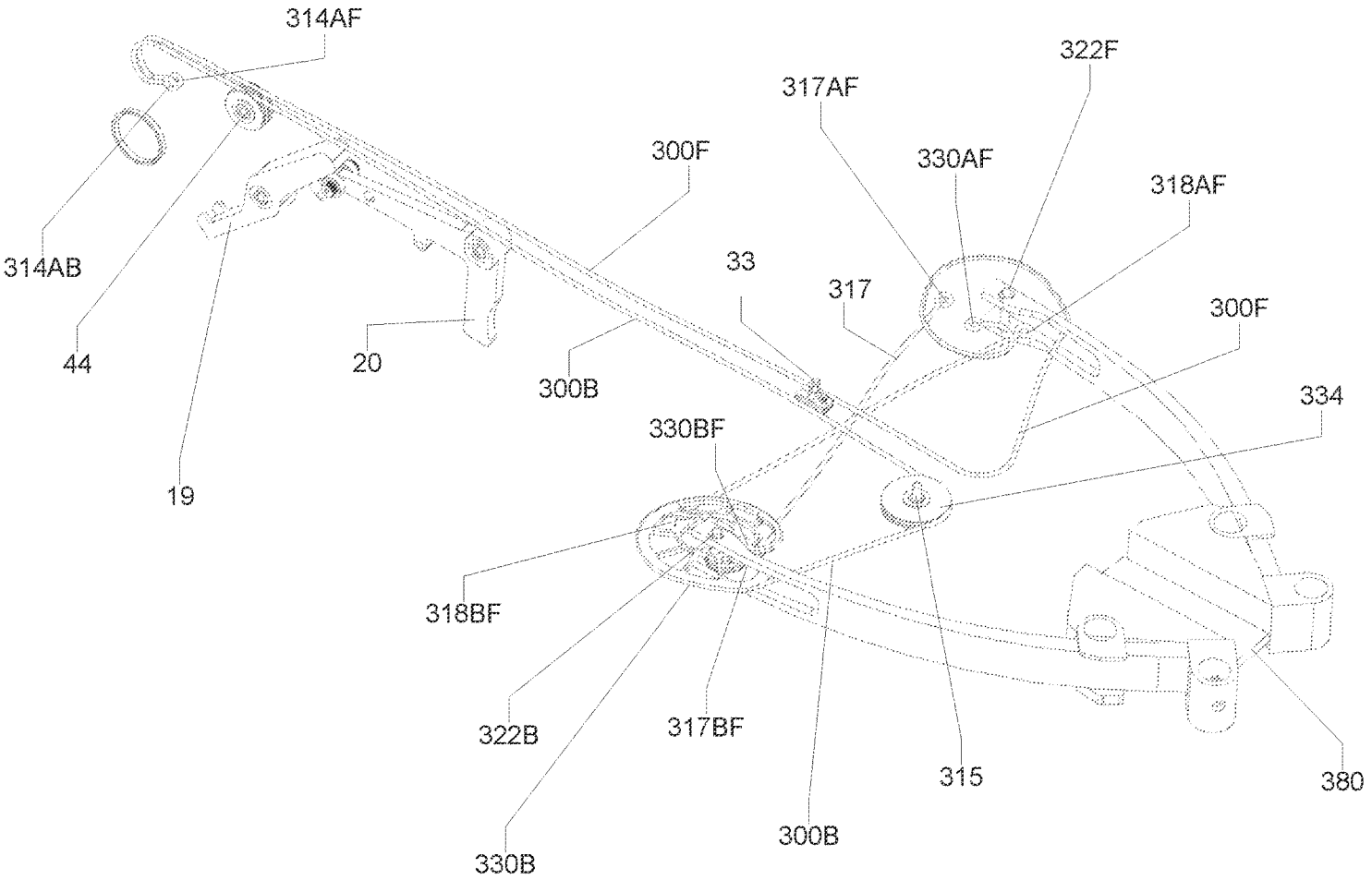
FIG. 33 is a right side perspective view of the linear crossbow of FIG. 28 in the undrawn position detailing the string routing and connections.
Figure 34:
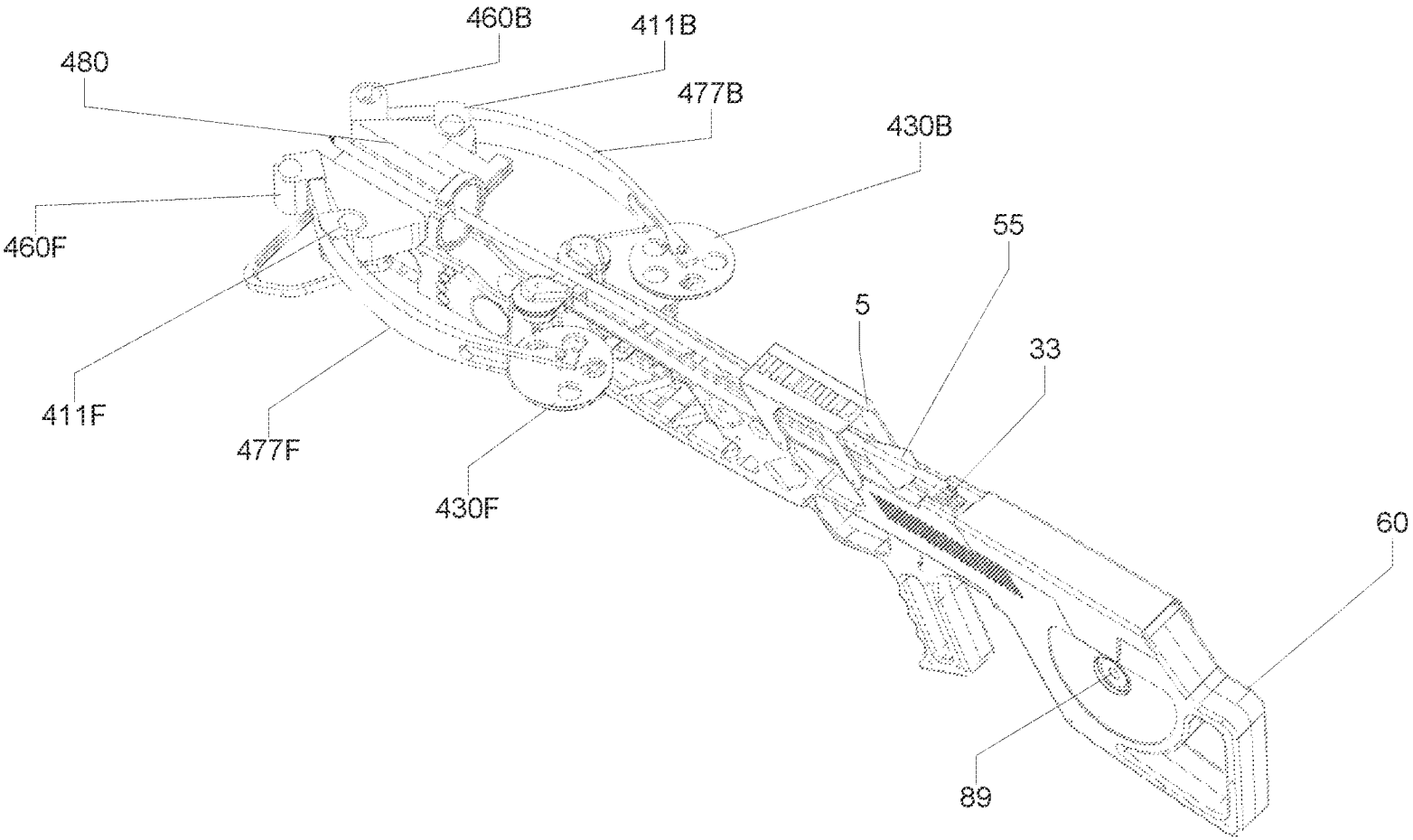
FIG. 34 is another linear crossbow with the limbs facing rearward and the cams distally mounted to the limbs and the power cables centrally connected in the drawn position.
Figure 35:
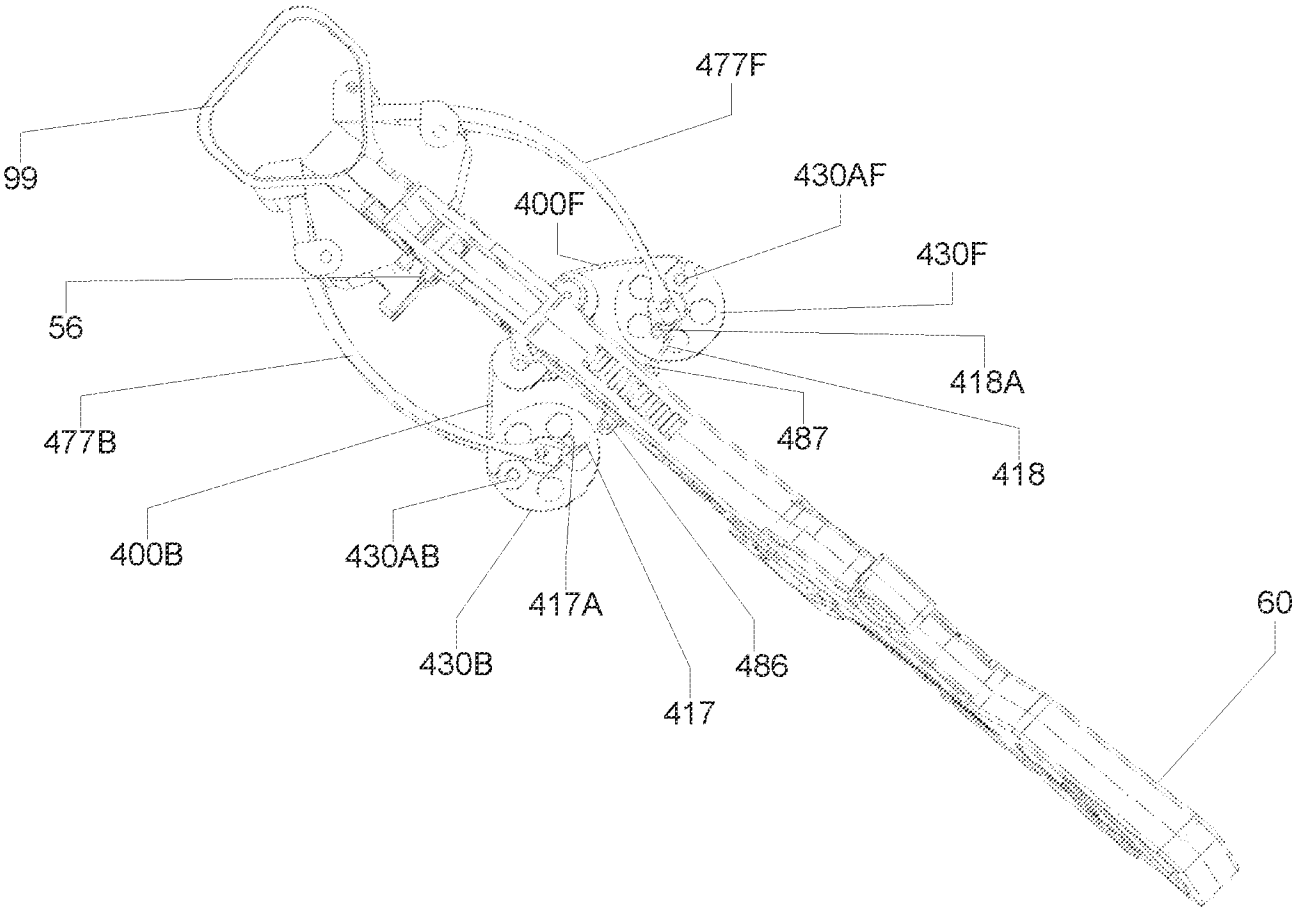
FIG. 35 is a left side perspective view of the linear crossbow of FIG. 34.
Figure 36:
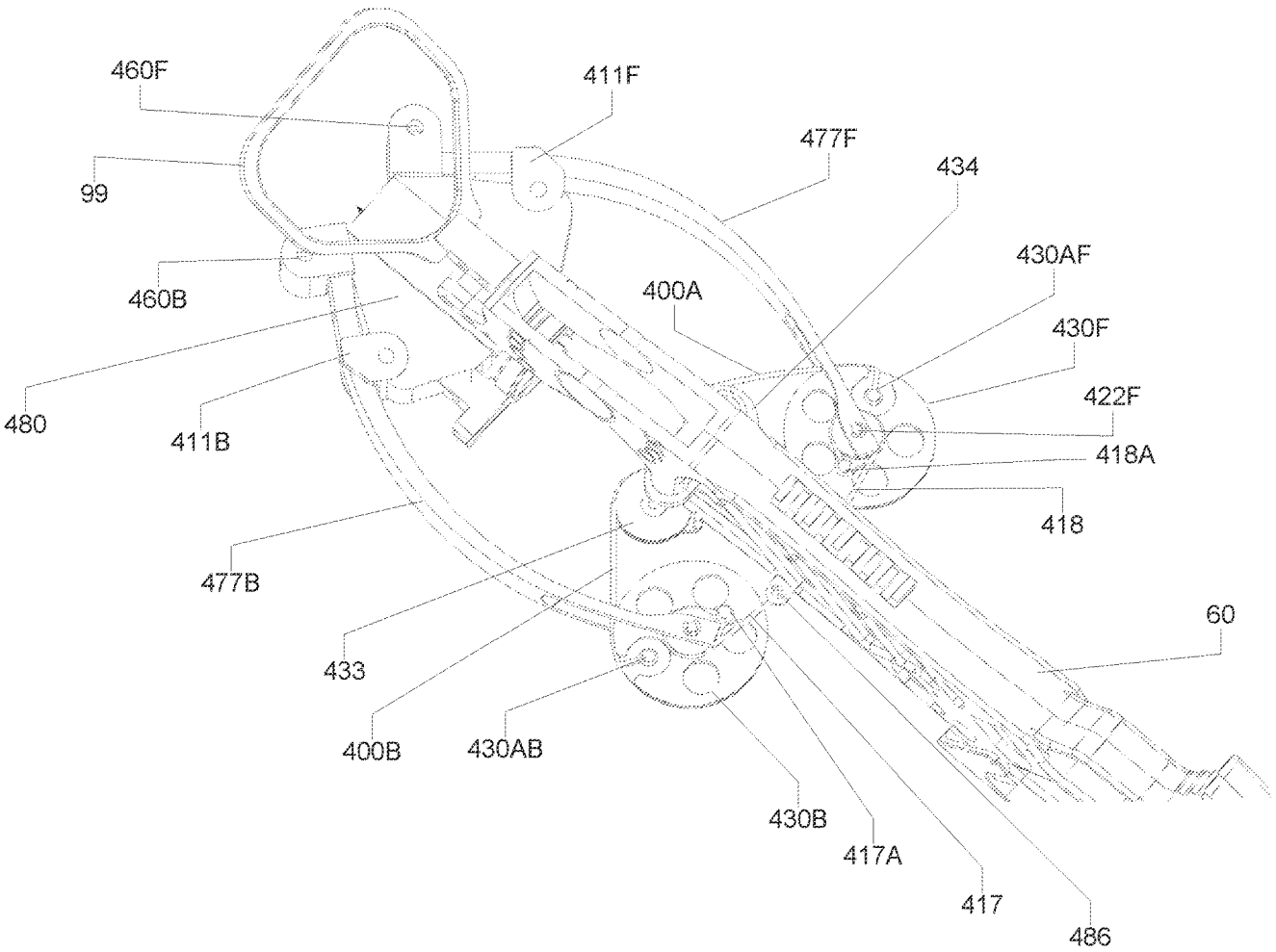
FIG. 36 is a bottom side perspective view of the linear crossbow of FIG. 34 details the cam connection and string routing.
Figure 37:
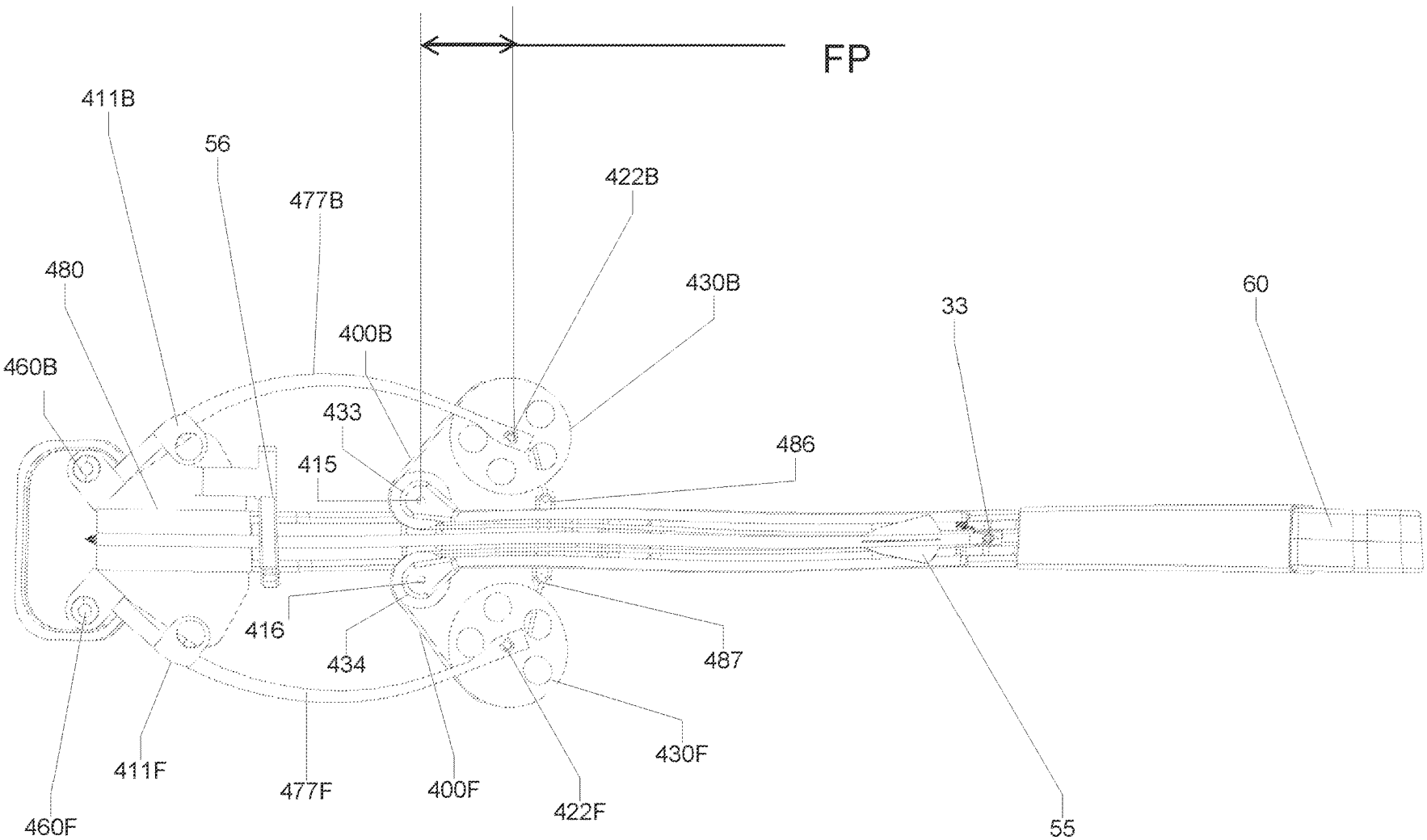
FIG. 37 is a top view of the linear crossbow of FIG. 34 in the draw position.
Figure 38:
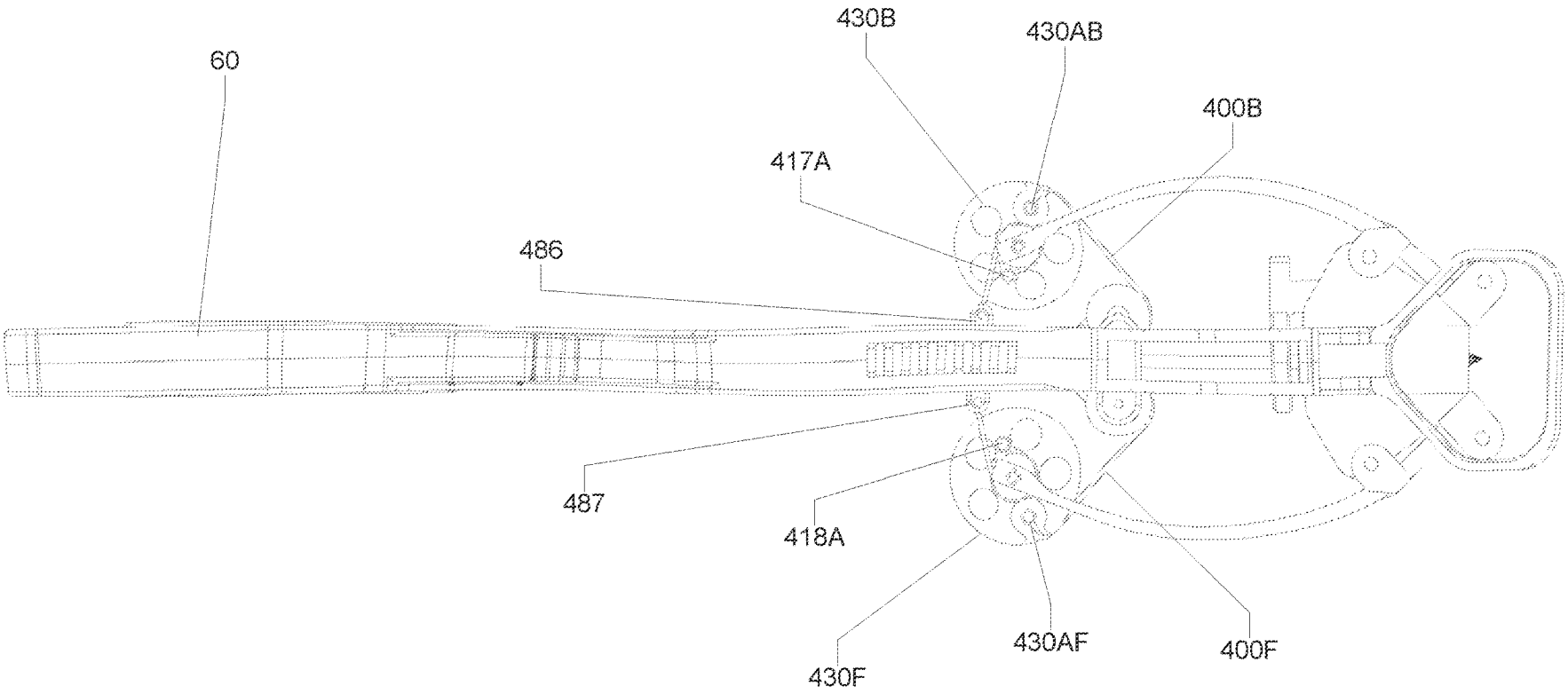
FIG. 38 is a bottom view of the linear crossbow of FIG. 34 in the drawn position.
Figure 39:
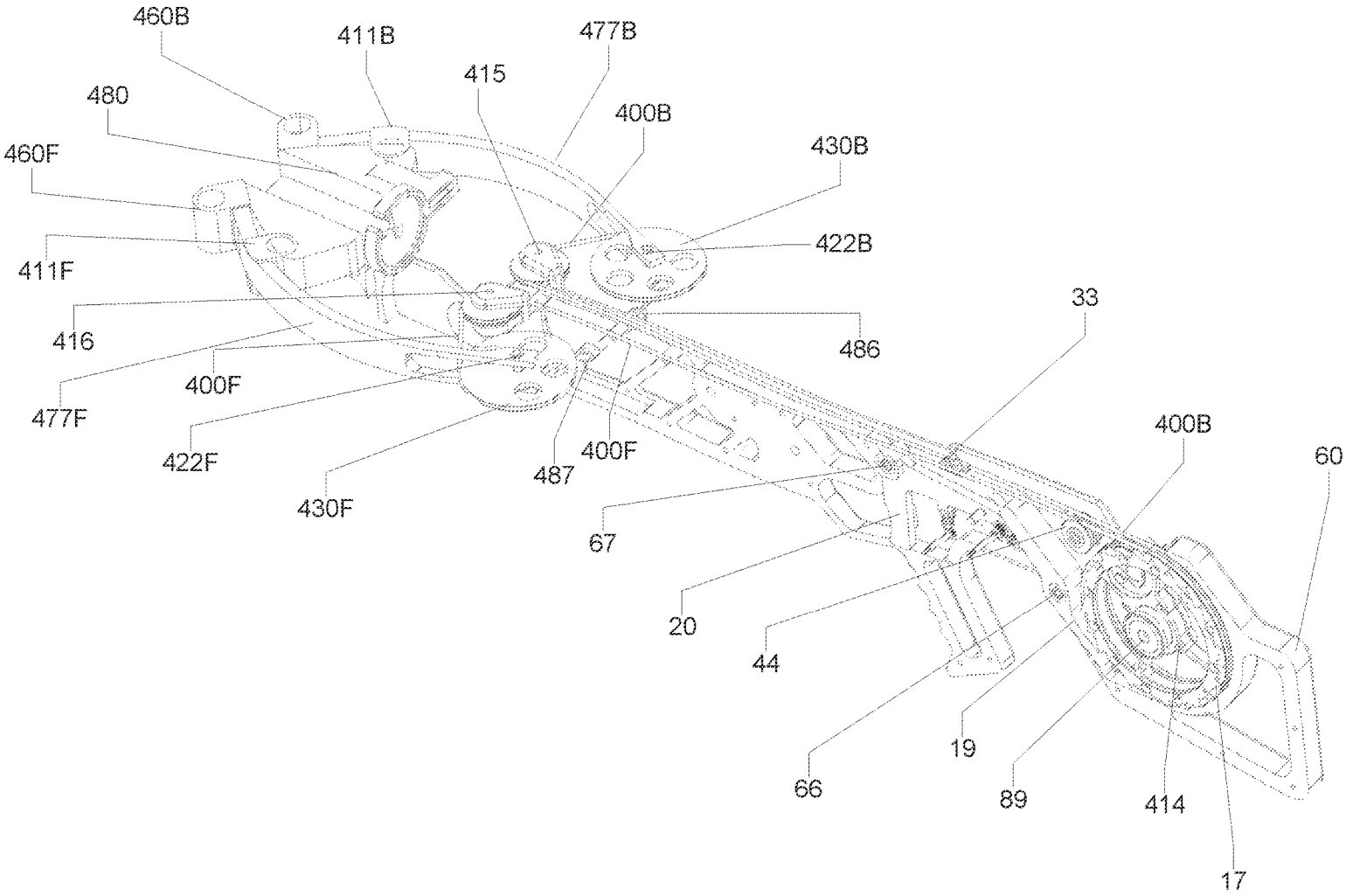
FIG. 39 is a left side perspective view of the linear crossbow of FIG. 34 in drawn position showing internal components.
Figure 40:
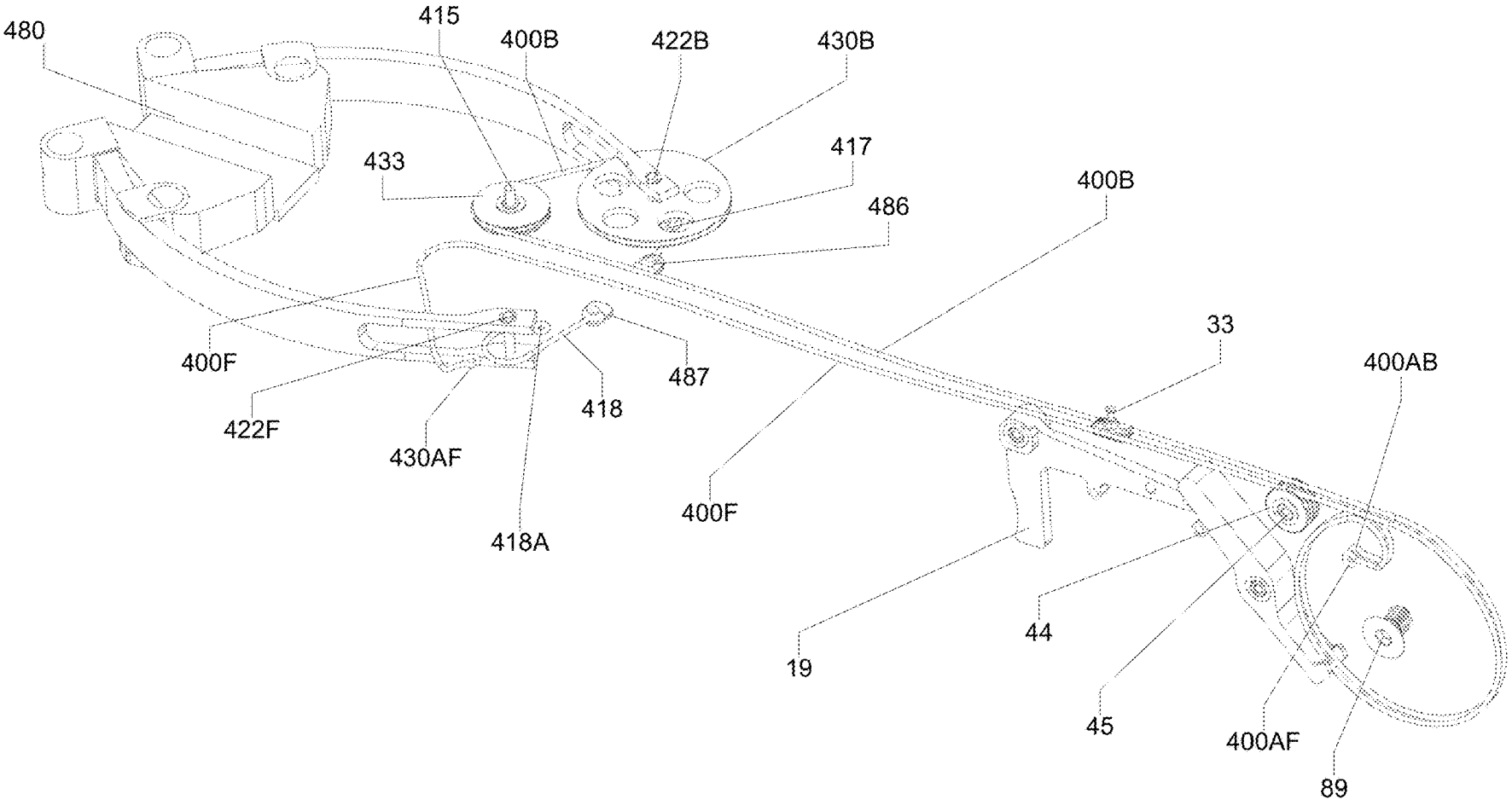
FIG. 40 is a left side perspective view of the linear crossbow of FIG. 34 in drawn position detailing the string routing and connection points.
Figure 41:
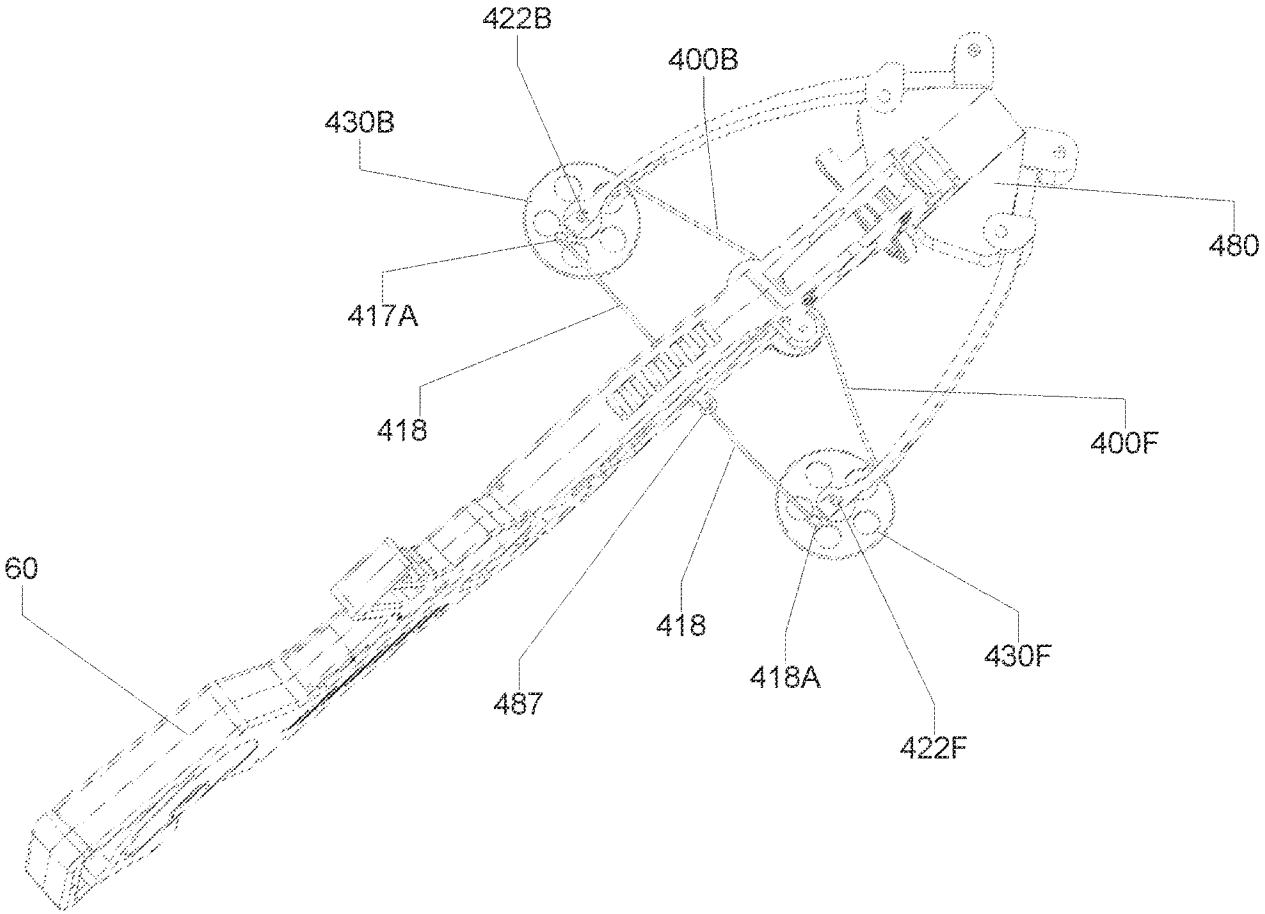
FIG. 41 is a perspective view of the linear crossbow of FIG. 34 in the undrawn position showing the bottom side.
Figure 42:
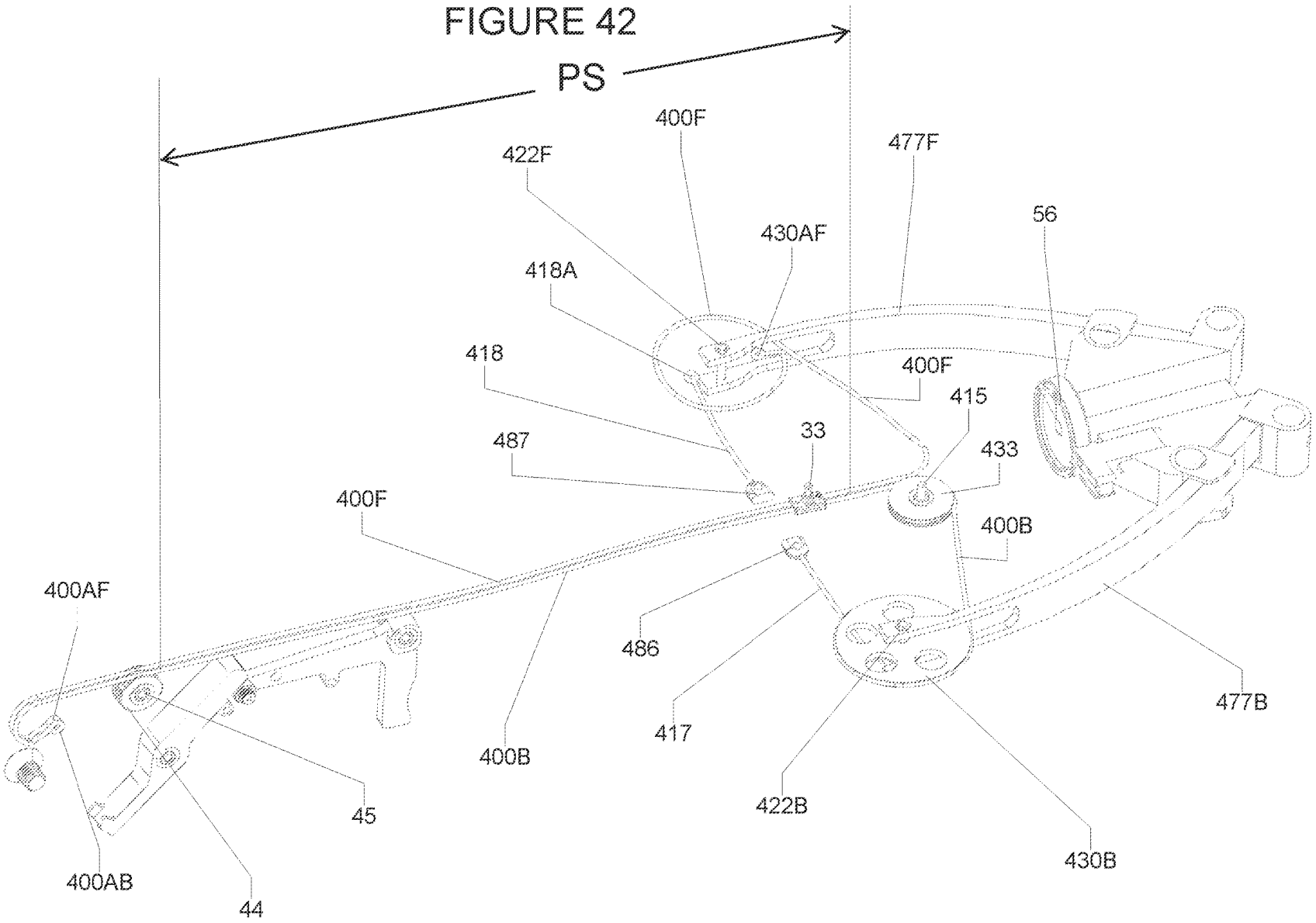
FIG. 42 is a perspective view of the linear crossbow of FIG. 34 in undrawn position detailing the string routing and connection points.

Furthermore, spiral tracks 202F and 202B are part of the forward string let out track assembly 212 which is rotatably mounted to the stock 250. The string let out track assembly 212 has draw strings 200F and 200B affixed at points 200AF and 200AB and in the undrawn state as shown in FIG. 26 are wrapped about the circumference and then directed to the stop pulley 44 then the rear draw string take up assembly 214 and attached to 214 at points 214AB and 214AF. The draw string 200F and 200B also have the arrow shuttle 33 attached such that during the drawing and undrawing the arrow shuttle 33 moves about 14 inches or the power stroke distance propelling the arrow. The rest of the function of this design has been described above.

The overall width of the linear crossbow described can have a width between 3 inches and 24 inches depending on the angle of the limbs, but preferable in the range of about 6 inches in undrawn position. The power stroke of this design would be in the range of 1 to 30 inches and preferably around 15 inches. The arrow shuttle 33 is affixed to draw strings 200F and 200B such that going from the undrawn to drawn position the arrow shuttle moves about 14 inches in the direction of arrow flight and remains attached and under tension. The operation of the described linear crossbow is nearly identical to the crossbow of section 2 other than the limb direction or orientation. The PS power stroke is shown in FIG. 26 and runs between the forward tracks of 212 and the rearward take up assembly 214 and can between 1 and 30 inches and preferably around 14 inches.

Section 4—Dual String Let Out Track with Dual Cams

Another configuration of the linear crossbow is shown in FIG. 28 through FIG. 33, and FIG. 69 reversed option. The linear crossbow uses a set of cams which are distally mounted to the free ends of the limbs, then are timed together to generate the power and let off means similar with compound crossbows used today. The biggest difference is that the draw string is two draw strings that are directed around pair of pulleys, then to the rear take up track assembly. The layout of the limbs and the additional guide pulleys and cams mounted to end of the limbs are the main difference from the linear crossbow shown in FIG. 1 thru 10. The limbs of this design could also have the limbs mount forward or rearward.

Furthermore, the designs of could use any number of currently available cam means or round cams with double Y yokes or any cam timing arrangement known in the prior art with or without let off. The details describe will focus primarily on the limbs, pulleys, cams and the rest will be understood to be similar or the same as the prior design described in Sections 1, 2, and 3.

The following details describe the design for this linear crossbow starting with the limbs. The limbs 377F and 377B which can either be single or split limbs design, also the limbs 377F and 377B are attached to a forward riser 380 section and are distally mounted from riser 380 and the riser 380 is affixed to stock 60. The limb 377F and 377B are affixed to riser 380 at point 360F and 360B. The limbs 377F and 377B are also supported over mid limb supports 311F and 311B to provide a moment for the limbs to flex over. The mid limb supports 311F and 311B are also affixed to the riser 380 as shown. The limbs 377F and 377B free ends have cams 330F and 330B that are rotatably mounted to the free limb ends at axles 322F and 322B. The current design shows a cam to cam power cable arrange with power cables 317 and 318 attached to corresponding take up and let out tracks from prior art known.

The power cables 317 and 318 maintain the timing and providing let off at the end of draw cycle. They are arranged in this design in what is known as a binary cam arrangement with 317 being attached to cam 330AF at point 317AF take up track and then to cam 330AB and attached at point 317BF to a let out track. Power cable 318 is attached to cam 330AF at point 318AF that is a let out track and the other end of 318 is attached to cam 330B at point 318BF which is a take up track.

Again, the timing portion is not critical with the linear crossbow since the draw strings 300F and 300B are drawn along a linear path from a single take up assembly 314. The power or bias the draw strings in this design is provided between the limbs and is commonly used in many crossbows. The cams 330F and 330B are biased to take up the draw strings 300F and 300B such that when rear take up assembly 314 is rotated or pulled the string track payout or unload to the 314 take up assembly but resist and create a draw force curve that builds the load and hold the force on the draw string 300A and 300F until they reach the end of the power stroke and then let out the load ready to fire position. Yet again, the type or style of the cam arrange can be any type used in prior art.

Furthermore, one main advantage is that the power cables 317 and 318 do not require that they are directed and are not in the arrow flight paths as with other crossbow on market thus reducing cable wear and improving safety and efficiency. They are freely floating below the draw strings 300F and 300B and do not interfere with the arrow 55 flight or arrow shuttle 33. The cams 330F and 330B both have string let out tracks and in the undrawn position have draw strings 300F and 300B that are wrapped around the circumference of the cam tracks and attach at point 330AF and 330AB and the draw strings are then directed to the two draw string guide pulleys 333 and 334.

Draw string guide pulleys 333 and 334 are rotatably mounted to stock 60 and freely rotate about axle 315 and 316 and these axles are rigidly mounted to the stock 60. The draw strings 300F and 300B are then directed to the stop pulley 44 and then onto the rear draw string take up assembly 314 and the draw strings are attached at point 314AB and 314AF. The rear take up assembly is rotatably mounted to the stock 60 with a set of bearing about an axles 89. The axle 89 also contains a mating point to accept a ratchet or handle crank 15.

The rest of the function of this design has been described above in Section 1, 2, and 3. The axle to axle width of the linear crossbow described can have a width between 5 inches and 24 inches depending on the angle of the limbs, but preferable in the range of about 8 inches in undrawn position. The power stroke PS of this design would be in the range of 1 to 30 inches and preferably around 15 inches. The arrow shuttle 33 is affixed to draw strings 300F and 300B such that going from the undrawn to drawn position the arrow shuttle moves about 14 inches in the direction of arrow flight and remains attached and draw strings 300A and 300B remain under tension. To increase the power stroke the size of cams can be larger or spiral wound or any other method of providing draw string. The distance FP of the fixed idlers pulleys 334 and 333 can be forward as shown or rearward of the cams 330B and 330F. The ideal position of the FP distance is plus or minus 6 inches of the cams and is shown at about 4 inches forward of the cams to maximize the power stroke PS.

The system can even use a single cam system known in vertical bows and an idler pulley. Any of the cam arrangement know in the art can be used, but simply taking the draw string and separating the draw string from a cam to cam connection but instead using a cam to pulley to rear take up system arrangement for the draw strings is the main design feature of the described linear crossbow.

Figure 69:
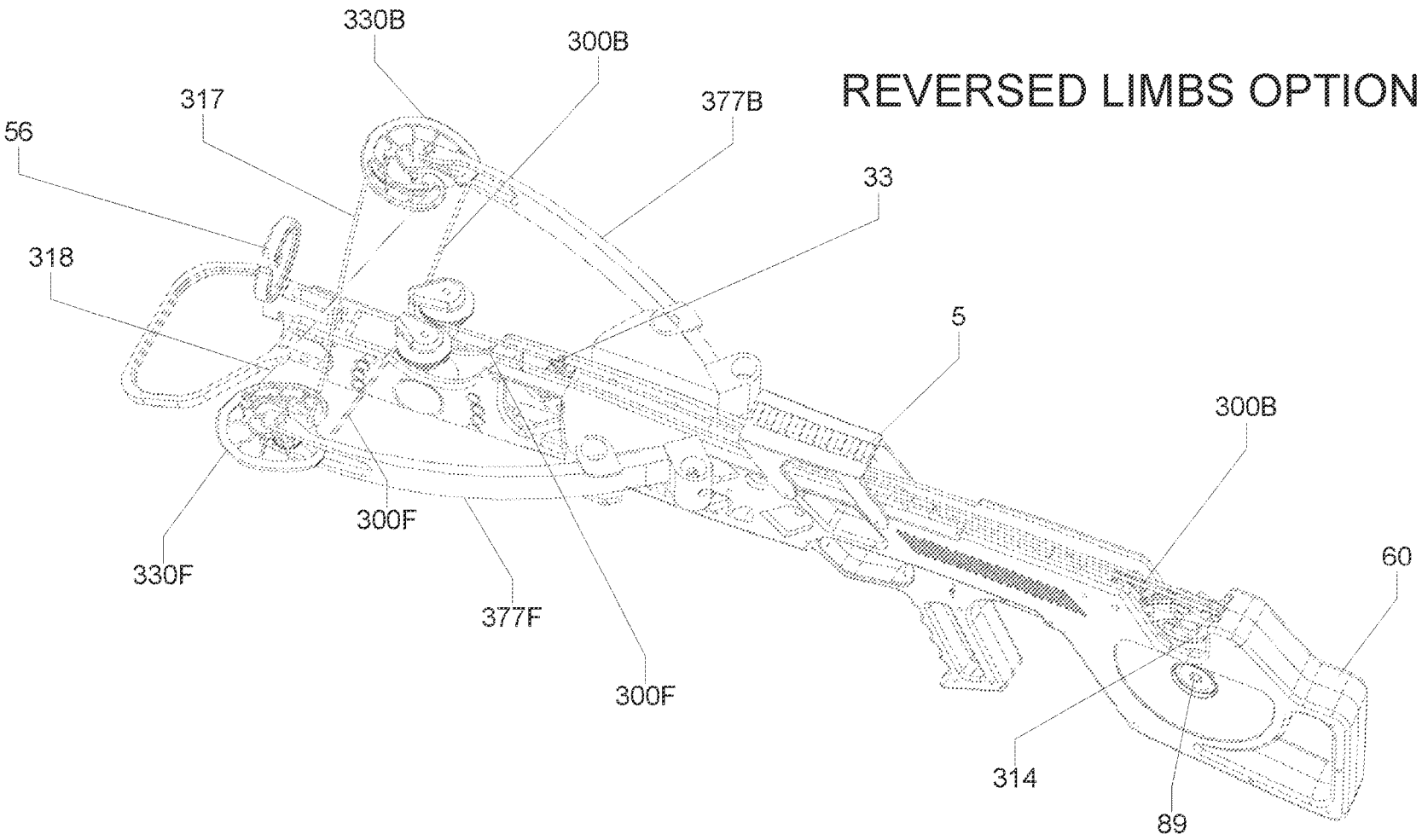
FIG. 69 is a left perspective view of the crossbow of FIG. 28 in the undrawn position with the limbs, cams, and idlers REVERSED to show the same design can be flipped if desired.

The draw strings 300F and 300B could be combined into one draw string after leaving the guide pulleys 333 and 334 and then directed to a single groove track on the rear take up assembly 314. The design of the linear crossbow is unaffected by cam lean since the draw string is guided and moves between to rotatably mounted point and is extremely accurate. Finally, the draw strings could come off the rear or forward side of the cams and the idler pulleys 315/316 could be forward or rearward of the cams, the method shown is the preferred method. Another variation of the crossbow is shown in FIG. 69 that show the limbs and cams reversed in the opposition direction. The design of FIG. 69 will pull more weight rearward and possibly balance better. The FIG. 69 uses like numbers the same as described above to allow someone to easily follow this design.

Section 5—Dual String Let Out with Center Mounted Power Cables

Another example configuration of the linear crossbow is shown in FIGS. 34 through 42, and FIG. 70 reverse option. The linear crossbow uses a set of cams which are distally mounted to the free ends of the limbs. The cams power cables are then directly mounted to the stock portion and independently operate.

The biggest difference is that the draw string is dual draw strings that are directed around pair of pulleys, then to the rear take up track assembly. The timing of the cams in the linear crossbow of FIGS. 34 to 42 are not an issue since the draw strings are pulled from the center from a single take up track assembly. The layout of the limbs and the additional guide pulleys and cams mounted to end of the limbs are the main difference from the linear crossbow shown in FIG. 1 thru 10. The limbs of this linear crossbow could also have the limbs mounted forward or rearward. Furthermore, the linear crossbow could use any number of currently available cam means or round cams known in the art with or without let off. The details described will focus primarily on the limbs, pulleys, cams and the rest will be understood to be similar or the same as the prior designs described in Section 1, 2, 3, and 4.

The following details describe the design for this linear crossbow starting with the limbs. The limbs 477F and 477B can either be single or split limbs design, also the limbs 477F and 477B are attached to a forward riser 480 section and are distally mounted from riser 480 and the riser 480 is affixed to stock 60. The limb 477F and 477B are affixed to riser 480 at point 460F and 460B. The limbs 477F and 477B are also supported over mid limb supports 411F and 411B to provide a moment for the limbs to flex over. The mid limb supports 411F and 411B are also affixed to the riser 480 as shown. The limbs 477F and 477B free ends have cams 430F and 430B that are rotatably mounted to the free limb ends at axles 422F and 422B.

The current design shows a cam to stock connection of power cables arranged with power cables 417 and 418 attached to corresponding take up power tracks on cams 430F and 430B and the other end attached to the stock at point 486 and 487. The power cables 417 and 418 take up power cable during draw cycle and bias the draw string to the undrawn state while flexing the limbs 477F and 477B creating a draw force curve to propel the arrow 55. The power cable 417 has one end attached to the power cable take up track of cam 430B and is attached at point 417A with the other end of 417 is attached at point 486 that is attached to the stock 60. The other power cable 418 has one end attached to the power cable take up track of cam 430F and is attached at point 418A with the other end of 418 attached at point 487 that is attached to the stock 60. Again, the timing portion is not critical with this linear crossbow since the draw strings 400B and 400F are drawn along a linear path from a single take up string assembly 414.

The power or bias to the draw strings in this design is provided between the limbs and riser and is commonly used in crossbows. Furthermore, one main advantage is that the power cables 417 and 418 are not in the arrow flight paths as with other crossbows on market thus reducing cable wear and improving safety and efficiency. The cams 430F and 430B both have string let out tracks and in the undrawn position have draw strings attached at point 400AF and 400AB then 400F and 400B are wrapped around the circumference of the cam string tracks and the draw strings are then directed to the two draw string guide pulleys 433 and 434. Draw string guide pulleys 433 and 434 are rotatably mounted to stock 60 and freely rotate about axle 415 and 416 and the axles are rigidly mounted to the stock 60.

The draw strings 400F and 400B are then directed to the stop pulley 44 and then onto the rear draw string take up assembly 414. The stop pulley is rotatably mounted to the stock with axle 45 and spins freely. The draw strings 400F and 400B are attached to the rear take up assembly at point 400AB and 400AF. During the drawing and undrawing of the linear crossbow the arrow shuttle 33 move along a linear path or the power stroke of the linear crossbow which is about 14 inches. Furthermore, the draw strings 400B and 400F are biased to remains loaded on the string let out track but payout the retained draw string to the rear take up assembly 414 when the assembly is ratcheted using a ratchet or handle crank 15 to take up the string until the majority of the draw string moves to the take up assembly.

During the shooting or undrawing of the linear crossbow the draw strings are quickly unloaded from the take up assembly to the let out assembly moving the arrow shuttle 33 and propelling the arrow 55. The process repeats while the linear crossbow is loaded, cocked, and fired. The rest of the function of this design has been described above in Section 1, 2, 3, and 4.

The axle to axle width of the linear crossbow described can have a width between 5 inches and 24 inches depending on the angle of the limbs, but preferable in the range of about 7 inches in undrawn position. The power stroke PS of this design would be in the range of 1 to 30 inches and preferably around 15 inches. The arrow shuttle 33 is affixed to draw strings 400F and 400B such that going from the undrawn to drawn position the arrow shuttle moves about 15 inches in the direction of arrow flight and remains attached and under tension. The position of the idler roller guide pulleys 433 and 434 are shown forward of the cams 430F and 430B and denoted as distance FP and is in the range of plus or minus 6 inches either forward or behind the cams. The FP distance shown is about 4 inches forward and is positioned to maximize the power stroke PS. The further forward the idler guide pulleys 433 and 434 are the more compact the linear crossbow can be made.

To increase the power stroke the size of cams can be larger or spiral wound or any other method of providing draw string. Any of the cam arrangements known in the prior art can be used, but simply taking the draw string and separating the draw string from a cam to cam but instead to a cam to pulley to rear take up system for both cams is the main unique technique of the described embodiment. The draw strings 400F and 400B could be combined into one draw string after leaving the guide pulleys 433 and 434 and then directed to a single groove track on the rear take up assembly 414 and the arrow shuttle could be attached to a single draw string but may require some guiding.

The example described above is the preferred method of operation. Also, the draw strings 400F and 400B can come off the forward part of the cams 430B and 430F as shown or the back side of the cams towards the buttstock. The ideal location for the most compact and efficient operation is shown forward of the cams for 433 and 434 idlers. The details of the linear crossbow shown in FIG. 70 are the same as the above described but as shown in detail the limbs and cams are reversed and the limbs are pointing in the forward direction. The design of FIG. 70 would shift more weight rearward and possibly balance better than the design described above. The numerals are the same as those used to describe the normal and reverse design in FIG. 70 to allow the reader to easily follow the differences in the two design.

Section 6—Scope Sight Mount that Spans the Stock Side to Side

Another key feature of all the linear crossbows described thus far described is the ability to position the scope rail anywhere along the linear path of the stock or along the power stroke. We will use FIGS. 43 to 49 to describe this feature in more detail.

Historically crossbow sights on prior art are cantilevered from behind the string latch forward. This cantilevered sight/scope rail is easily misaligned or moved when the crossbow is accidentally bumped or jarred. Some crossbows have incorporated dual mounted scope sight rails mounting them at the string latch and at a forward position in front of the perpendicular draw string at rest location. The reason that all current crossbows use this method of mounting the scope sight rails is that the draw string will clearly intersect or interfere with the traversing draw string requiring the sides of the stock barrel to be free and clear of any mount.

Figure 43:
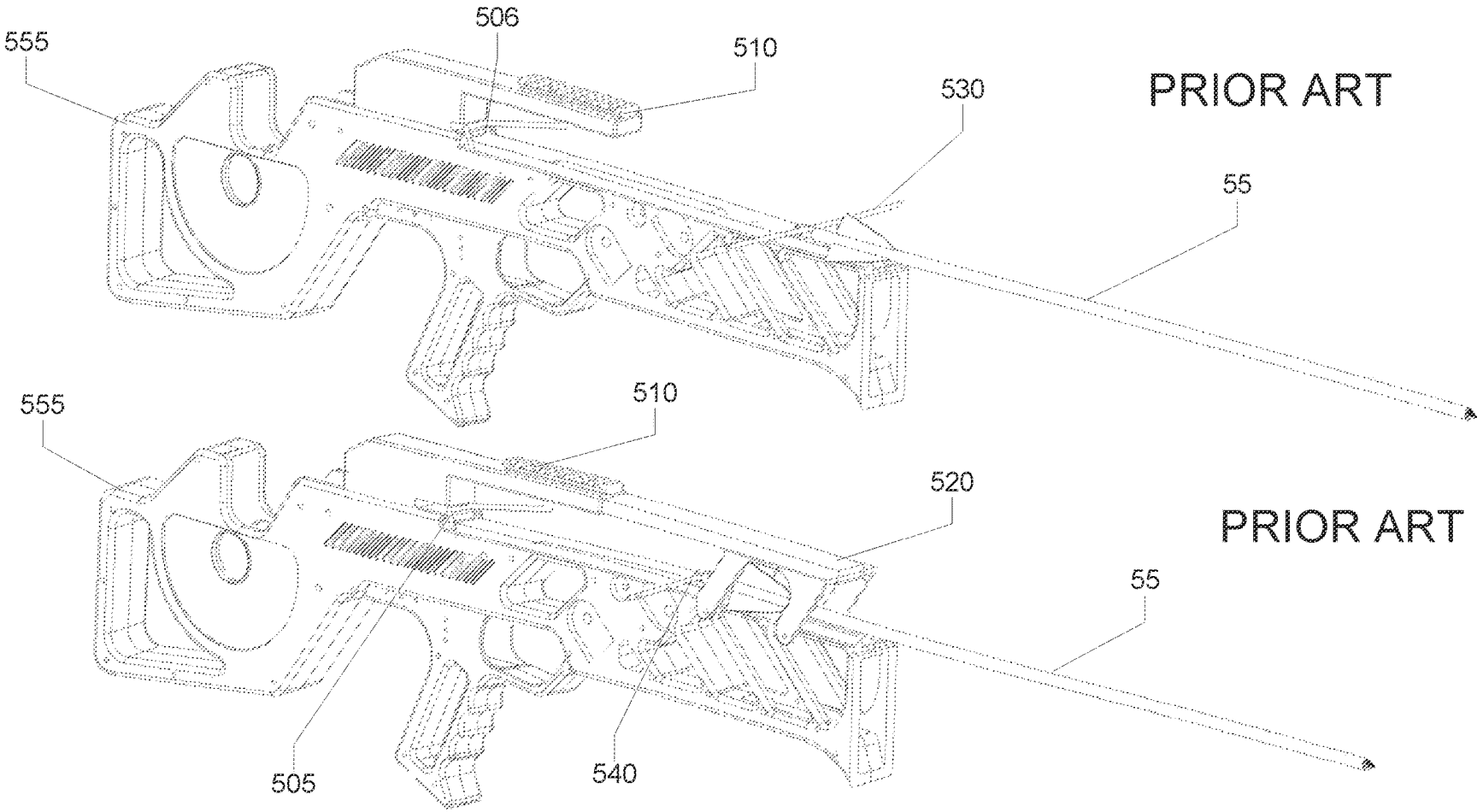
FIG. 43 is a perspective view of PRIOR ART showing how scope mounts are currently used in two methods.
Figure 44:
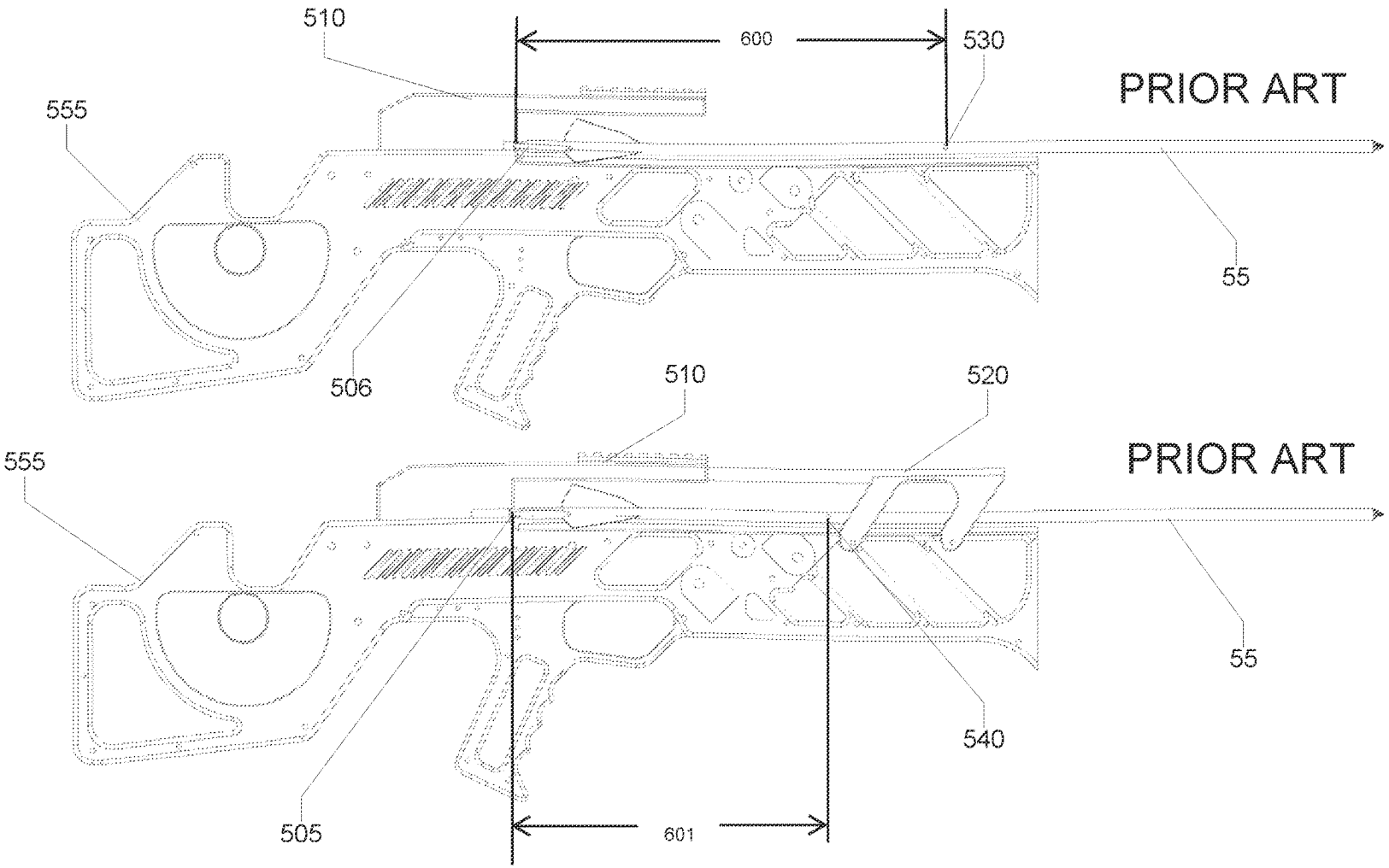
FIG. 44 is a right side view of PRIOR ART showing the scope mounts must be clear of the draw string path.
Figure 45:
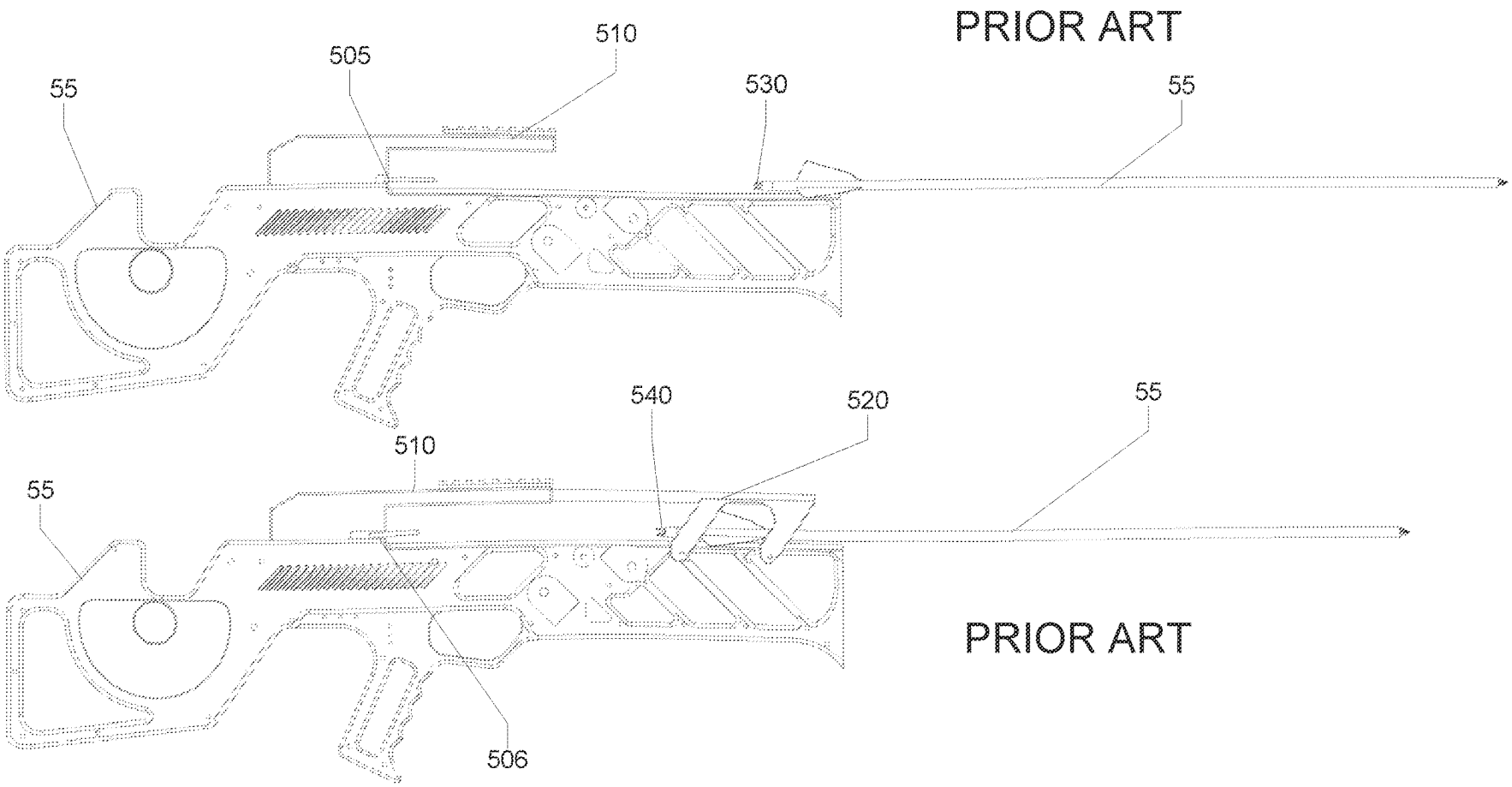
FIG. 45 is a right side view of PRIOR ART showing the scope mounts and arrow path.
Figure 46:
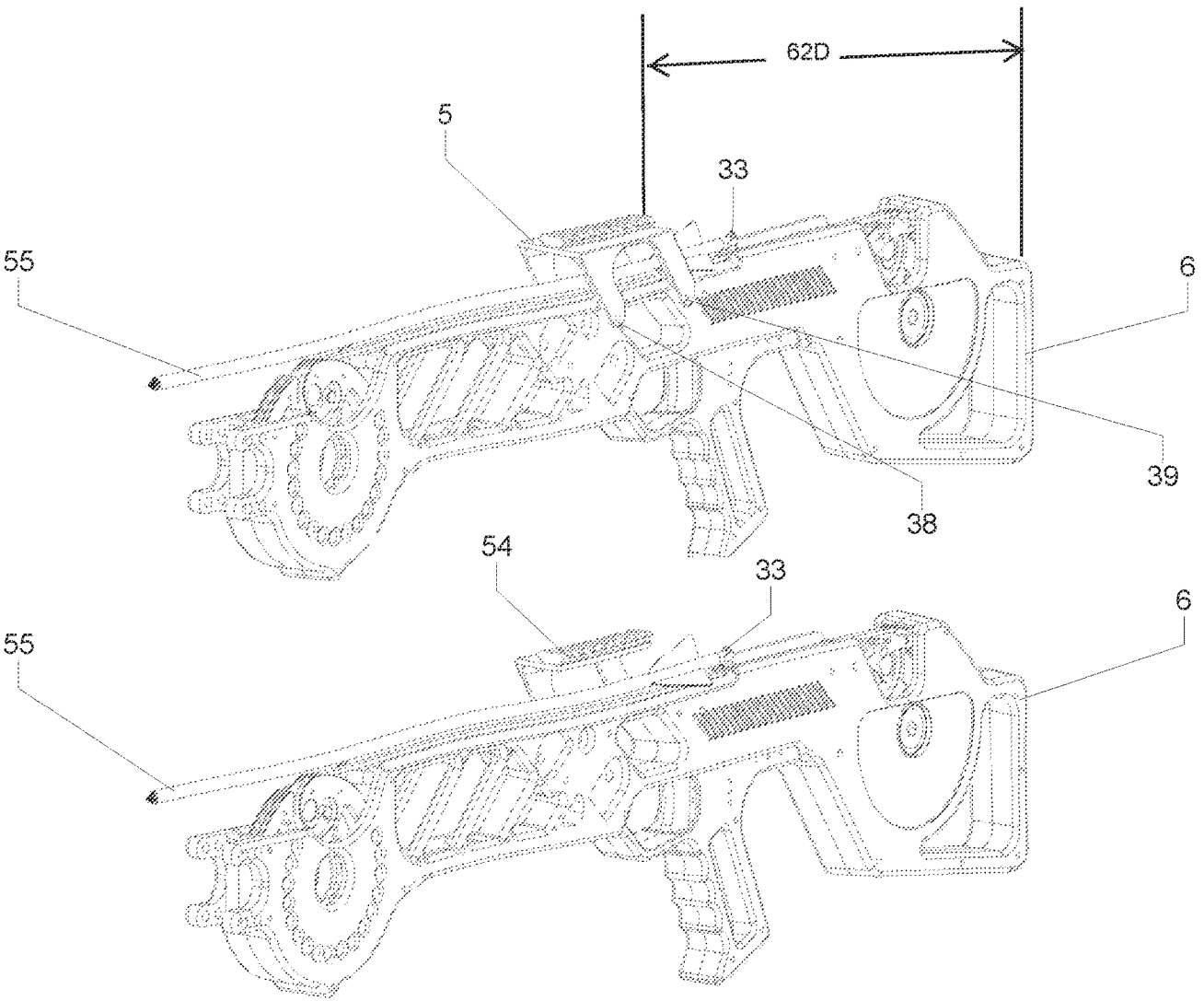
FIG. 46 is a left side perspective view showing details of the scope rail mount that is side mounted along the flight path and does not interfere with the arrow or draw string.
Figure 47:
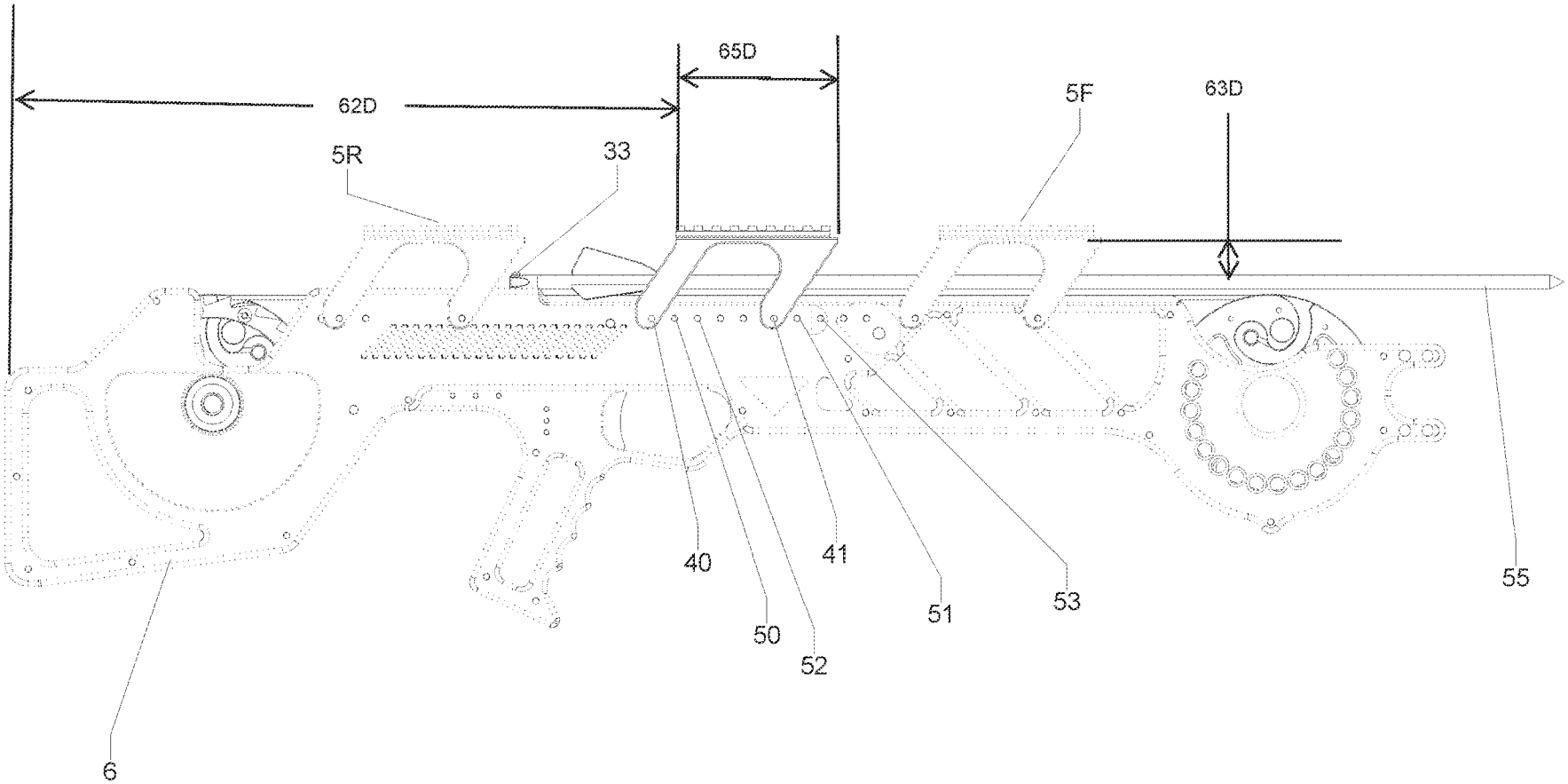
FIG. 47 is a right side view of the scope rail setup of FIG. 46 detailing the scope mount setup in multiple positions and some detailed dimensions.
Figure 48:
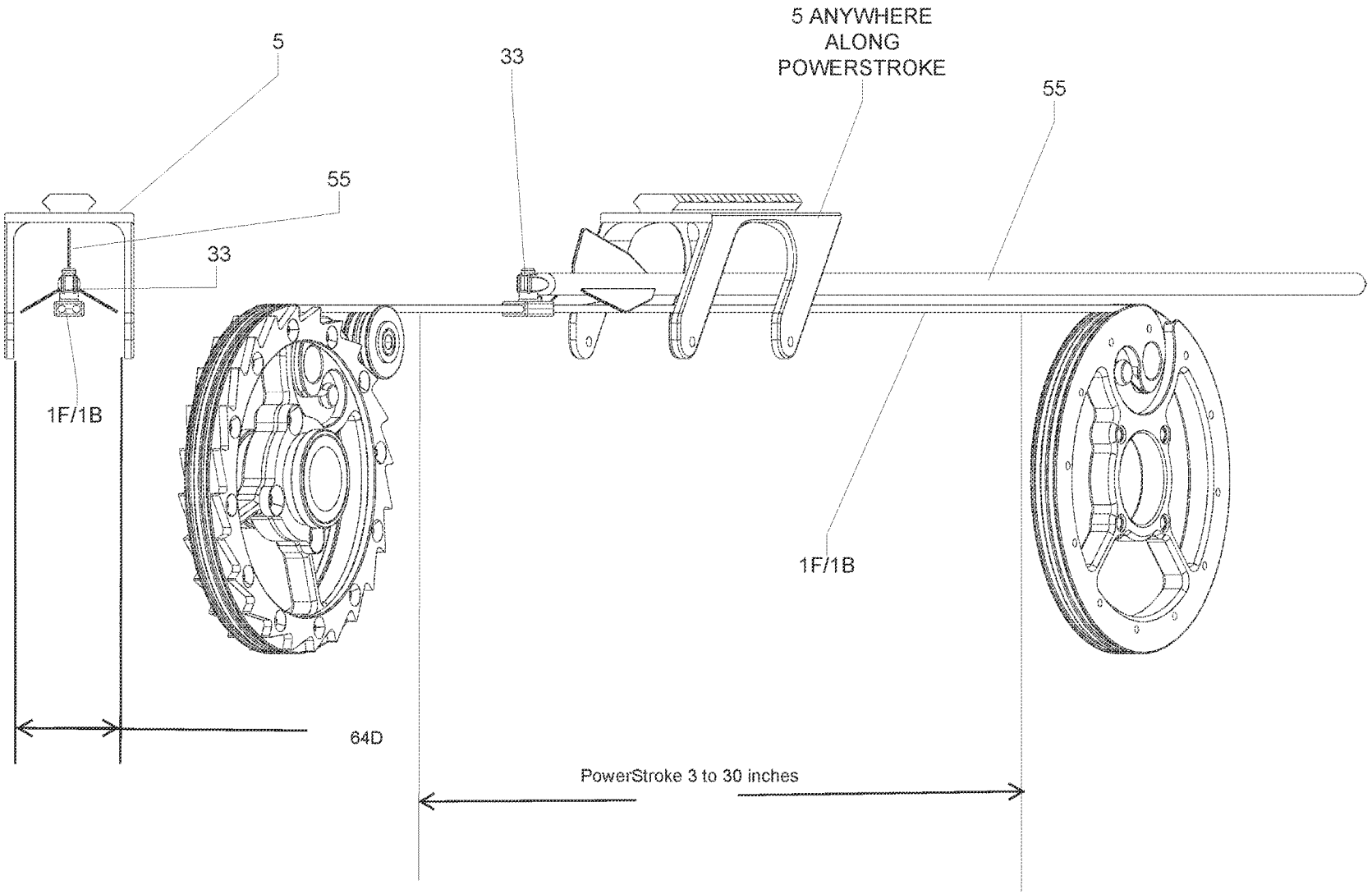
FIG. 48 is a perspective view of the scope mount setup of FIG. 46.
Figure 49:
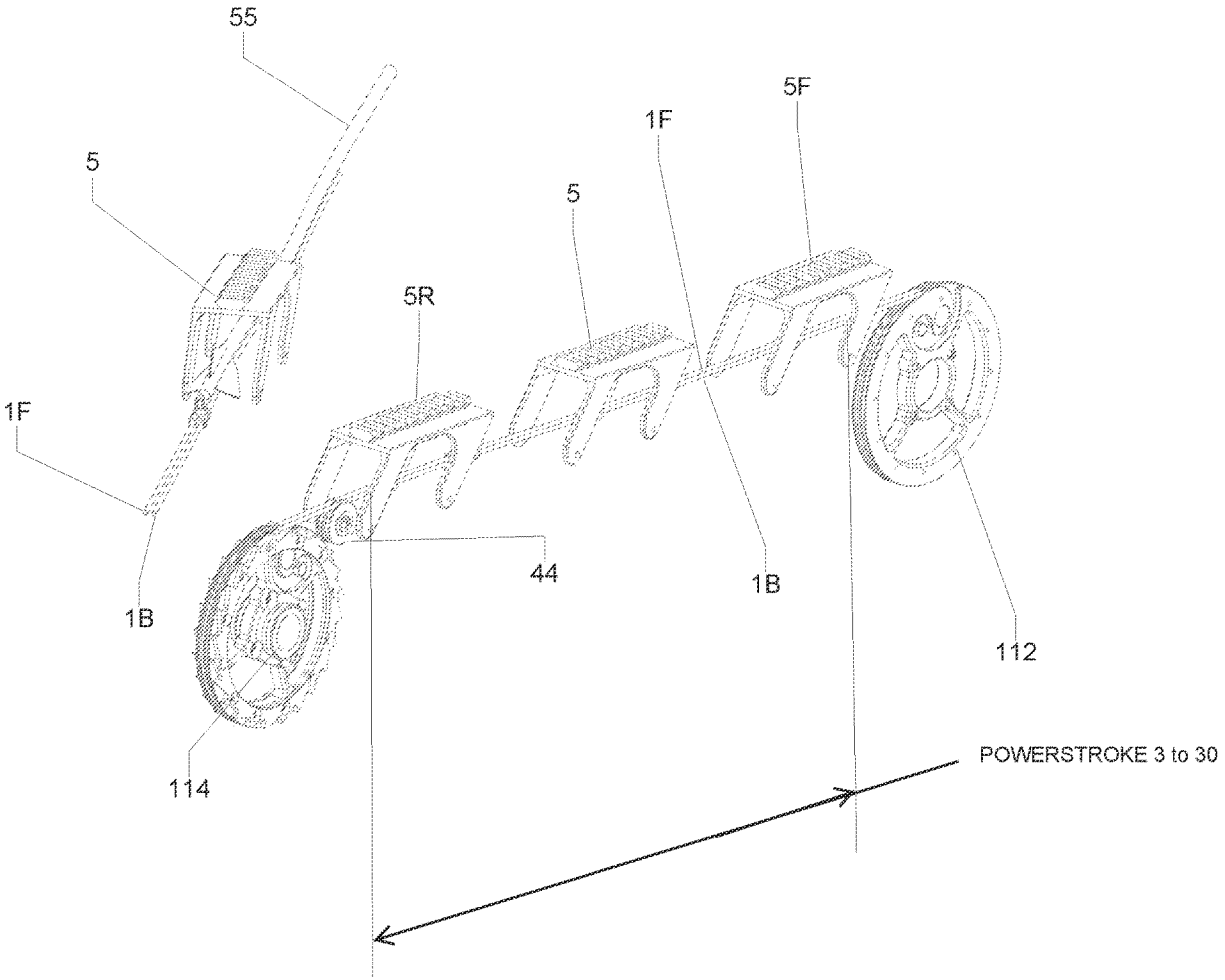
FIG. 49 is a perspective view of the scope mount setup in multiple positions showing the power stroke clearance of the scope mount.

FIGS. 43-45 illustrate the prior art methods. The Prior Art shown with a stock 555 and a rear string latch position of 506 and a at rest string position of 530 must remain clear along the side of the power stroke or arrow flight path. Therefore, the scope rail mount 510 is cantilevered as shown. The arrow 55 and the draw string must not have any interference when the crossbow is fired.

The figure in 43 lower part shows the dual mounted sight scope rail mount 510 with forward portion 520 making it a dual point mount. The forward portion 520 down straddle the rail or barrel but can only do this is a position that is forward of the draw string and the area between points 505 and 540 must remain clear for the entire power stroke distance 600 and 601 respectfully. Both of the above scope rail mounts must keep the entire power stroke or draw string travel area clear of the arrow 55 and the draw string.

Turning our attention to FIGS. 46 through 49 will show the proposed and unique scope rail mount 5 and the unique features. The scope sight mount 5 can straddle both sides of the stock anywhere along the length of the stock. Also, if the scope rail mount was the full length of the power stroke it would completely protect the shooter from ever touching the arrow or shuttle or draw strings making a safety guard and a scope rail mount.

The scope sight mount distance 62D from the buttstock to sight scope mount 5 is shown as 62D. This distance can be from 4 to 25 inches but preferably from 8 to 18 inches and ideally 10 to 12 inches. The length of the scope rail mount 5 is shown as 65D and is in the range of 0.5 to 24 inches and is preferably 1 to 6 inches and is ideally 4 inches. The scope rail mount 5 can include a picatinny rail or be a smooth top with holes to accept any number of sight scope mounts. The internal clearance height of the scope sight mount 5 is above the arrow 55 as shown as 63D and is in the range of 0.5 to 4 inches and preferably 1.5 inches. The scope rail mount 5 internal width clearance 64D is shown and is in the range of 0.25 to 4 inches and preferably 1.5 inches and must be wide enough to allow arrow 55 and vanes to clear without contact. The scope sight mount assembly 5 can also have multiple mount locations along the barrel allowing the user to adjust the eye relief since the scope rail assembly 5 does not interfere with the 1B and 1F draw strings or the arrow 55.

Furthermore, the scope mounting holes 38, 39, 40, 41 can have numerous locations as shown with additional holes 50, 51, 52, and 53 or the scope sight rail 5 could be placed on a linear slide mechanism. The scope rail mounted in position 5R is shown in a rear position and 5F show the scope rail mounted in a forward position. The main advantage of this type of scope rail mount is the rigidity it provides for extreme accuracy and the ability to change the eye relief for the shooter without effecting accuracy by having to cantilever or dual mount a scope rail adding significant weight. Obviously, the scope rail mount 5 can also be single side mounted to one side of the stock and is shown as scope rail mount 54 and still provide for a very rigid mount. The scope rail mount 5 or 54 must be above the draw strings 1F and 1B, the arrow 55 and vanes, and the arrow shuttle 33.

The described scope rail mount has never been able to historically be used on present day crossbows and will significantly improve the benefits of the linear crossbow. Finally, the scope rail mounts 5 and 54 defined provide for the most accurate and lightest assembly with eye relief adjustment to be used on a linear crossbow. The scope rail mounts 5 and 54 will work on any of the linear crossbows described in Sections 1 thru 9 as well as any other type of projectile weapon that uses a linear type of draw string assembly.

Section 7—Various Projectiles and Interchangeable Mounts

Some examples of the linear crossbow have yet another advantage over prior crossbows in the ability to not only shoot arrows or even large diameter arrows, but round shot, drones, missiles, small short arrows, spears, darts, grenades, cell phones, smoke canisters, and any number of projectiles that can be adaptably mounted to the draw string 1F and 1B of any of the designs described in Sections 1 thru 9. The projectiles can also be attached to a string for spear gun fishing or underwater use.

Figure 50:
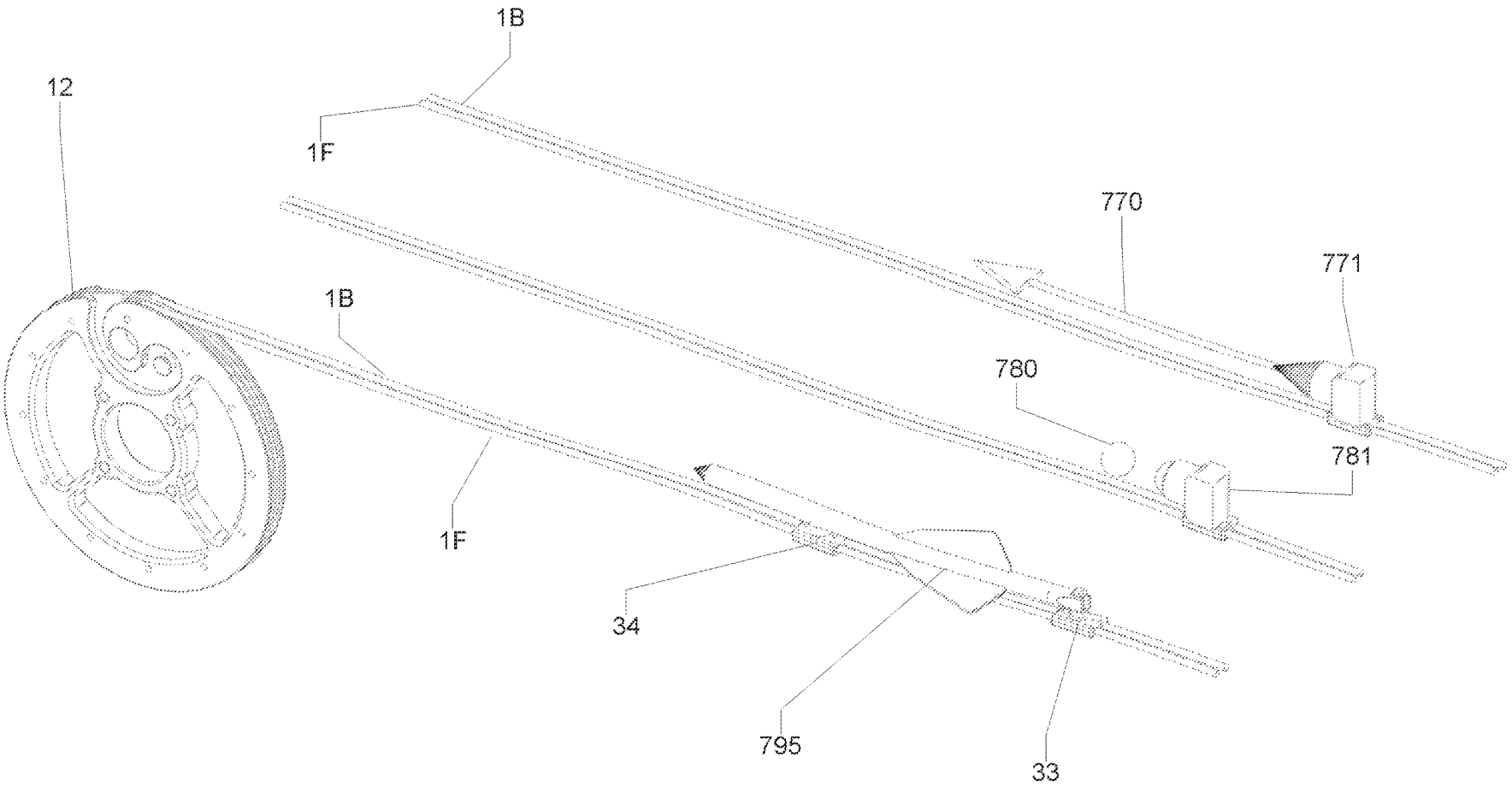
FIG. 50 is a perspective view of the arrow shuttle and various small projectiles and various attachment methods.

FIG. 50 shows only a few of the potential mounting options to shoot various projectiles. The projectiles launched will be in the weight range of 20 grains to 50 lbs and preferably 200 grains to 600 grains for most applications. The arrow mount shuttle 33 shown has a vertical post that duplicates the mounting means for attaching a standard arrow with a post that is 0.115 inches in diameter ideally.

The mount 781 shown is a receptacle mount that contains a small magnet that allows a steel round shot 780 to be held and then released at the end of the power stroke. Another mount 771 could also be to launch a dart 770 that is held with a rear mounted magnet. Another mounting method would use dual shuttles like shuttles 33 and 34 or this could be a single long shuttle that is about 0.5 to 8 inches long.

The spacing of shuttle 33 and 34 could be from 0.5 to 8 inches apart and preferably about 4 inches. The short arrow 795 shown can be from 2 to 12 inches and preferably about 6 inches. When using a short projectile that is either single or dual mounted the forward drop away or fixed arrow rest 56 is not required since the projectile is already supported. The arrow shuttle 33 and arrow 55 along with the forward arrow rest 56 is one of many ways to use the linear crossbow.

The methods described above are advantageous and can quickly and easily be interchanged either by mechanical means or a quick-change adaptable head to allow going from small short projectile to arrows within seconds. Since the linear crossbow has at least one and preferably two linear draw strings any number of mounts can be placed on the draw string 1F and 1B rigidly attached to accept any number of projectiles, as long as the projectile mounts stay between the draw string let out and draw string take up tracks during cocking and shooting of the linear crossbow. Current crossbows have projectile that usually have a single draw string and a draw string latch that engages the draw string and would interfere or be very difficult to interchange projectile types. The linear crossbow is ideal for this type of application.

Section 8—Fixed or Drop Away Rest System

The linear crossbows described above may use some type of forward arrow rest 56 and contains a standard mount 57 that will accept any number of arrow rests available on the market. The linear crossbow is unique in that the drop away rests can use the power cables of the design shown in FIG. 1 thru 10 and since the limbs and power cables are positioned as such that attaching the drop away power cord could be easily achieved.

Furthermore, the linear crossbow designs could contain addition take up or let out tracks to feed or take up a drop away power cord to allow the rest to function as on a vertical bow.

Finally, the linear crossbows shown by allowing any number of rests and having the arrow 55 supported between 33 arrow shuttle and 56 arrow rest the linear crossbow can be easily paper tuned to obtain perfect arrow flight by independently adjusting the arrow rest 56 up down left or right since it is mounted via standard mount 57 holes.

Section 9—Rear Take Up Latch, Trigger, and Variable Power Stroke

Figure 51:
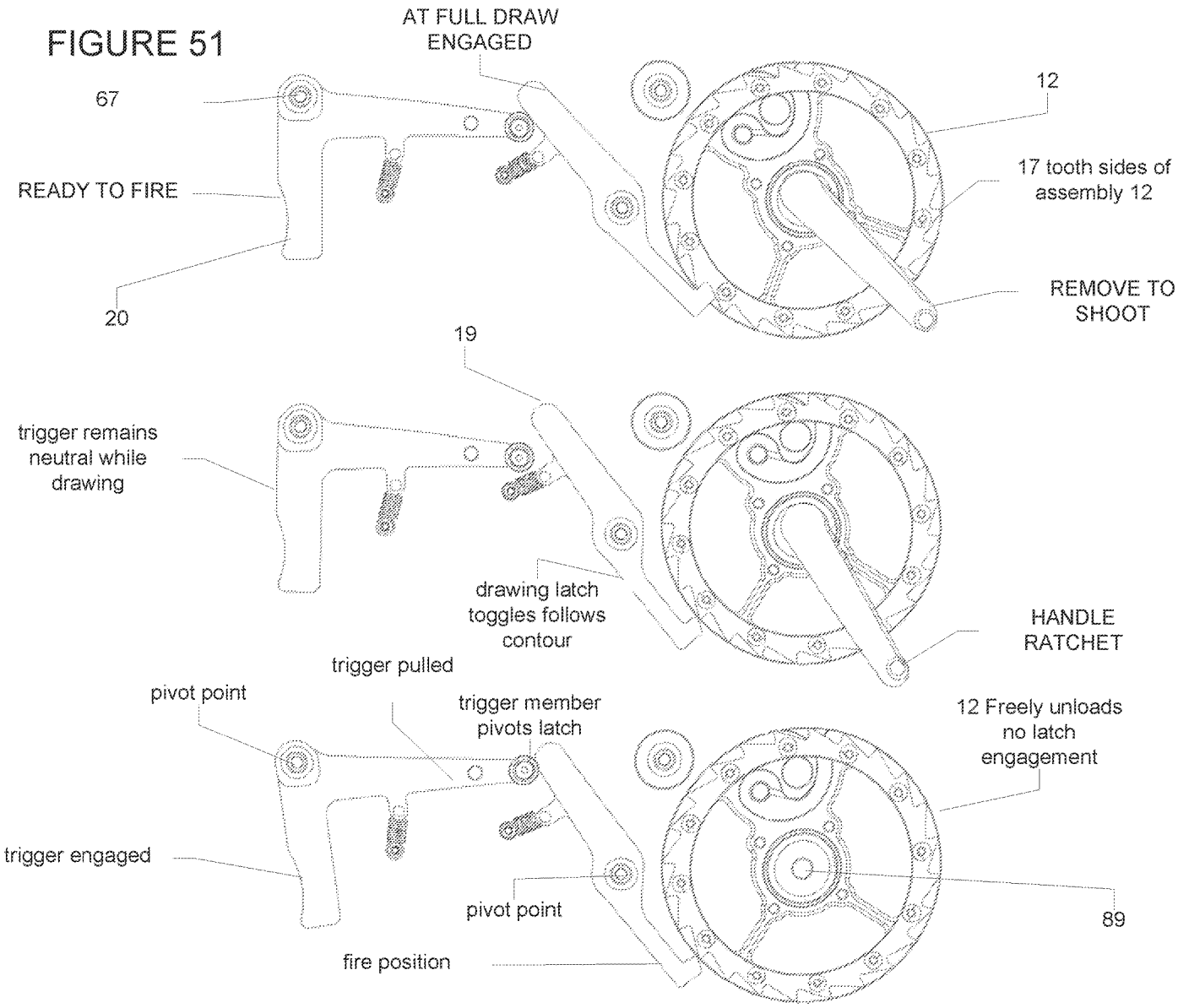
FIG. 51 is a side view of the rear take up and trigger and latch assembly in various position of fire, drawing, and loaded.

FIG. 51 shows details of examples of the rear take up assembly and trigger assembly. The linear crossbow is unique in that it does not engage the draw strings 1B and 1F or the arrow shuttle 33 or the arrow 55 to hold the linear crossbow at full draw. The described system could hold onto or latch the arrow shuttle 33 but this would put stresses on the arrow latch that could potentially slide on the support and draw strings when under tension or holding the linear crossbow in the drawn position.

Unlike prior art the crossbow interacts with the rear draw string take up 14 that contains a toothed assembly 17 and 18 that interact with the latch mechanism 19 to hold the crossbow at every toothed position while it is cocked. Furthermore, the linear crossbow trigger can be discharged with the trigger assembly 20 at any locked position along the full draw cycle or power stroke PS, allowing the shooter to vary the power of the projectile shot. This is not the only way this linear crossbow could be used, as you could obviously engage and hold the arrow 55, draw string 1B or 1F, or the shuttle 33 to hold the linear crossbow at full draw.

The disclosed method is a preferred method and allows for a very robust system for releasing the loaded weapon without wear and tear on the draw strings. Historically, the draw string is the preferred method to retaining a crossbow in the fully draw position; however, this causes severe wear on the draw string every time the crossbow is shot significantly reducing the life of the string and the safety. The new system trigger mechanism does not demonstrate a safety or anti-dry fire mechanism, but this could easily be added using any other method similar to prior art. Finally, having a trigger latch mechanism that can retains the crossbow at various power stroke position is very advantageous for shooting various projectiles or varying the power or kinetic energy of the projectile.

Section 10—Fixed Central Cams

Another configuration of the linear crossbow is shown in FIGS. 53 through 67, and FIG. 68 a reverse option. The linear crossbow uses a set of cams which are rotatably mounted and affixed to stock and centrally mounted to straddle the arrow flight path. The centrally mounted cams power cables are then directly attached the free end of the distally mounted limbs.

The timing of the central cams in the linear crossbow of FIGS. 53 to 68 is not an issue since the draw strings are pulled from the center from a single take up track assembly. The limbs of this linear crossbow could also have the limbs mounted forward or rearward. Furthermore, the linear crossbow could use any number of currently available cam means or round cams known in the art with or without let off. The details described here will focus primarily on the limbs, pulleys, cams and the rest will be understood to be similar or the same as the prior designs described in Section 1, 2, 3, and 4.

The following details describe the design for this linear crossbow starting with the limbs. The limbs 877F and 877B can either be single or split limbs design, also the limbs 877F and 877B are attached to a forward riser 880 section and are distally mounted from riser 880 and the riser 880 is affixed to stock 60. The limb 877F and 877B are affixed to riser 880 at point 860F and 860B. The limbs 877F and 877B are also supported over mid limb supports 811F and 811B to provide a moment for the limbs to flex over. The mid limb supports 811F and 811B are also affixed to the riser 880 as shown. The limbs 877F and 877B free ends have one end of the power cables 817 and 818 affixed at points 822B and 822F as shown.

The pair of cams 830F and 830B are rotatably mounted to the stock 60 and a bracket 899 with a set of axles at points 815 and 816 and have bearing to reduce friction and improve efficiency. The distance of the cam to cam center is about 4 inches and depends on the size of the cams. The main design criteria is that the tangent point of both cams has a spacing that is close enough to allow the shuttle 33 to have an almost constant spacing of about 0 to 1 inches apart and ideally about 0.2" apart for the draw string 800B and 800F.

The other opposite ends of power cables 817 and 818 are attached to the cams 830F and 830B at points 830AB and 830AF. The cams 830F and 830B have a power cable string track such that upon drawing of the linear crossbow the power cables are wrapped around the corresponding power cable take up groove on each cam. The power cables 817 and 818 take up the power cables during the draw cycle and bias the draw stings 800F and 800B to the undrawn state while flexing the limbs 877B and 877B creating a draw force curve to propel the arrow 55 and move the shuttle 33 between two points very quickly.

An arrow shuttle 33 is affixed to the pair of draw strings 800F and 800B such that it travels between the draw and undrawn position in a linear path along the arrow flight path between the cams 830F and 830B and the rearward take up assembly 814. Again, the timing portion is not critical with this linear crossbow since the draw strings 800B and 800F are drawn along a linear path from a single take up string assembly 814. The power or bias to the draw strings in this design is provided between the limbs and centrally mounted cams 830B and 830F and is commonly used in crossbows.

Furthermore, one main advantage is that the power cables 817 and 818 are not in the arrow flight paths as with other crossbows on the market thus reducing cable wear and improving safety and efficiency. Furthermore, the cables 817 and 818 are not guided further increasing the efficiency of this design.

The cams 830F and 830B both have string let out tracks and in the undrawn position have draw strings attached at point 800AF and 800AB, then 800F and 800B are wrapped around the circumference of the cam string tracks and the draw strings are then directed to the rear stop pulley 44 and then onto the rear draw string take up assembly 814. The rear take up assembly is rotatably mounted with bearing about axle 89. The rear take up assembly 814 has two string grooves and draw string attachment means. The rear take up assembly 814 also contains a ratcheting means or toothed assemblies 17 and 18 attached to the rear take up that interact with the latch mechanism 19 and trigger assembly 20. The stop pulley is rotatably mounted to the stock with axle 45 and spins freely. The draw strings 800F and 800B are attached to the rear take up assembly 814 at point 800AB and 800AF.

During the drawing and undrawing of the linear crossbow the arrow shuttle 33 move along a linear path or the power stroke of the linear crossbow which is about 14 inches. Furthermore, the draw strings 800B and 800F are biased to remains loaded on the string let out tracks of the cams 830F and 830B but payout the retained draw string to the rear take up assembly 814 when the assembly is ratcheted using a ratchet attachment point on axle 89 to take up the string until the majority of the draw string moves to the take up assembly.

During the shooting or undrawing of the linear crossbow the draw strings are quickly unloaded from the take up assembly 814 to the let out assembly moving the arrow shuttle 33 and propelling the arrow 55. The process repeats while the linear crossbow is loaded, cocked, and fired. The rest of the function of this design has been described above in Section 1, 2, 3, and 4.

The axle to axle width of the linear crossbow described can have a width between 5 inches and 24 inches depending on the angle of the limbs, but preferable in the range of about 7 inches in undrawn position. The power stroke PS of this design would be in the range of 1 to 30 inches and preferably around 15 inches. The arrow shuttle 33 is affixed to draw strings 800F and 800B such that going from the undrawn to drawn position the arrow shuttle moves about 15 inches in the direction of arrow flight and remains attached and under tension. To increase the power stroke the size of 830B and 830F cams can be larger or spiral wound or any other method of providing draw string. Any of the cam arrangements known in the prior art can be used, but simply taking the draw string and separating the draw string from a cam to cam but instead from a cam to rear take up system for both cams is the main unique technique of the this embodiment.

The draw strings 800F and 800B could be combined into one draw string after leaving the cams 830B and 830F and then directed to a single groove track on the rear take up assembly 814 and the arrow shuttle 33 could be attached to a single draw string but may require some guiding. The described above is the preferred method of operation.

Figure 68:
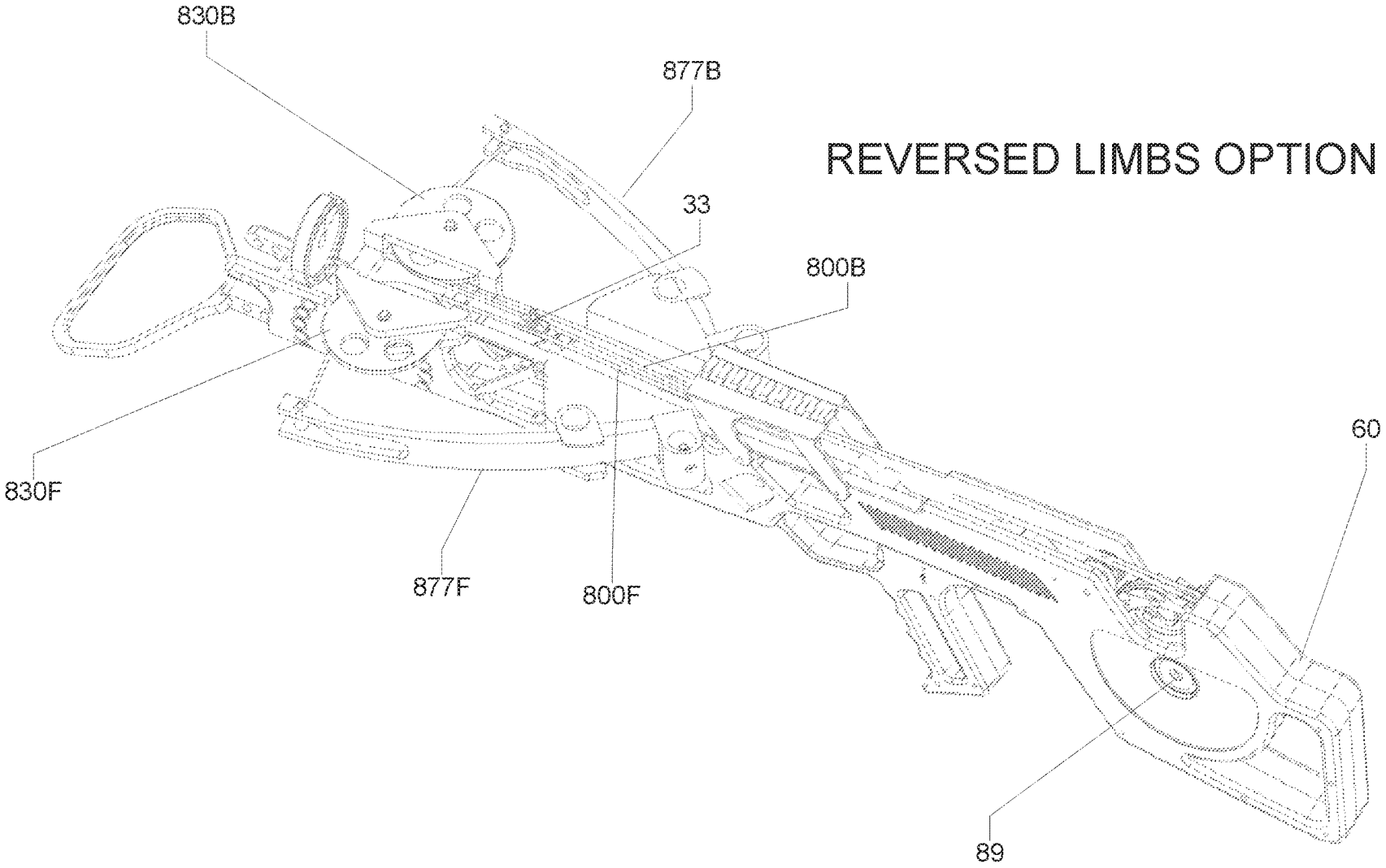
FIG. 68 is a left perspective view of the crossbow of FIG. 53 in the undrawn position and the limb and cams REVERSED to show the same design can be flipped if desired.

The details of the linear crossbow shown in FIG. 68 are the same as the above described but as shown in detail the limbs and cams are reversed and the limbs are pointing in the forward direction. The design of FIG. 68 would shift more weight rearward and possibly balance better than the design described above. The numerals are the same as those used to describe the normal and reverse design in FIG. 68 to allow someone to easily follow the differences in the two designs.

What is claimed is:

1. A crossbow, comprising:

a stock defining a projectile axis;

a drawstring configured to move along the projectile axis between an undrawn position and a drawn position, the undrawn position defining a first power stroke end, the drawn position defining a second power stroke end; and a scope rail mount including a first support and a second support, the first support coupled to the stock at a first mount location positioned rearward of the first power stroke end, the second support coupled with the stock at a second mount location positioned rearward of the first mount location and forward of the second power stroke end.

2. The crossbow of claim 1, wherein the scope rail mount straddles the projectile axis.

3. The crossbow of claim 1, the stock defining a first side and a second side, wherein the first support and the second support are coupled with the first side.

4. The crossbow of claim 1, the stock defining a first side and a second side, wherein the first support and the second support are coupled with the first side, the crossbow further comprising:

the scope rail mount including a third support, the third support coupled to the stock at a third mount location, the third mount location positioned on the second side of the stock.

5. The crossbow of claim 1, the stock defining a front end and a rear end, the crossbow further comprising:

a limb, including:

a fixed end coupled to the stock between the front end and the rear end; and a free end positioned between the front end and the rear end;

wherein the first mount location is positioned rearward of the fixed end of the limb and forward of the free end of the limb.

6. The crossbow of claim 1, the stock defining a front end and a rear end, the crossbow further comprising:

a limb, including:

a fixed end coupled to the stock between the front end and the rear end; and a free end positioned between the front end and the rear end;

wherein the first mount location is positioned forward of the fixed end of the limb and rearward of the free end of the limb.

7. The crossbow of claim 1, the stock defining a front end and a rear end, wherein the scope rail mount is positioned about 8 to about 18 inches from the rear end.

8. The crossbow of claim 1, wherein the scope rail mount includes a length of about 4 inches to about 24 inches.

9. A crossbow, comprising:

a stock defining a front end, a rear end, a first side, a second side, and a projectile axis;

a drawstring configured to move along a projectile flight path between an undrawn position and a drawn position;

a limb, including:

a fixed end coupled to the stock between the front end and the rear end; and a free end positioned between the front end and the rear end; and a scope rail mount including a first support and a second support, the first support coupled to the stock at a first mount location positioned (i) forward of at least one of the free end of the limb or the fixed end of the limb and (ii) rearward of the other of the free end of the limb or the fixed end of the limb, the second support coupled with the stock at a second mount location positioned rearward of the first mount location;

wherein the scope rail mount is positioned rearward of at least a portion of the drawstring with the drawstring in the undrawn position;

wherein the undrawn position of the drawstring defines a first power stroke end and the drawn position of the drawstring defines a second power stroke end, wherein the first mount location is positioned rearward of the first power stroke end and the second mount location is positioned forward of the second power stroke end.

10. The crossbow of claim 9, wherein the scope rail mount straddles the projectile axis.

11. The crossbow of claim 9, wherein the first support and the second support are coupled with the first side.

12. The crossbow of claim 9, the stock defining a first side and a second side, wherein the first support and the second support are coupled with the first side, the crossbow further comprising:

the scope rail mount including a third support, the third support coupled to the stock at a third mount location, the third mount location positioned on the second side of the stock.

13. The crossbow of claim 9, wherein the scope rail mount is positioned about 8 to about 18 inches from the rear end.

14. A crossbow, comprising:

a stock defining a front end, a rear end, a first side, a second side, and a projectile axis;

a drawstring configured to move along a projectile flight path between an undrawn position and a drawn position;

a limb, including:

a fixed end coupled to the stock; and a free end positioned between the front end and the rear end; and a scope rail mount including a first support and a second support positioned rearward of at least a portion of the drawstring with the drawstring in the undrawn position, the first support coupled with the first side of the stock and the second support coupled with the second side of the stock such that the scope rail mount straddles the projectile axis, wherein the scope rail mount is positioned about 8 inches to about 18 inches from the rear end, and wherein the first support and the second support are positioned forward of at least one of the free end of the limb or the fixed end of the limb.

15. The crossbow of claim 14, wherein the first support is coupled to the stock at a first mount location positioned (i) forward of at least one of the free end of the limb or the fixed end of the limb and (ii) rearward of the other of the free end of the limb or the fixed end of the limb.

16. The crossbow of claim 14, wherein the undrawn position of the drawstring defines a first power stroke end and the drawn position of the drawstring defines a second power stroke end, wherein the first support and the second support are positioned between the first power stroke end and the second power stroke end.

17. The crossbow of claim 14, further comprising:

the scope rail mount including a third support, the third support coupled to the stock and positioned rearward of the first support and the second support.

18. The crossbow of claim 14, comprising:

the scope rail mount including a third support, the third support coupled to the stock and positioned rearward of the first support and the second support;

wherein the undrawn position of the drawstring defines a first power stroke end and the drawn position of the drawstring defines a second power stroke end; and wherein the first support, the second support, and the third support are positioned between the first power stroke end and the second power stroke end.

19. The crossbow of claim 14, comprising:

wherein the scope rail mount includes a length of about 4 inches to about 24 inches.

* * * * *